US012011085B2

(12) United States Patent
Hermann et al.

(10) Patent No.: US 12,011,085 B2
(45) Date of Patent: Jun. 18, 2024

(54) STORAGE SYSTEM

(71) Applicant: Great Star Industrial USA, LLC, Huntersville, NC (US)

(72) Inventors: John A. Hermann, Huntersville, NC (US); Jay Fording, Davidson, NC (US); Bob Hardison, Mooresville, NC (US); Mike Webb, Concord, NC (US)

(73) Assignee: Great Star Industrial USA, LLC, Huntersville, NC (US)

( * ) Notice: Subject to any disclaimer, the term of this patent is extended or adjusted under 35 U.S.C. 154(b) by 6 days.

(21) Appl. No.: 17/529,994

(22) Filed: Nov. 18, 2021

(65) Prior Publication Data

US 2022/0218104 A1 Jul. 14, 2022

Related U.S. Application Data

(63) Continuation of application No. 16/704,826, filed on Dec. 5, 2019, now Pat. No. 11,206,922.

(60) Provisional application No. 62/775,547, filed on Dec. 5, 2018.

(51) Int. Cl.

| | |
|---|---|
| ***A47B 46/00*** | (2006.01) |
| ***A47B 57/08*** | (2006.01) |
| ***A47B 57/16*** | (2006.01) |
| ***A47B 67/04*** | (2006.01) |

(52) U.S. Cl.

CPC ..... *A47B 46/00* (2013.01); *A47B 57/08* (2013.01); *A47B 57/16* (2013.01); *A47B 67/04* (2013.01)

(58) Field of Classification Search

CPC ..... A47B 46/00; A47B 57/08; A47B 57/16; A47B 67/04; A47B 87/02

USPC ..... 312/107, 408, 351; 108/6

See application file for complete search history.

(56) References Cited

U.S. PATENT DOCUMENTS

| | | | | |
|---|---|---|---|---|
| 1,850,572 | A * | 3/1932 | Starck | A47B 83/045 108/33 |
| 3,125,385 | A | 3/1964 | Friedman | |
| 3,563,624 | A | 2/1971 | Stice | |
| 4,433,881 | A | 2/1984 | Witten | |
| 4,903,451 | A | 2/1990 | Gresswell | |
| 5,158,503 | A * | 10/1992 | Mitchell | E05D 3/12 16/302 |
| 5,492,399 | A | 2/1996 | Tillack | |
| 5,653,416 | A | 8/1997 | Frank | |

(Continued)

OTHER PUBLICATIONS

U.S. Appl. No. 16/704,826, filed Dec. 5, 2019, U.S. Pat. No. 11,206,922, Issued.

*Primary Examiner* — James O Hansen
(74) *Attorney, Agent, or Firm* — Alston & Bird LLP

(57) ABSTRACT

Provided herein are systems, methods, and apparatus related to a storage system. The storage system may include one or more cabinets having shelves including a foldable panel. The storage system may include one or more cabinets having shelves including a fixed portion and a sliding portion configured to slide relative to the fixed portion. A modular storage system may be provided including a plurality of cabinet units that may fixedly attach to each other. A locking mechanism including a locking foot and locking element may be provided for connecting multiple cabinets in a modular cabinet assembly. Some embodiments may include a drawer and secondary work surface assembly for a shelf capable of use in a cabinet.

14 Claims, 44 Drawing Sheets

(56) References Cited

U.S. PATENT DOCUMENTS

| | | | | |
|---|---|---|---|---|
| 5,813,741 | A * | 9/1998 | Fish | F25D 25/024 312/351 |
| 5,826,955 | A | 10/1998 | Sanders | |
| 6,267,462 | B1 | 7/2001 | Krause | |
| 6,318,822 | B1 | 11/2001 | Wang | |
| 6,450,599 | B1 * | 9/2002 | Mamuyac | A47B 46/005 312/258 |
| 7,740,331 | B2 * | 6/2010 | Koo | F25D 23/021 312/402 |
| 8,403,438 | B2 * | 3/2013 | Park | F25D 25/02 108/143 |
| 8,540,326 | B2 | 9/2013 | Moszer | |
| 8,601,765 | B2 | 12/2013 | Lord | |
| 9,271,570 | B2 * | 3/2016 | Ceballos Godefroy | A47F 5/10 |
| 2002/0078525 | A1 * | 6/2002 | Hua | E05D 1/02 16/221 |
| 2003/0085640 | A1 * | 5/2003 | Chan | A47B 43/00 312/262 |
| 2006/0132008 | A1 * | 6/2006 | Benefiel | A47B 96/027 312/408 |
| 2011/0241501 | A1 | 10/2011 | Heo | |
| 2012/0242200 | A1 | 9/2012 | Keragala | |
| 2014/0375199 | A1 * | 12/2014 | Lee | F25D 25/024 312/404 |
| 2016/0273828 | A1 * | 9/2016 | Burke | F25D 25/02 |
| 2019/0056170 | A1 * | 2/2019 | Im | F25D 23/067 |

* cited by examiner

STORAGE SYSTEM

CROSS REFERENCE TO RELATED APPLICATIONS

This application is a continuation of U.S. application Ser. No. 16/704,826 (published as U.S. 2020/0178686), filed Dec. 5, 2019 and entitled "Storage System", which application claims the benefit of U.S. provisional application No. 62/775,547, filed Dec. 5, 2018 and entitled "Storage System," which application is hereby incorporated by reference herein in its entirety.

BACKGROUND

Storage systems may be used to organize home and commercial goods, including tools, paint, and other items. Storage needs vary greatly across both individual and the environment in which items are stored. System flexibility is extremely important for the longevity and usefulness of the product and is a key purchase driver. The embodiments of the storage systems disclosed herein address current shortcomings of existing products with the features, structure, and capabilities disclosed herein. Through applied effort, ingenuity, and innovation, many of these identified problems have been solved by developing solutions that are included in embodiments of the present invention, many examples of which are described in detail herein.

BRIEF SUMMARY

Disclosed herein are systems, methods, and apparatus related to storage systems. In some embodiments, a storage system may be provided. The storage system may include a cabinet defining a top wall, a bottom wall, a left side wall, and a right side wall; a first shelf engaged with the cabinet and extending between the left side wall and the right side wall, the first shelf comprising a foldable panel hingedly connected to a frame; and a second shelf engaged with the cabinet and extending between the left side wall and the right side wall. The first shelf may be disposed closer to the bottom wall than the second shelf.

In some embodiments, the storage system may include at least one bin removably attached to the cabinet. The bin may include at least one protrusion for engaging the cabinet. In some embodiments, the second shelf may include a second foldable panel hingedly connected to a second frame, and the second foldable panel and the foldable panel may be vertically aligned. In some embodiments, the first shelf may include a third foldable panel hingedly connected to the frame independently of the foldable panel. In some embodiments, the storage system may include a third shelf above the first shelf, the third shelf comprising a secondary work surface configured to extend from beneath the third shelf to an in-use position.

In some embodiments, a storage system may be provided that includes a cabinet defining a top wall, a bottom wall, a left side wall, and a right side wall; a first shelf engaged with the cabinet and extending between the left side wall and the right side wall, the first shelf may include a fixed portion and a slidable portion. The slidable portion may be configured to slide relative to the fixed portion between a stowed position and an in-use position, and in the stowed position, at least a portion of the slidable portion of the first shelf may be disposed below the fixed portion of the first shelf.

In some embodiments, the fixed portion and the slidable portion may be parallel to each other in both the stowed position and the in-use position. The storage system may include a second shelf engaged with the cabinet and extending between the left side wall and the right side wall. The second shelf may include a second fixed portion and a second slidable portion. The second slidable portion may be configured to slide relative to the second fixed portion between a stowed position and an in-use position. In the stowed position, at least a portion of the second slidable portion of the second shelf may be disposed below the second fixed portion of the second shelf. The fixed portion of the first shelf and the second fixed portion of the second shelf may be vertically aligned, and the slidable portion of the first shelf and the second slidable portion of the second shelf may be vertically aligned in an instance in which both the slidable portion of the first shelf and the second slidable portion of the second shelf are in the in-use position. In some embodiments, the first shelf may include third slidable portion. The third slidable portion may be configured to slide relative to the fixed portion between a stowed position and an in-use position, and in the stowed position, at least a portion of the third slidable portion of the first shelf may be disposed below the fixed portion of the first shelf.

In some embodiments, a modular storage system may be provided. The modular storage system may include a plurality of cabinet units configured to engage each other. The plurality of cabinet units may include a first cabinet unit comprising a top wall and a bottom wall, and a second cabinet unit comprising a top wall and a bottom wall. The first cabinet unit and the second cabinet unit may define a first configuration in which the top wall of the first cabinet unit may be connected to the bottom wall of the second cabinet unit such that the first cabinet unit and the second cabinet unit may be fixedly attached with the second cabinet unit on top and a second configuration in which the bottom wall of the first cabinet unit may be connected to the top wall of the second cabinet unit such that the first cabinet unit and the second cabinet unit may be fixedly attached with the first cabinet unit on top.

In some embodiments, each of the first cabinet and the second cabinet may include at least one first locking mechanism disposed at their respective bottom walls. Each of the first cabinet and the second cabinet may include at least one second locking mechanism disposed at their respective top walls. Each first locking mechanism may be structured to engage each second locking mechanism. In some embodiments, the at least one first locking mechanisms and the at least one second locking mechanisms define complementary shapes. The at least one first locking mechanisms may be locking feet. The at least one second locking mechanisms may be locking elements. In some embodiments, the first cabinet unit and the second cabinet unit may be configured to be changed between the first configuration and the second configuration without mechanical tools.

In some embodiments, a locking foot for a cabinet may be provided. The locking foot may include a pin member and at least one foot portion. The foot portion may include a proximal portion configured to engage the cabinet and a distal supporting portion configured to engage an external surface to support the cabinet. The foot portion may define an opening at a position between the proximal portion and the distal portion, the opening being configured to receive the pin member therethrough. In some embodiments, the at least one foot portion may define a second opening configured to receive the pin member or a second pin member therethrough. In some embodiments, the at least one foot portion may include two angled support arms extending inwardly towards each other from the proximal portion to the distal supporting portion. The distal supporting portion may extend between respective distal ends of each of the two angled support arms. In some embodiments, the proximal portion may include two flanges extending from respective proximal ends of the two angled support arms.

In some embodiments, a modular cabinet may be provided, which may include a bottom wall defining a bottom surface, and the locking foot extending from the bottom surface. In some embodiments, the proximal portion of the at least one foot portion may be engaged with the bottom surface of the bottom wall.

In some embodiments, a modular assembly may be provided, which may include a modular cabinet; and a second modular cabinet. The second modular cabinet may include a top wall defining a top surface and a locking element configured to engage the locking foot at or proximate the top wall to fixedly and removably attach the modular cabinet to the second modular cabinet. In some embodiments, the top surface of the top wall of the second modular cabinet may define an opening, and the locking foot may be configured to extend at least partially through the opening in an instance in which the locking foot is engaged with the locking element. The top wall of the second modular cabinet may define a bottom surface opposite the top surface, and the locking element may be attached to the bottom surface of the top wall. In some embodiments, the second cabinet may define a bottom wall opposite the top wall. The locking element may include a proximal portion engaged with the bottom surface of the top wall and a distal portion beneath the bottom surface between the top wall and the bottom wall. The locking element may define an opening at a position between the proximal portion and the distal portion, and the pin member of the locking foot may be configured to engage the opening. The locking element and the locking foot may define a same shape, and the locking element and the locking foot may define a same orientation during engagement. In some embodiments, both the modular cabinet and the second modular cabinet may include additional engagement features configured to receive legs therein for respectively supporting the modular cabinet or the second modular cabinet on ground.

In some embodiments, a hinge for a cabinet door may be provided. The hinge may include a plate configured to engage a cabinet frame; and a hinge body pivotally connected to the plate at a first hinge joint and configured to rotate about a first axis extending along the first hinge joint. The hinge body may define a second engaging portion spaced from the first axis, the second engaging portion may be configured to engage the cabinet door, such that hinge body may be configured to permit the cabinet door to rotate about a second axis parallel to and spaced from the first axis.

In some embodiments, an assembly may be provided that includes a shelf; and a drawer assembly. The drawer assembly may include a drawer disposed beneath the shelf and configured to slide between a stowed position and an open position; and a secondary work surface disposed between the shelf and the drawer relative to a vertical direction. The secondary work surface may be configured to slide between a stowed position and an in-use position.

In some embodiments, the drawer may include an engaging flange at a first end configured to limit the sliding of the secondary work surface and prevent the secondary work surface from sliding past the first end of the drawer. The drawer may be attached to the shelf via one or more sliding elements attached thereto. The secondary work surface may be configured to move independently of the drawer. In some embodiments, the drawer may include a track extending along each of a left and right surface of the drawer, and the secondary work surface may be engaged with and configured to slide along the tracks. The assembly may further include a lock configured to hold the secondary work surface over the drawer to close an interior of the drawer. In some embodiments, a second drawer may be engaged with and configured to slide relative to the drawer. The second drawer may be attached to an underside of the drawer via at least one sliding element.

In some embodiments, methods of manufacture and use of any of the apparatus and systems described herein may also be provided.

BRIEF DESCRIPTION OF THE DRAWINGS

Figure 1:
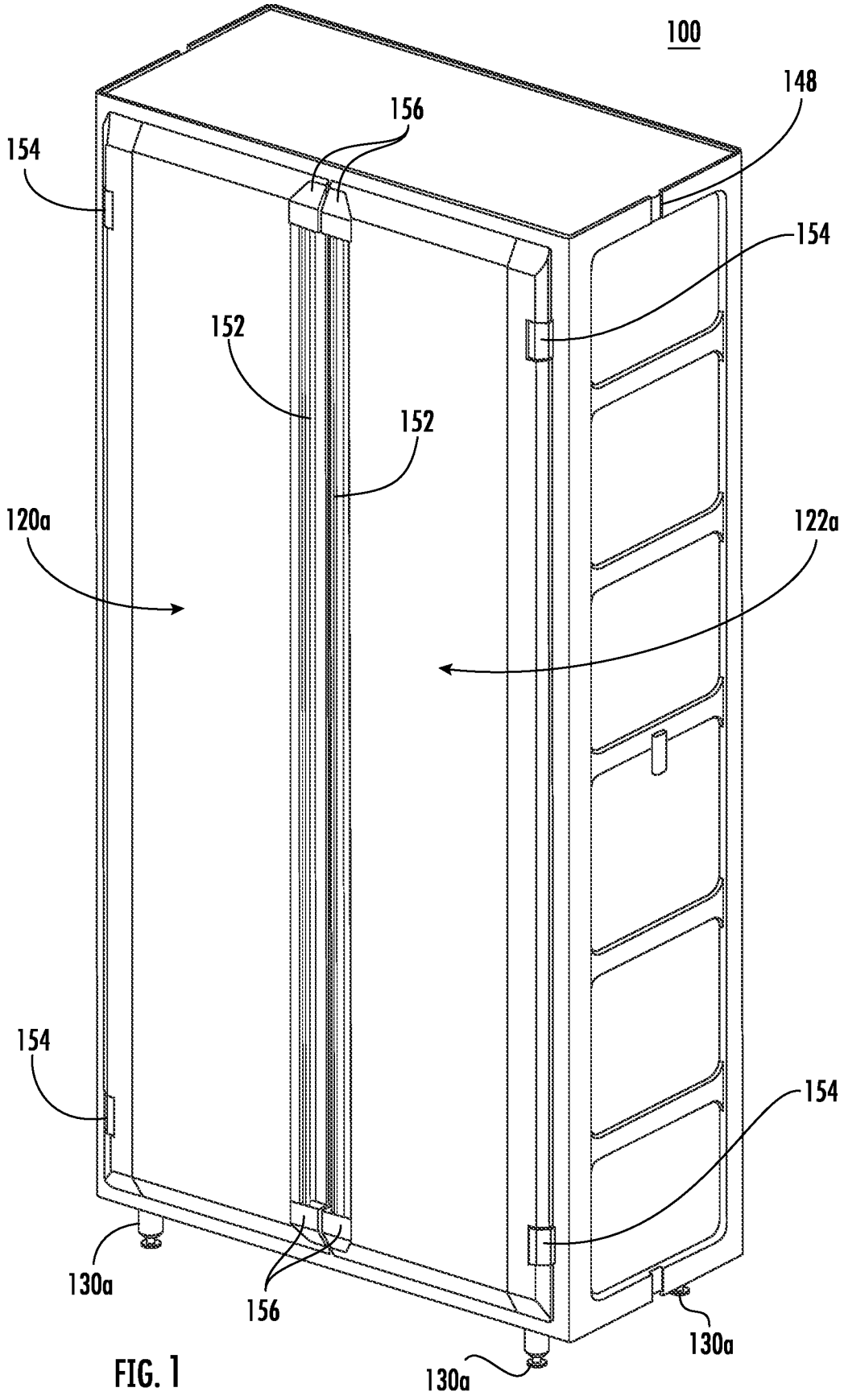
Figure 3:
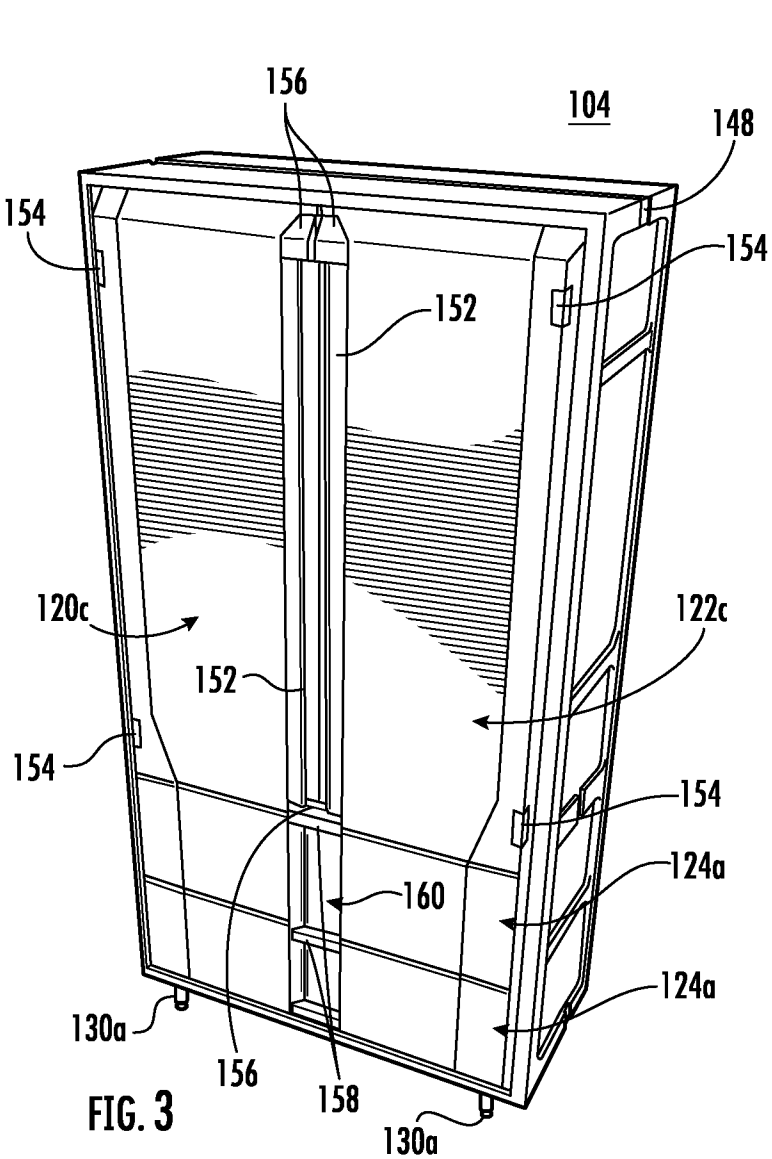
Figure 2:
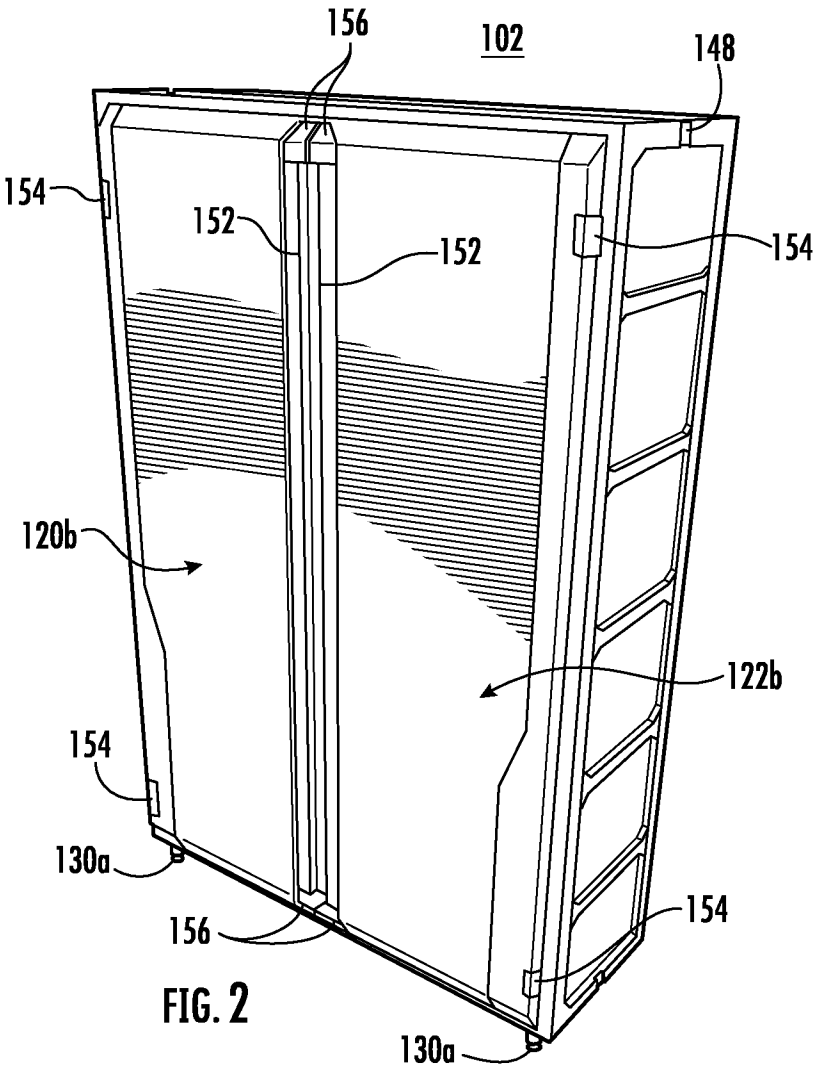
Figure 4:
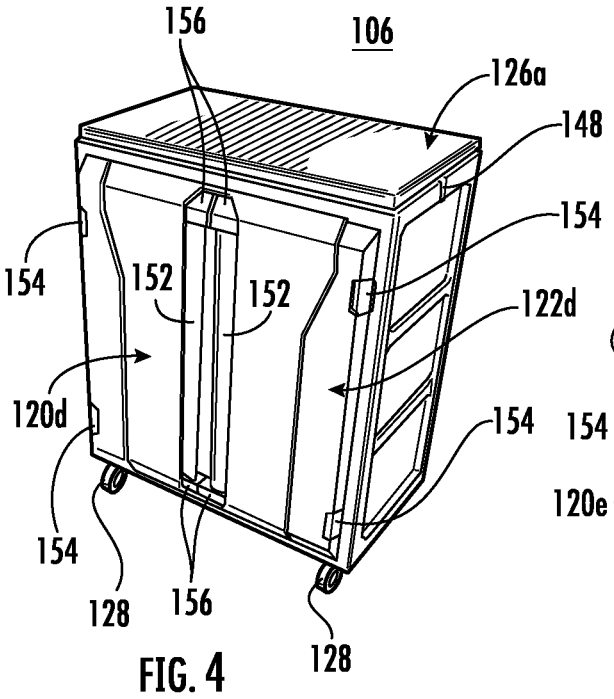
Figure 6:
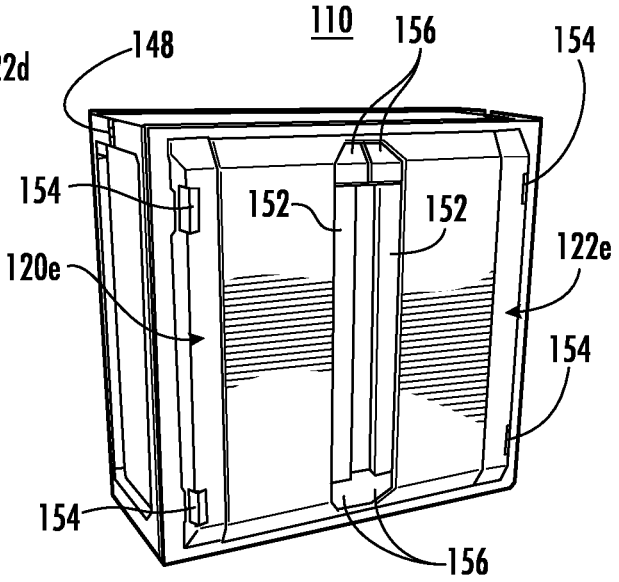
Figure 5:
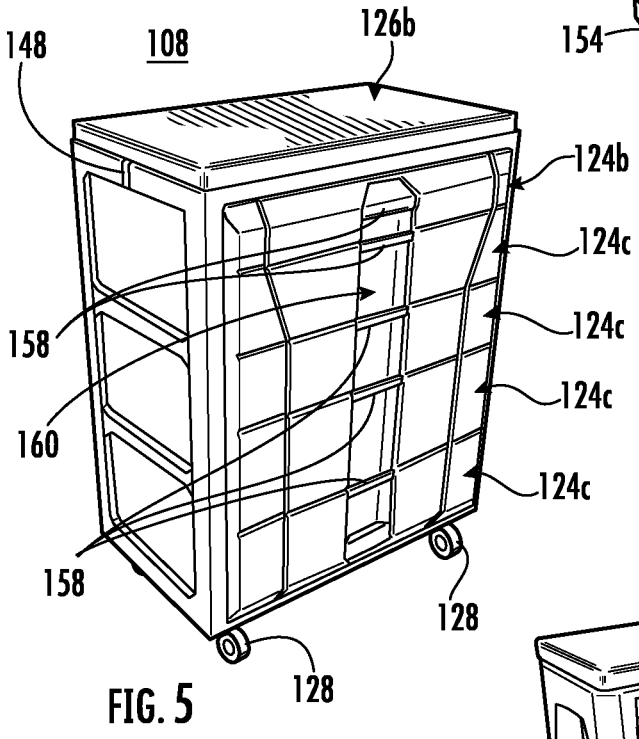
Figure 7:
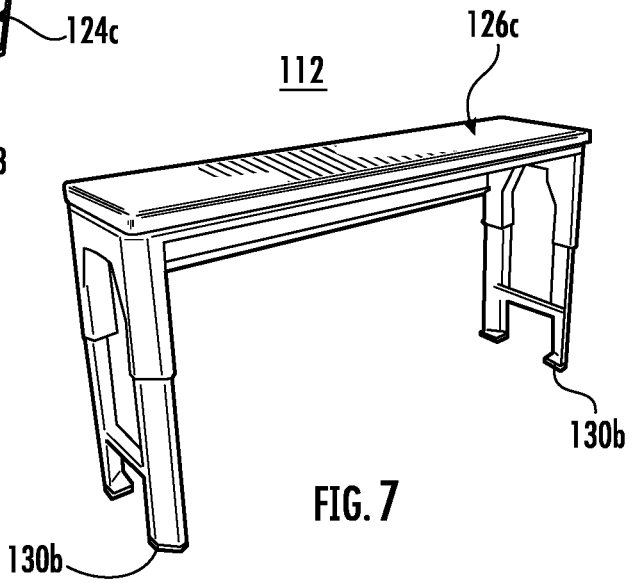
Figure 8:
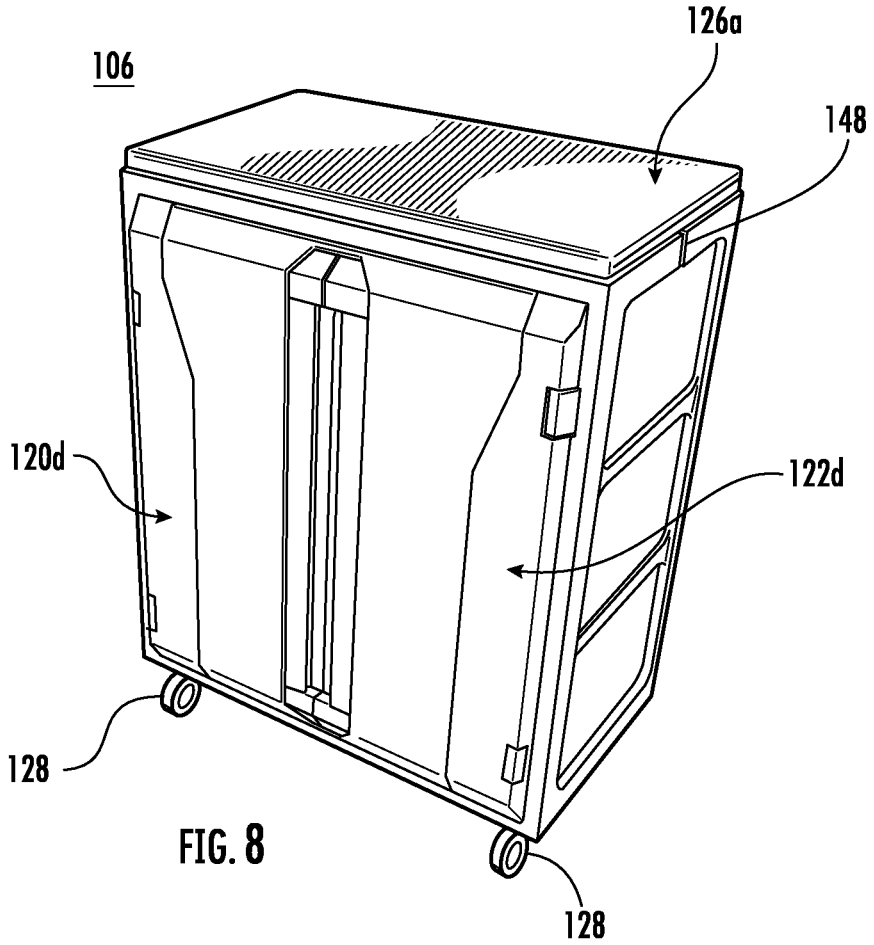
Figure 9:
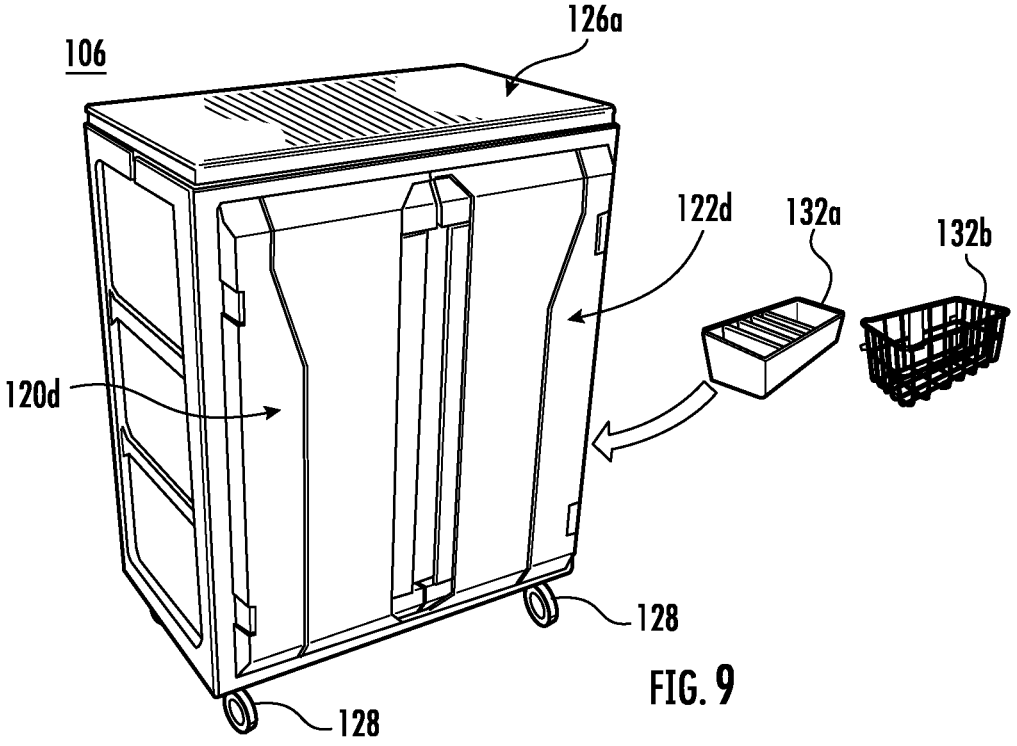
Figure 10:
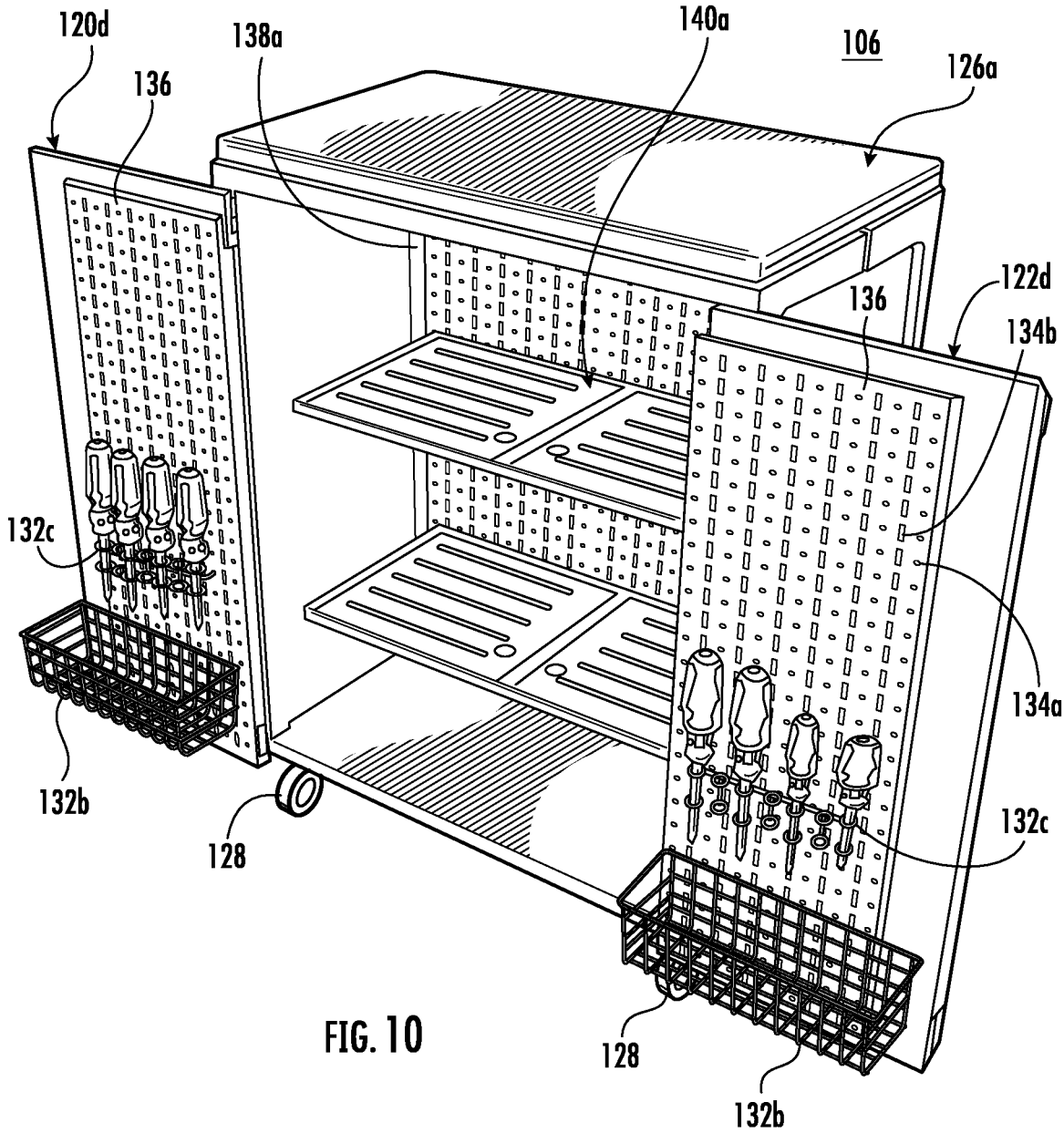
Figure 11:
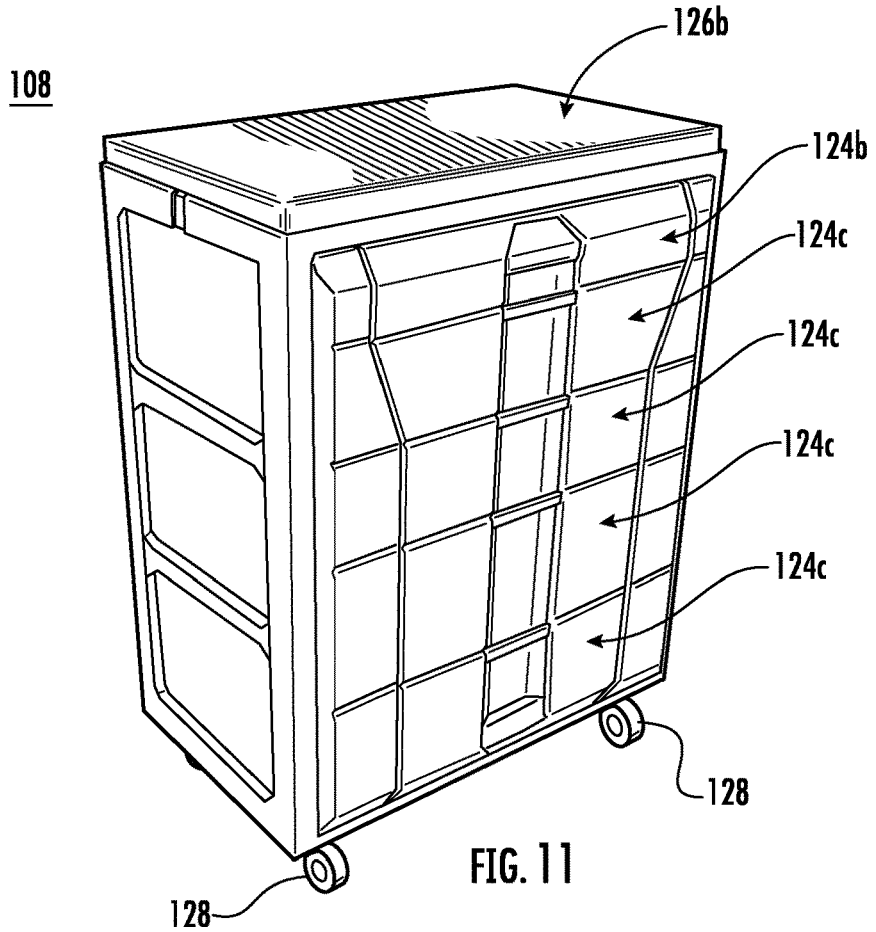
Figures 17, 18:
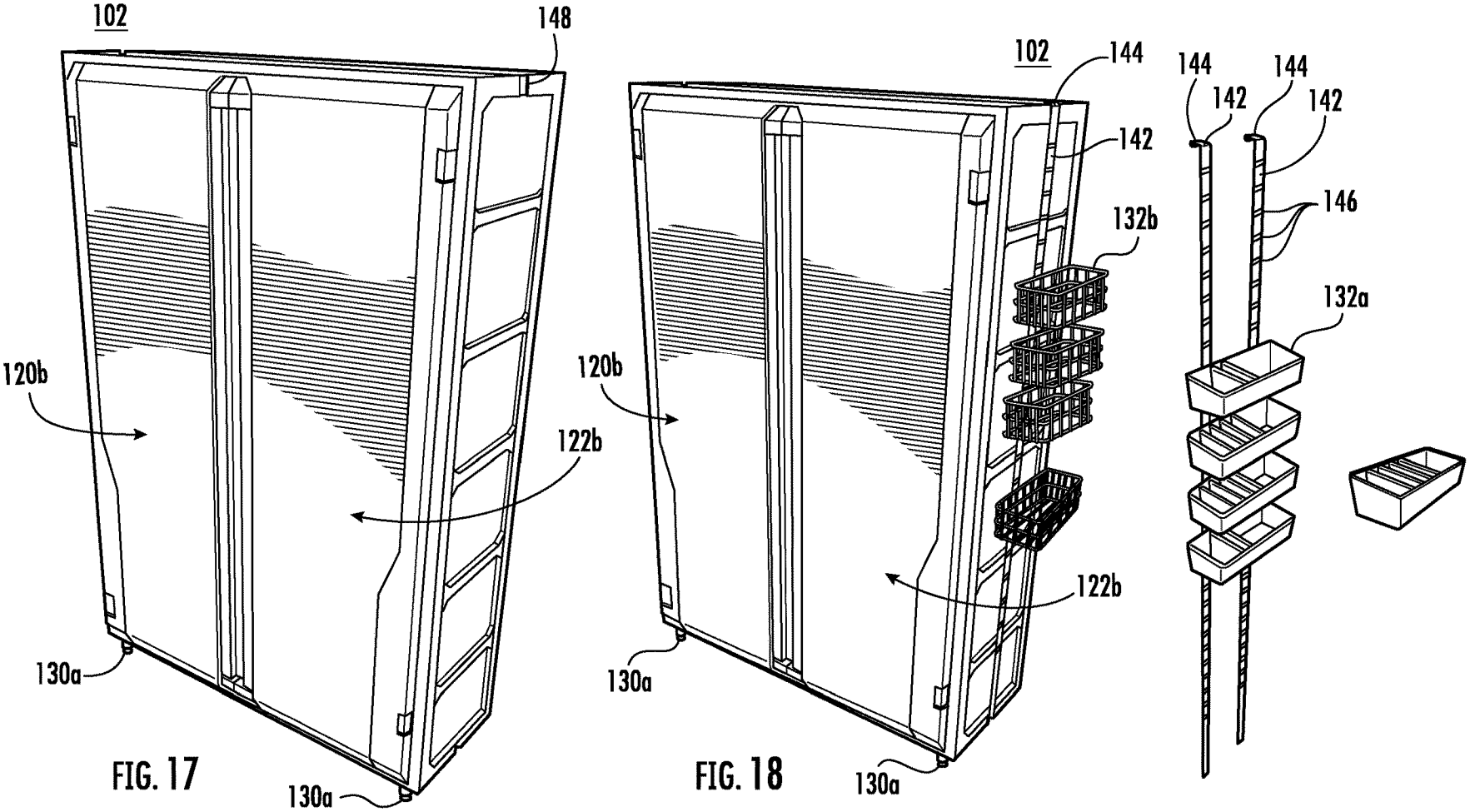
Figure 19:
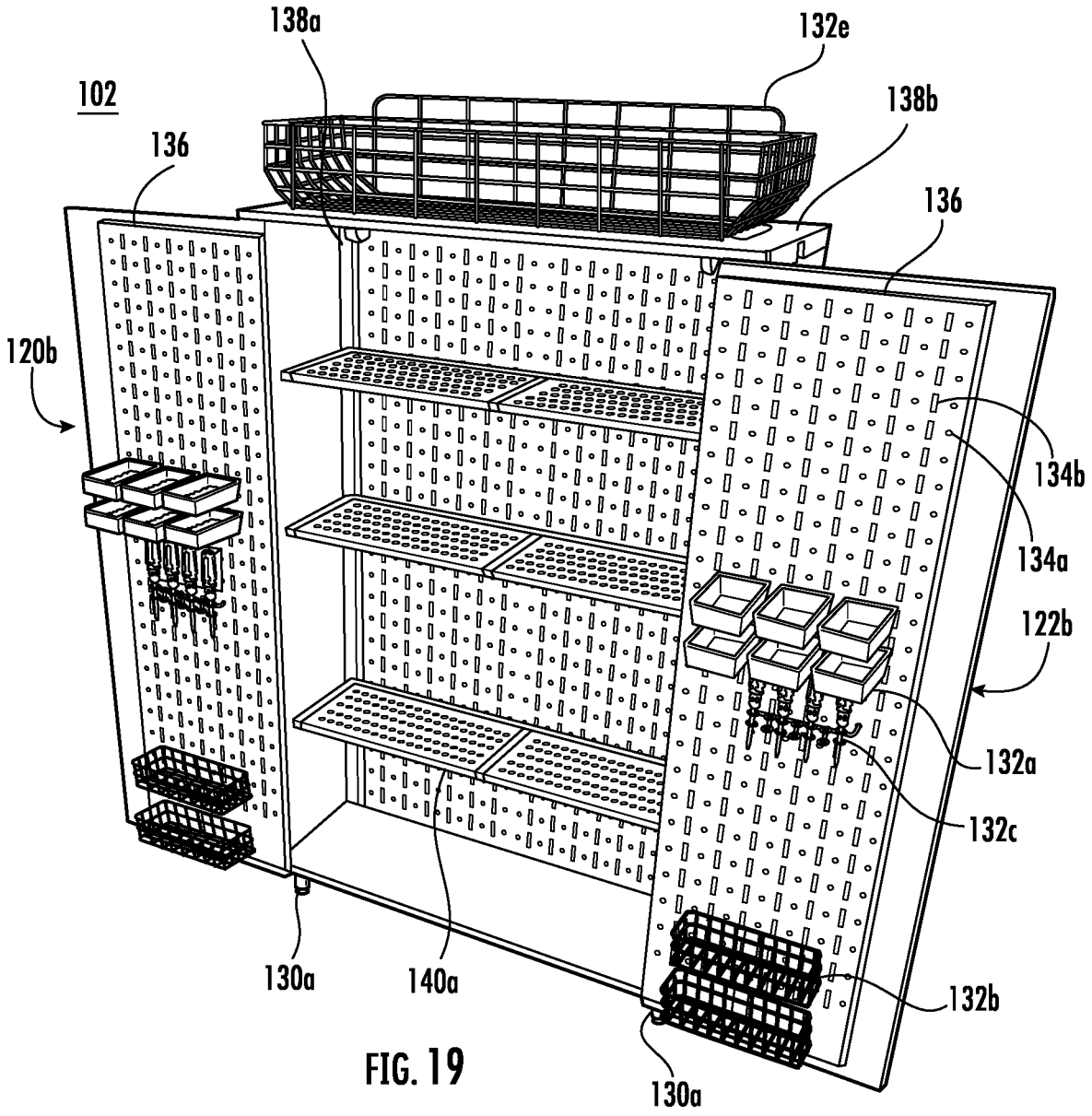
Figure 20:
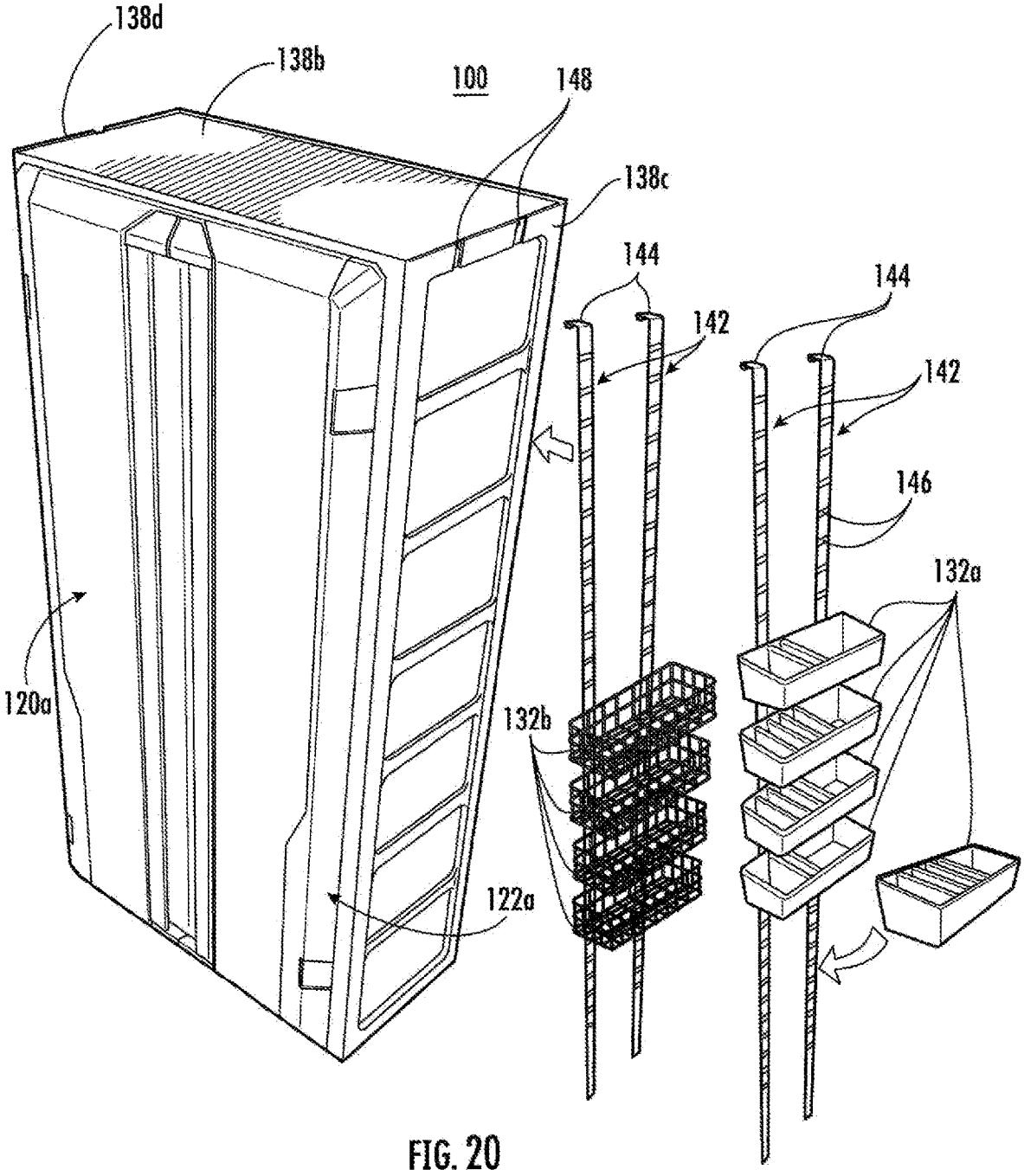
Figure 21:
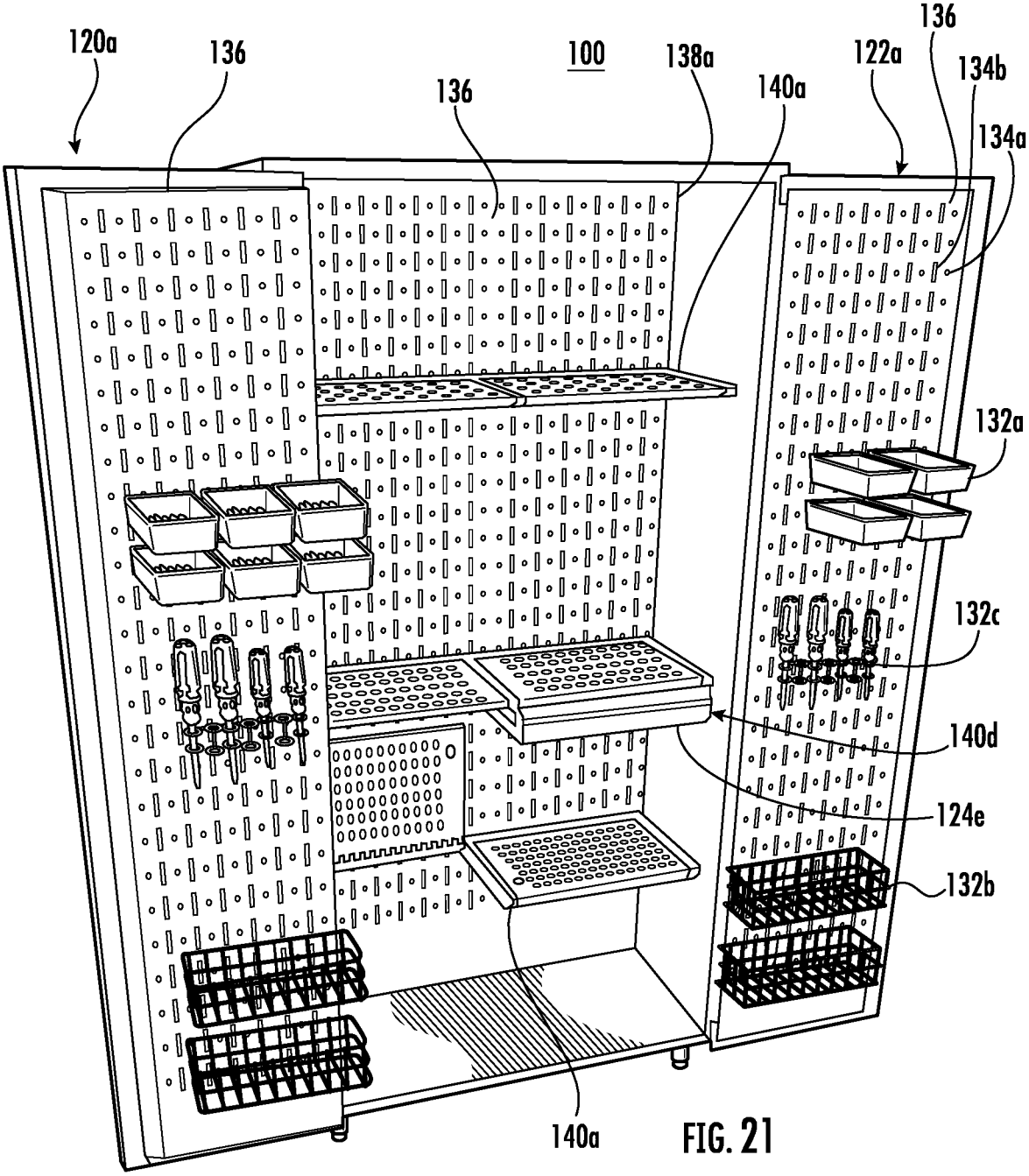
Figure 28:
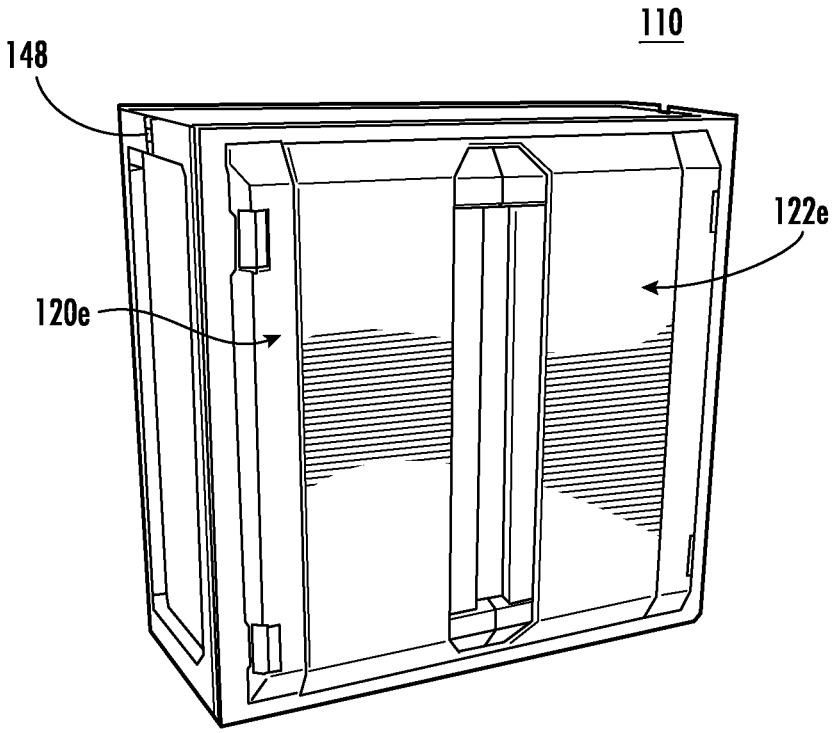
Figure 29:
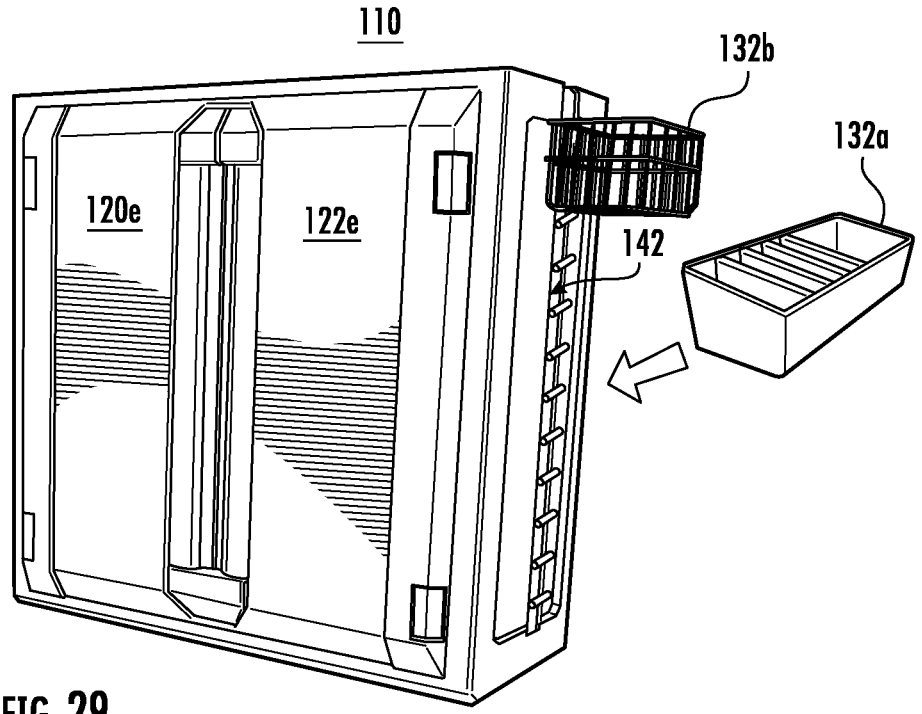
Figure 30:
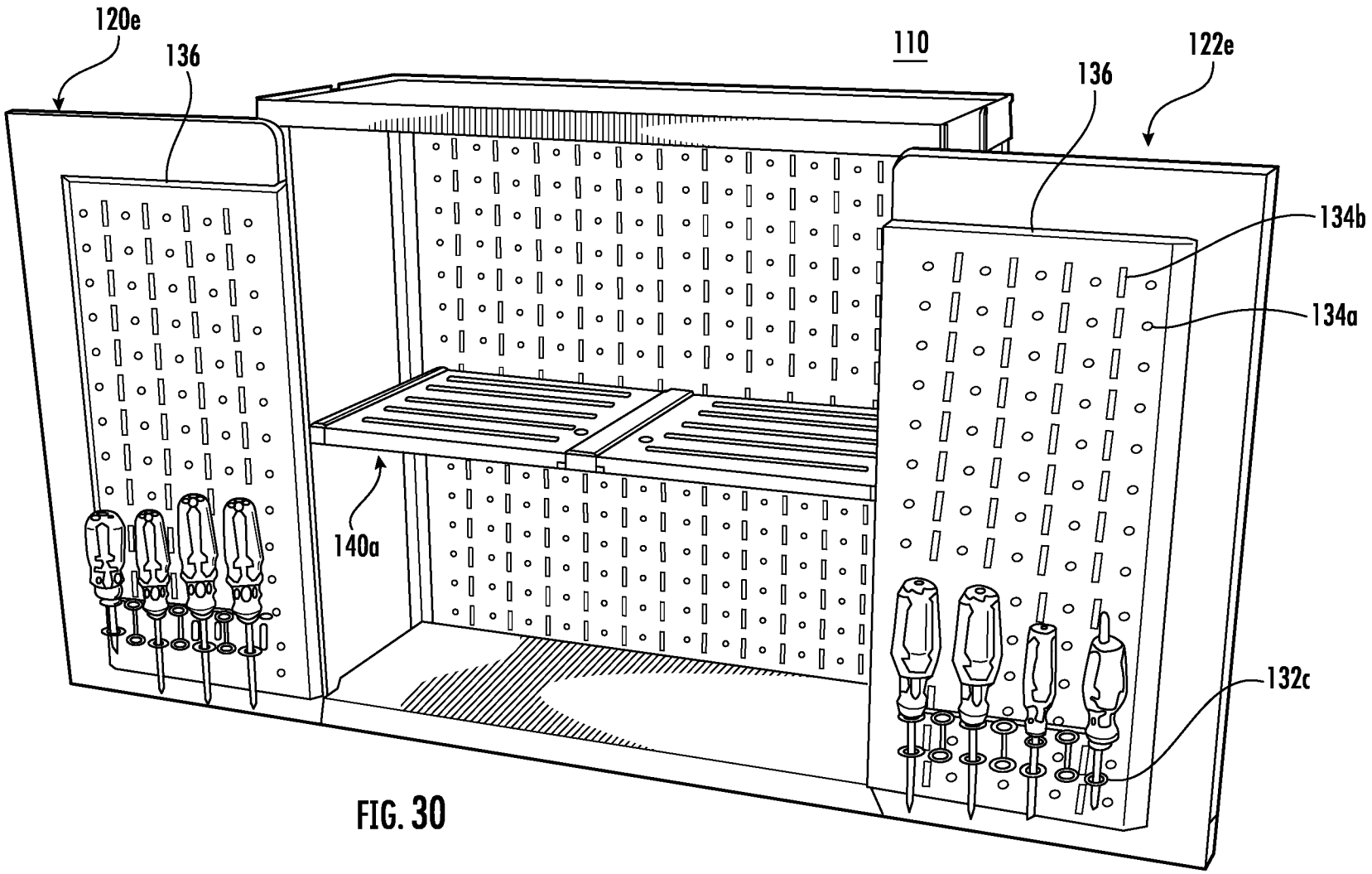
Figure 35:
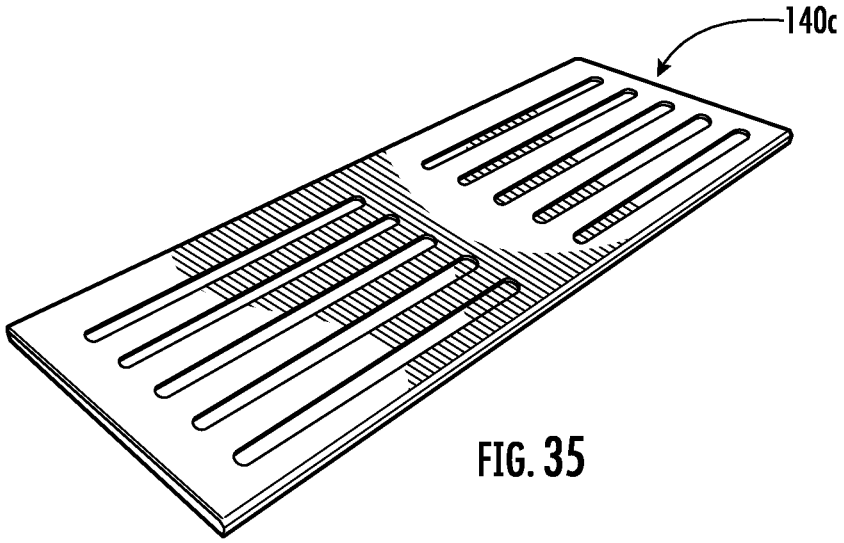
Figure 36:
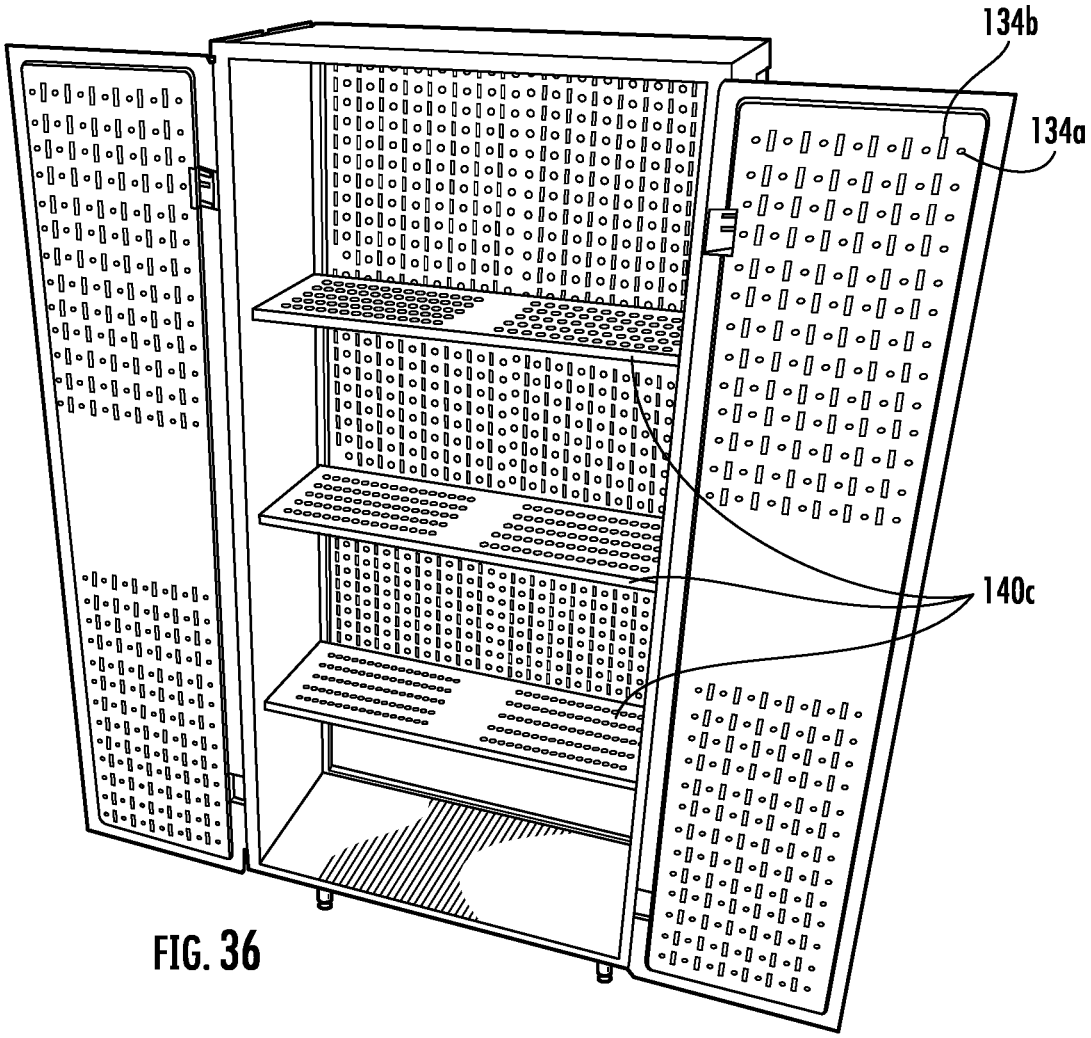
Figure 37:
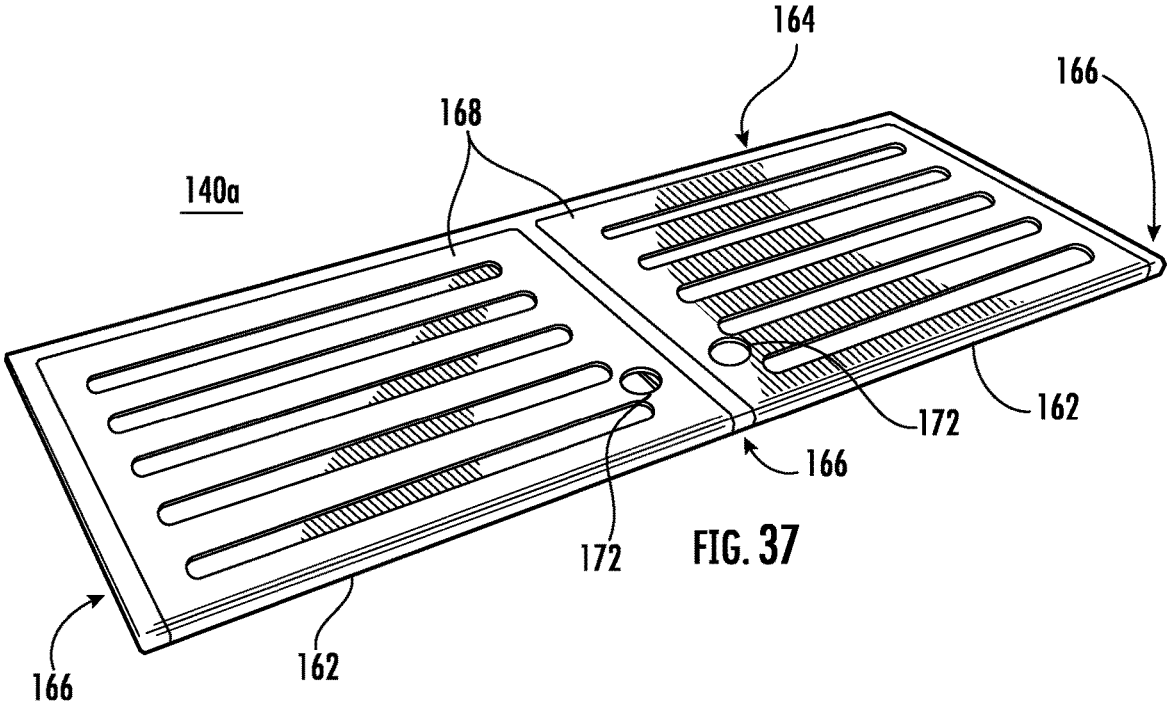
Figure 38:
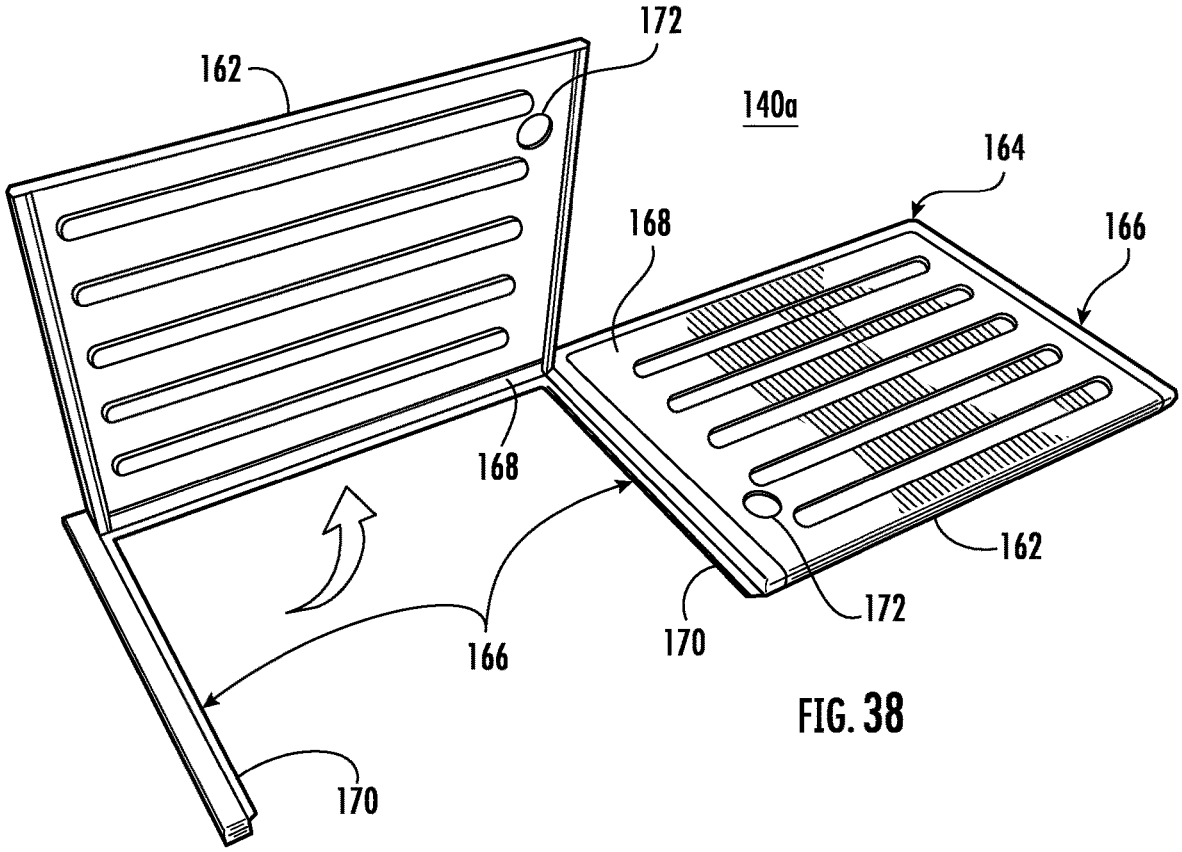
Figure 39:
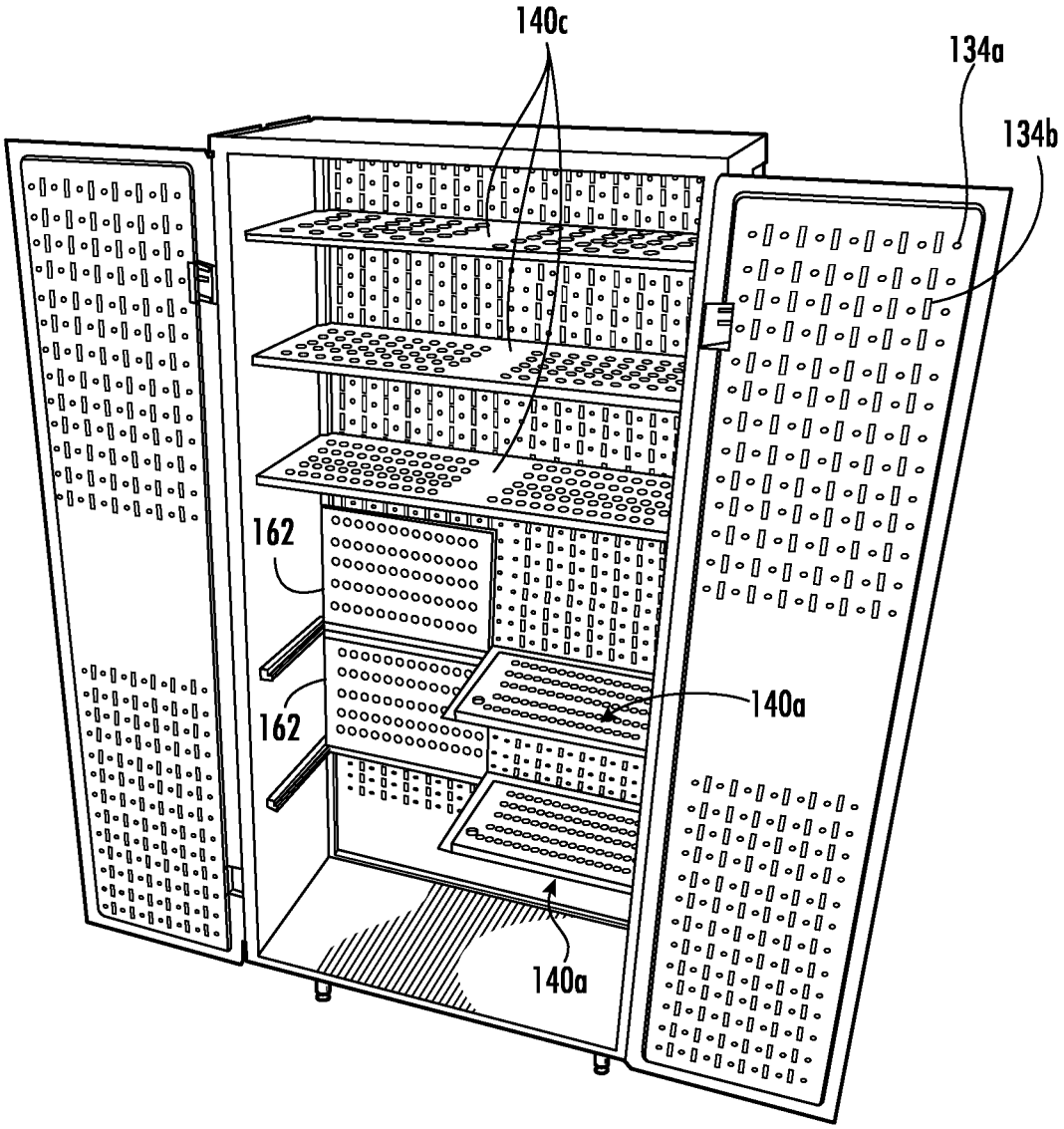
Figure 41:
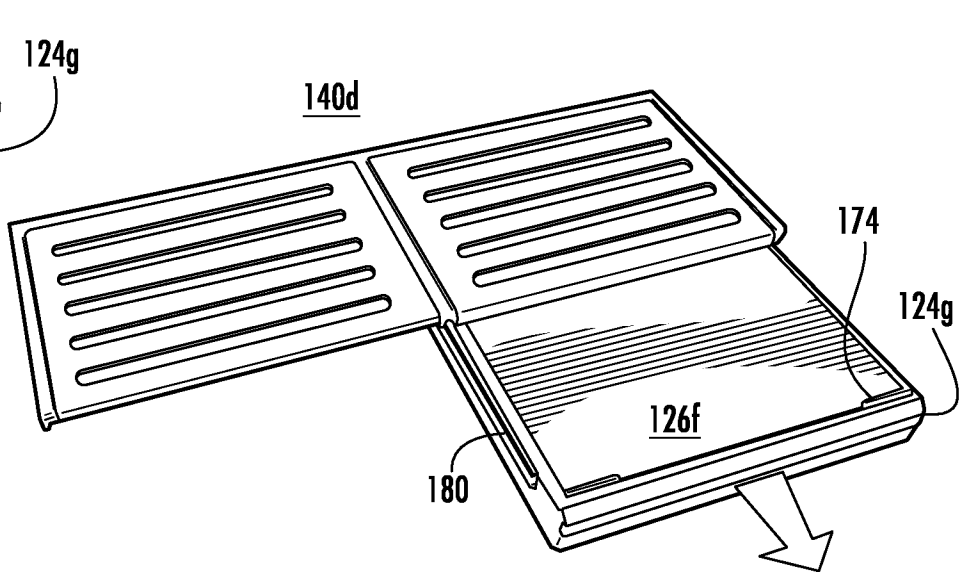
Figure 40:
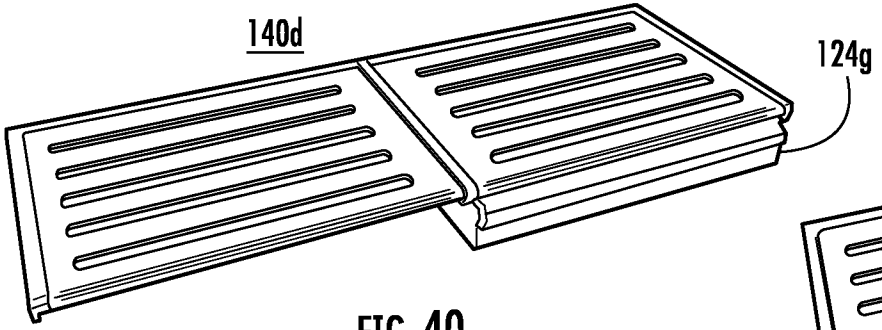
Figure 59:
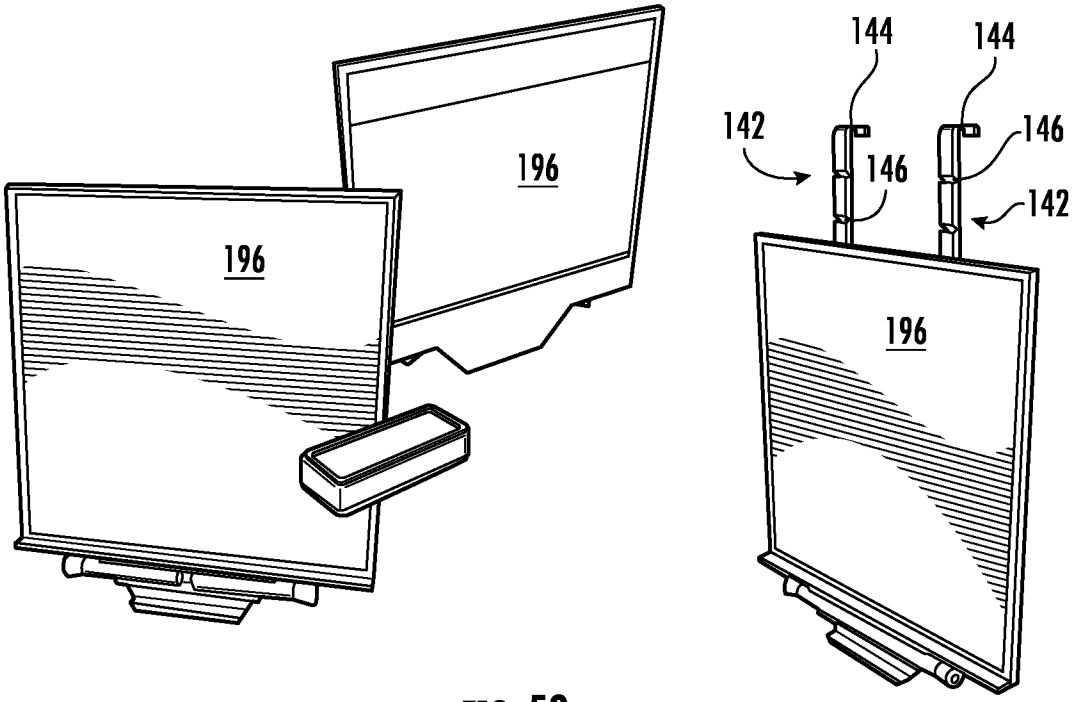
Figure 58:
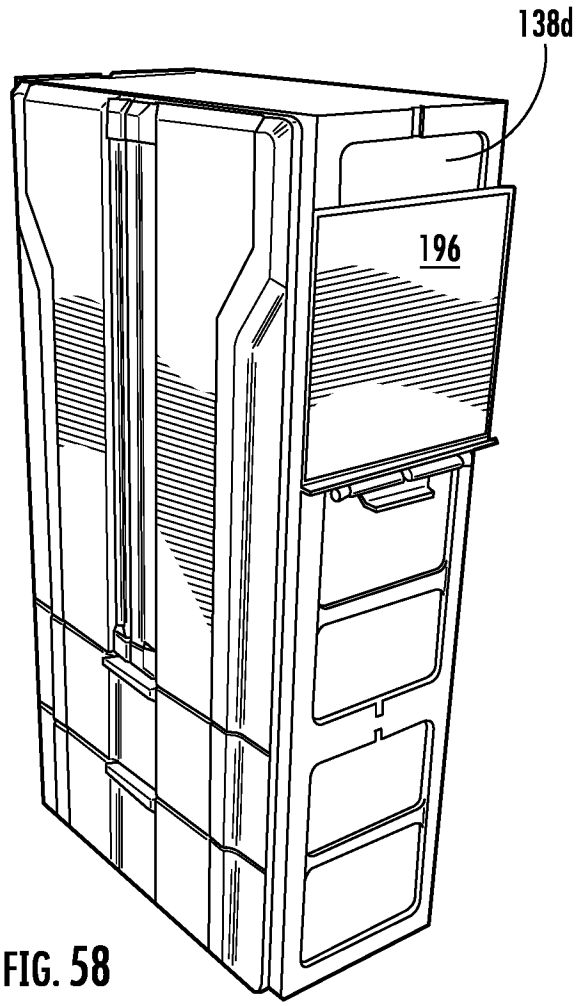
Figure 64A:
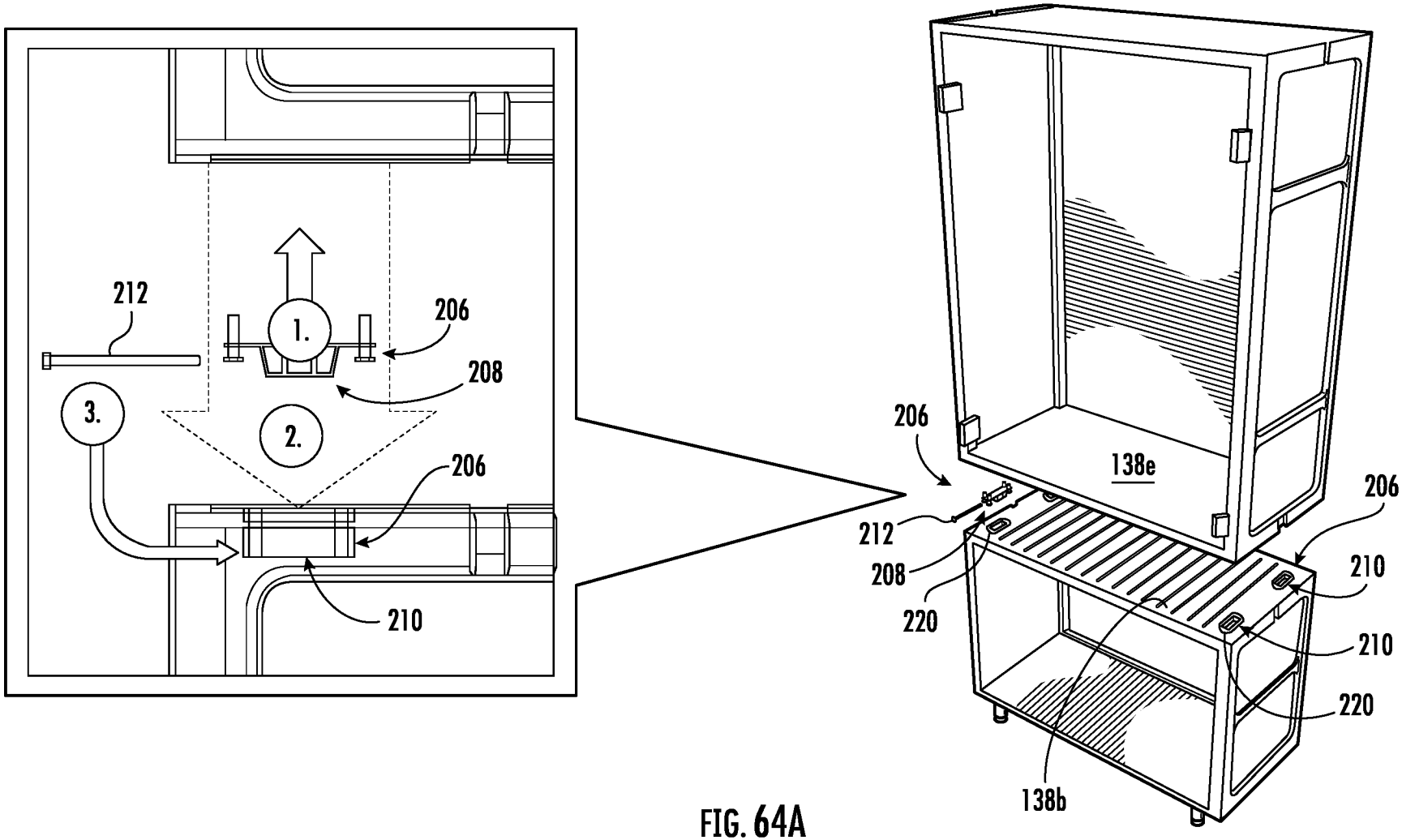
Figure 64B:
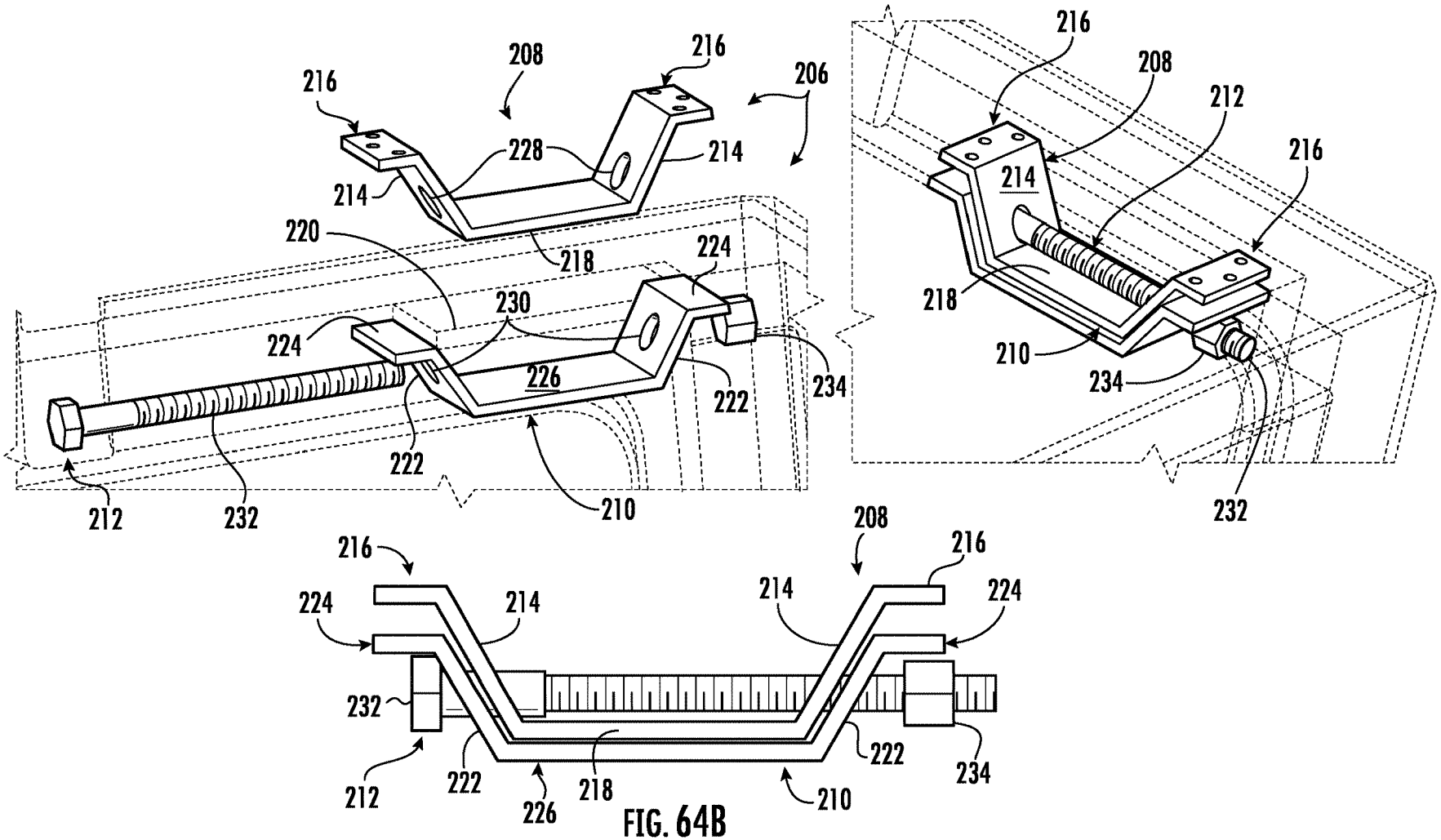
Figure 64C:
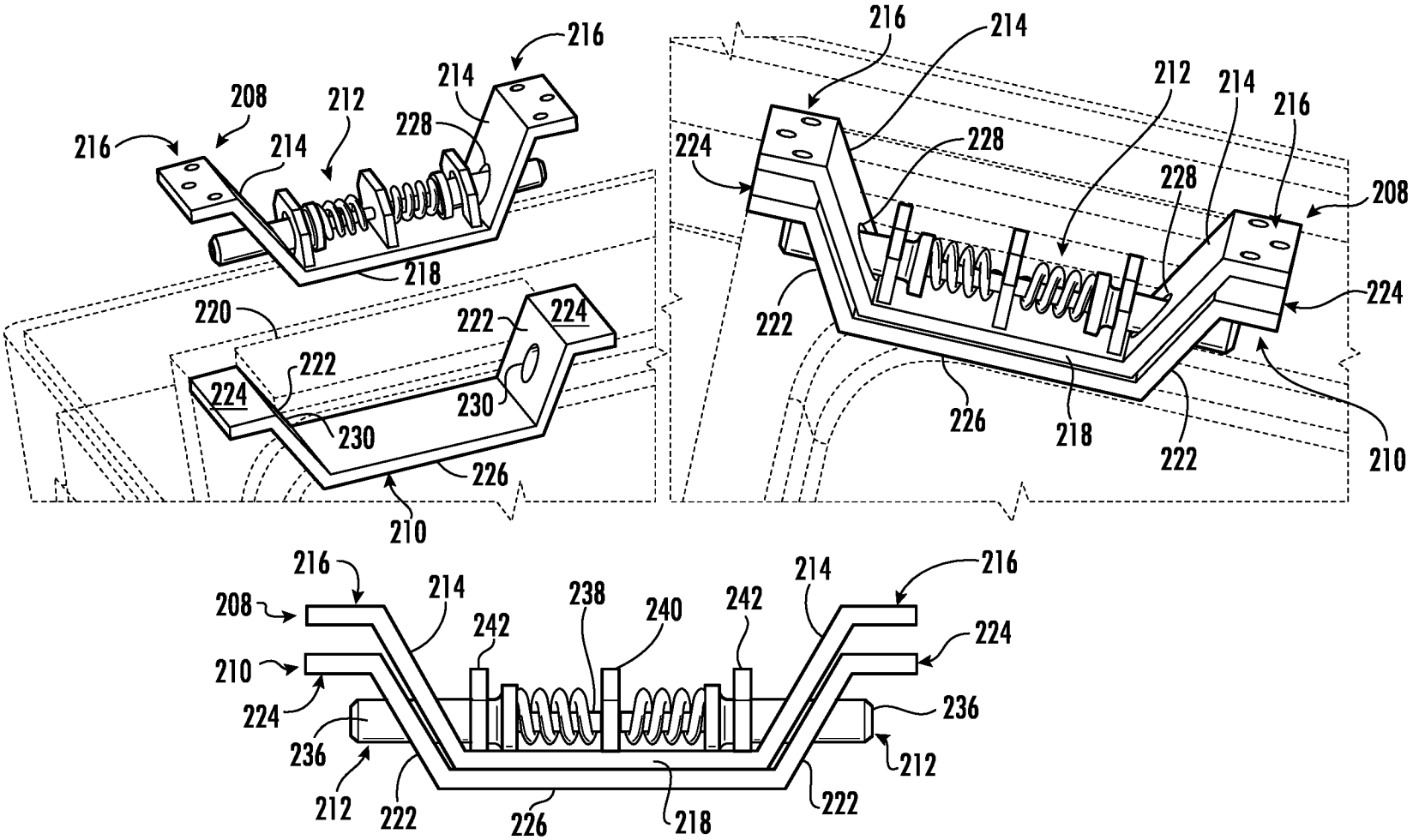
Figure 65:
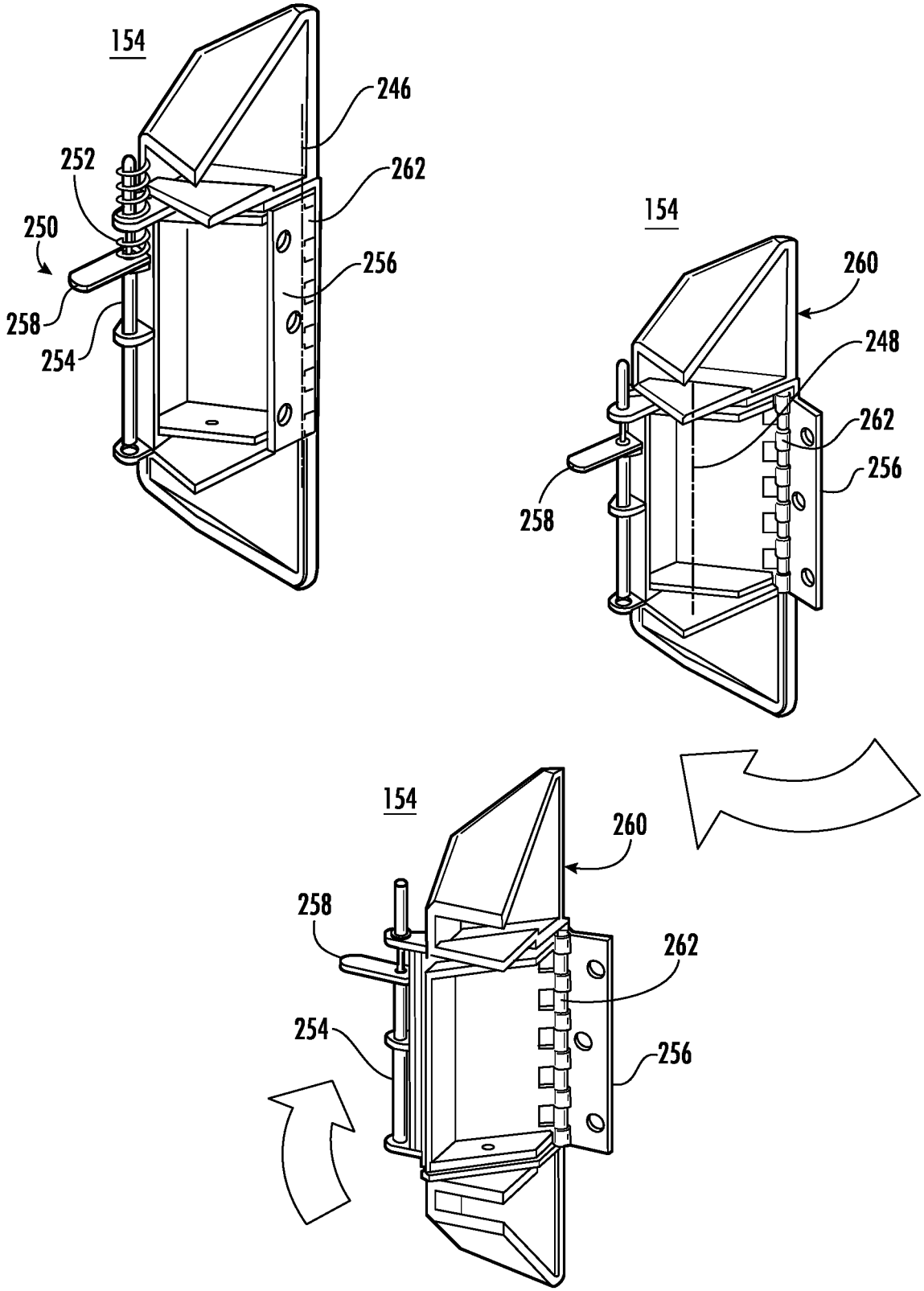
Figure 69:
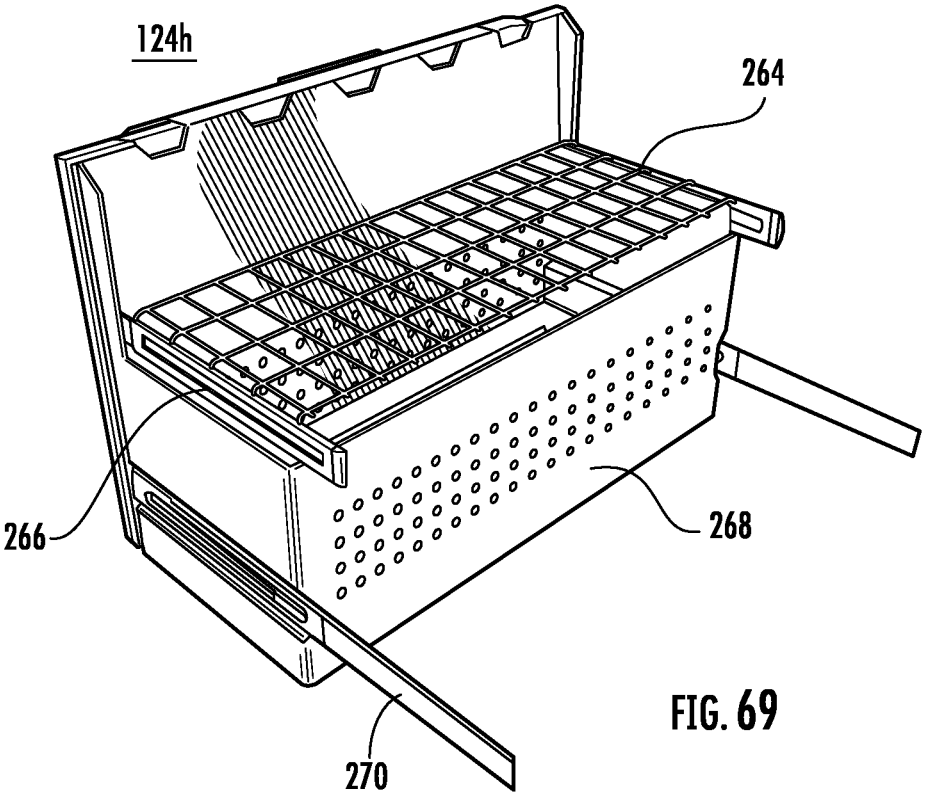
Figure 70:
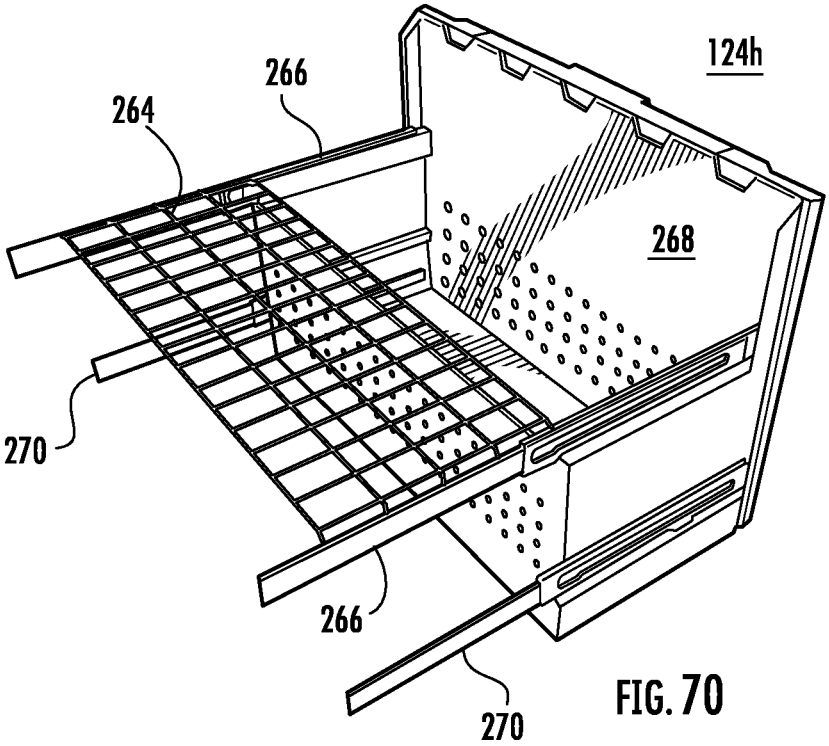
Figure 71:
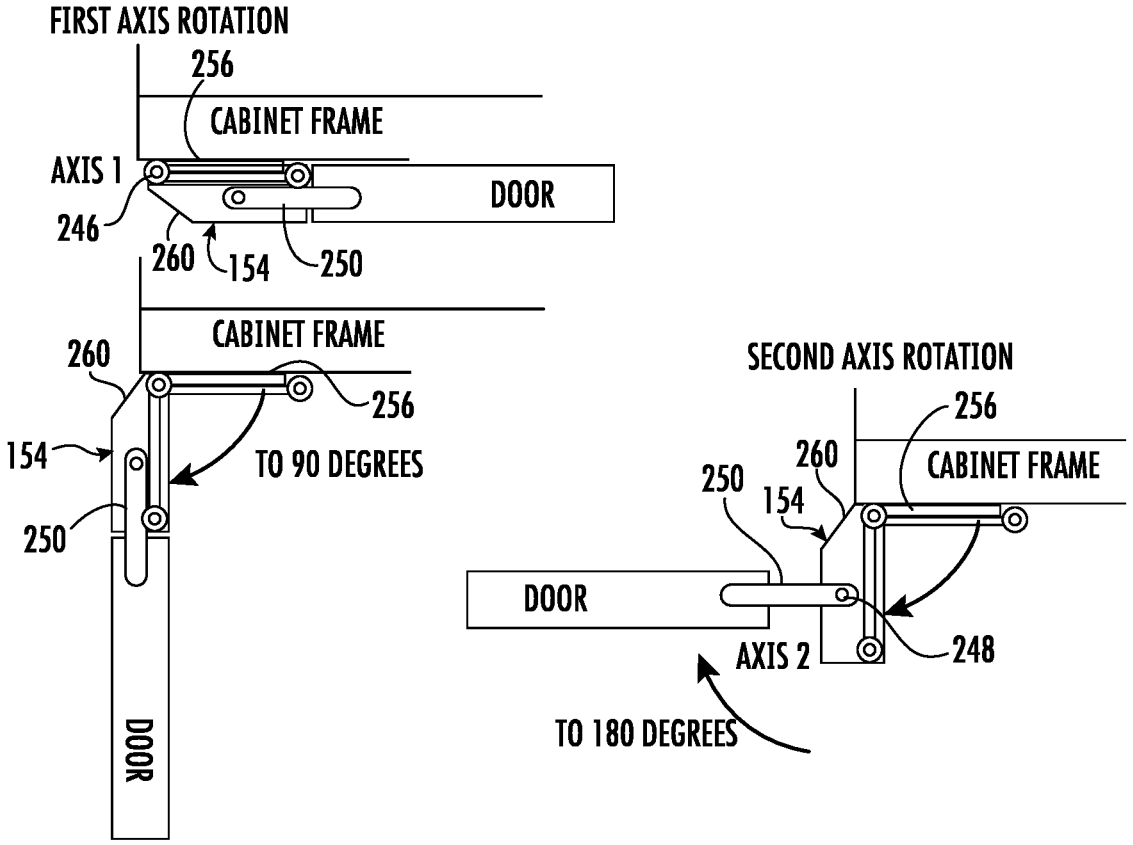

Having thus described embodiments of the invention in general terms, reference will now be made to the accompanying drawings, which are not necessarily drawn to scale, and wherein:

FIG. 1 shows an example tall cabinet in accordance with an embodiment of the disclosure;

FIG. 2 shows an example wide cabinet in accordance with an embodiment of the disclosure;

FIG. 3 shows an example modular cabinet in accordance with an embodiment of the disclosure;

FIG. 4 shows an example short two door cabinet in accordance with an embodiment of the disclosure;

FIG. 5 shows an example short five drawer cabinet in accordance with an embodiment of the disclosure;

FIG. 6 shows an example two door wall cabinet in accordance with an embodiment of the disclosure;

FIG. 7 shows an example work bench in accordance with an embodiment of the disclosure;

FIGS. 8-10 show additional views of short two door cabinets in accordance with embodiments of the disclosure;

FIGS. 11-16 show additional views of short five drawer cabinets in accordance with embodiments of the disclosure;

FIGS. 17-19 show additional views of wide cabinets in accordance with embodiments of the disclosure;

FIGS. 20-21 show additional views of tall cabinets in accordance with embodiments of the disclosure;

FIGS. 22-27 show additional views of modular cabinets and cabinet units associated therewith in accordance with embodiments of the disclosure;

FIGS. 28-30 show additional views of wall cabinets in accordance with embodiments of the disclosure;

FIGS. 31-34 show additional views of work benches in accordance with embodiments of the disclosure;

FIGS. 35-36 show an example shelf in accordance with an embodiment of the disclosure;

FIGS. 37-39 show an example foldable shelf in accordance with an embodiment of the disclosure;

FIGS. 40-44 show an example shelf with a secondary work surface in accordance with an embodiment of the disclosure;

FIGS. 45-48 show an example half shelf in accordance with an embodiment of the disclosure;

FIGS. 49-57 and 60-63 show example accessory storage bins and cabinets configured to engage therewith in accordance with embodiments of the disclosure;

FIGS. 58-59 show an example erasable board in accordance with an embodiment of the disclosure;

FIGS. 64A-64C show example embodiments of cabinet attachment mechanisms in accordance with embodiments of the disclosure;

FIG. 65 shows an example cabinet door hinge in accordance with an embodiment of the disclosure;

FIGS. 66-70 show example drawer configurations in accordance with embodiments of the disclosure; and FIG. 71 shows a top-down illustration of the hinge of FIG. 65.

DETAILED DESCRIPTION

Some embodiments of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Terms of direction such as "top," "bottom," "left," "right," "front," "rear," and the like may be used to describe the position of features relative to the normal operating position of the cabinets and components described herein, and reference to such directions should not be interpreted as forcing the cabinet to be held in a particular orientation at all times or under all circumstances.

Described herein are various storage systems and corresponding components, assemblies, combinations, and methods of use and manufacture of the same. The storage systems may include one or more cabinets and/or may include one or more work surfaces to meet the end user's needs. The storage systems may include any combination of components and features described herein, and the storage systems are modularly designed to enable a user to select the configuration of components best suited to the user's needs. In some embodiments, the flexible storage system described herein includes the ability of the user to manage large items in both the traditional method horizontally (placing items on a shelf) or vertically with the introduction of fold up or fold-in shelves that do not require removal. Flexibility and the ability to customize the storage space across the system enables more efficient and more versatile use of storage space. Each of the embodiments described herein have one or more features or components that are interchangeable within each embodiment (e.g., between various form factors and components within an embodiment) and are interchangeable between embodiments. For example, a drawer or basket used in one embodiment may be substituted into any other embodiment or form factor disclosed herein. Moreover, the components and features shown in FIGS. 35-70 may be used with any embodiment. Unless stated otherwise, each feature and each component described herein may be applied to and used with any of the systems and components described herein.

With reference to FIGS. 1-70, example storage systems are shown having various form factors and components depicted therein, each of which will be described in detail. FIGS. 1-7 show several example form factors for the system components, which components may be used in any number and combination or with any of the accessories and modifications described herein. Moreover, individual components and combinations of components may be claimed separately or in combination with a larger system. FIGS. 1-6 each show different example form factors of cabinets and FIG. 7 shows an example work bench form factor.

FIG. 1 shows a tall cabinet 100 having dimensions of about 72 inches in height by about 36 inches in width and about 18 inches in depth with an interior storage space enclosed by two doors 120*a*, 122*a*. FIG. 2 shows a wide cabinet 102 having dimensions of about 72 inches in height by about 48 inches in width and about 18 inches in depth with an interior storage space enclosed by two doors 120*b*, 122*b*. FIG. 3 shows a modular cabinet 104 having dimensions of about 72 inches in height by about 36 inches in width and about 18 inches in depth with an upper interior storage space separated by two doors 120*c*, 122*c* and two drawers 124*a* at a lower end of the modular cabinet. FIG. 4 shows a short two door cabinet 106 having dimensions of about 34.5 inches in height by about 28 inches in width and about 18 inches in depth with a wood worktop 126*a* and an interior storage space enclosed by two doors 120*d*, 122*d*. FIG. 5 shows a short five drawer cabinet 108 having dimensions of about 34.5 inches in height by about 28 inches in width and about 18 inches in depth with a wood worktop 126*b* and five drawers 124*b*, 124*c* vertically positioned along the height of the cabinet. FIG. 6 shows a two-door wall cabinet 110 having dimensions of about 28 inches in height by about 28 inches in width and about 12 inches in depth with an interior storage space enclosed by two doors 120*e*, 122*e*. FIG. 7 shows a wood work bench 112 having dimensions of about 43 inches in height by about 72 inches in width and about 18 inches in depth and including a wooden worktop 126*c*.

FIGS. 8-70 depict additional views, components, and features of the aforementioned form factors of FIGS. 1-7 and various embodiments thereof. FIGS. 8-10 depict additional views of embodiments of the short two door cabinet 106 of FIG. 4 and FIGS. 11-16 depict additional views of embodiments of the short five drawer cabinet 108 of FIG. 5, which cabinet may be free standing (e.g., with legs 130*a*, 130*b*, wheels 128, or other base supports), mounted atop other cabinets or work surfaces, and/or wall mounted. For example, FIGS. 9, 10, 12, 13, 15 depict accessory storage bins 132*a*-132*d* (also referred to as baskets, tool organizers, and the like) which may attach to and/or be disposed on the cabinet on the interior or exterior. In some embodiments, the depicted accessory storage bins 132*a*-132*d* may be placed on top of or on a hard surface within the cabinet. In some embodiments, the cabinet may include one or more openings 134*a*, 134*b* in a wall or door panel thereof, which openings may receive corresponding engagement projections from the storage bins 132*a*-132*d* for hanging the bins therefrom, or vice versa.

FIG. 10 depicts an example interior view having four storage bins 132*b*, 132*c* attached to the interior of the doors via one or more perforated openings 134*a*, 134*b* and corresponding engagement projections (i.e., hooks or tabs configured to insert into the corresponding openings as would be appreciated by a person of ordinary skill in the art in light of the present disclosure) on the storage bins. As depicted in FIGS. 8-10, the perforated openings 134*a*, 134*b* may not extend entirely through the cabinet doors or walls in some instances, and in some embodiments, a perforated panel 136 may be mounted to or formed as part of a door 120*d*, 122*d* or wall (e.g., a rear wall 138*a* as shown in FIG. 10) to prevent perforations from being visible to the exterior of the cabinet. In some embodiments, the perforated panel may be the exterior door or wall panel such that the perforations are visible and engageable on both sides of the door or wall. In some embodiments, the doors and/or rear wall may include perforations. In some embodiments, as shown in FIG. 10, other accessory storage bins, such as screwdriver holders 132*c*, may be engaged with the perforated panel 136, and one or more shelves (e.g., foldable shelves 140*a* as shown in FIG. 10) according to any of the embodiments described herein may be engaged with one or more of the perforated panels.

Figure 12:
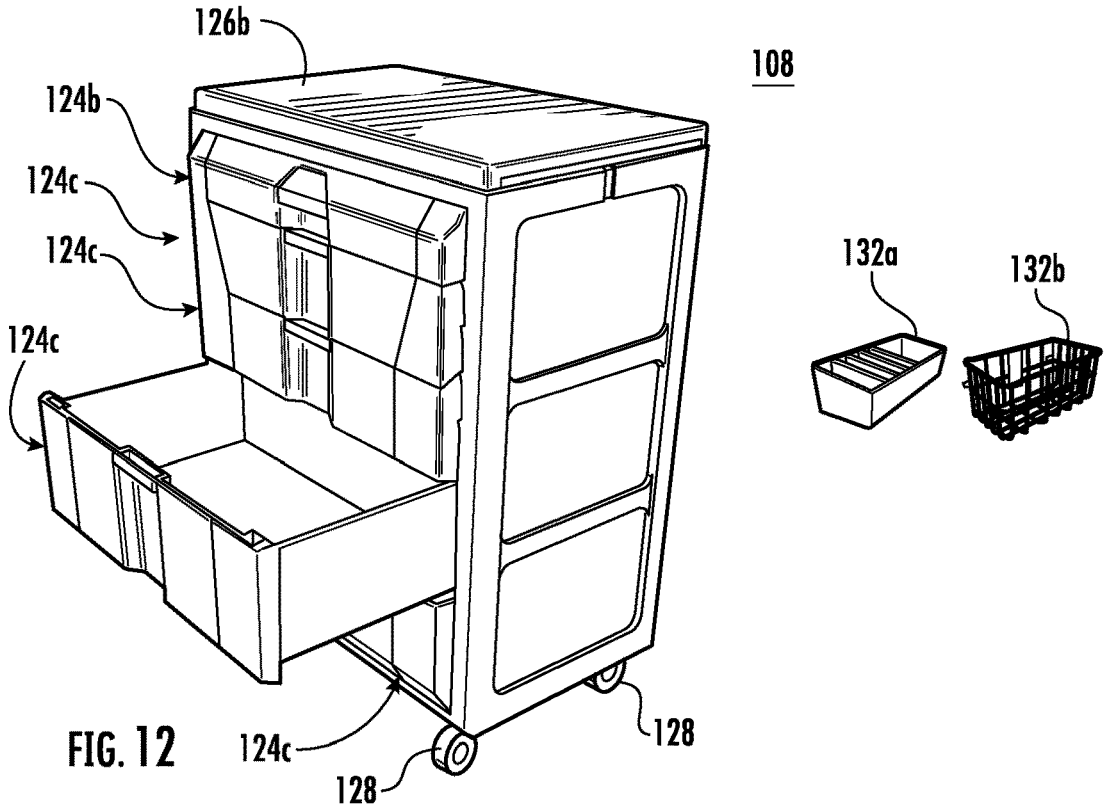
Figure 13:
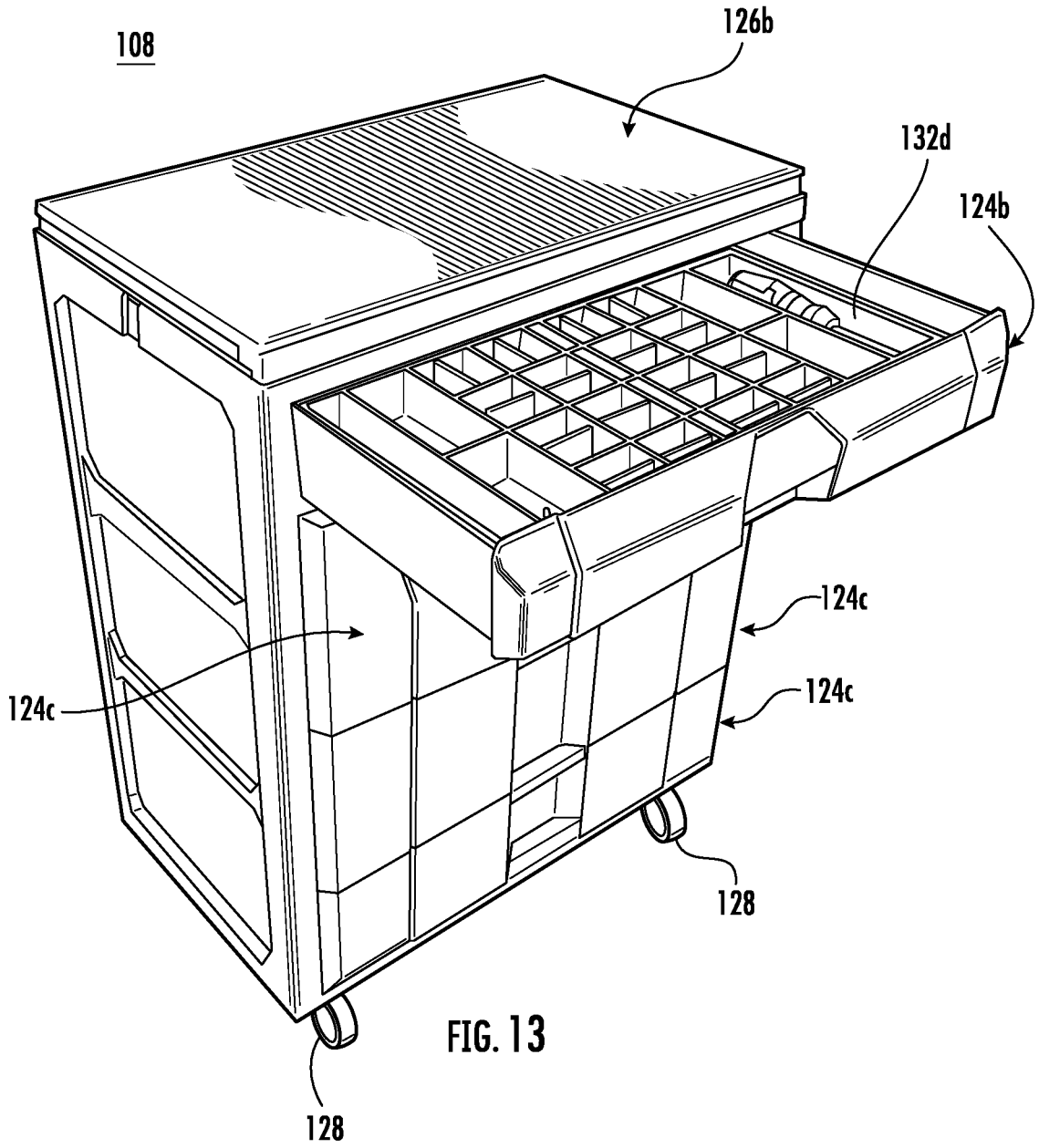
Figure 14:
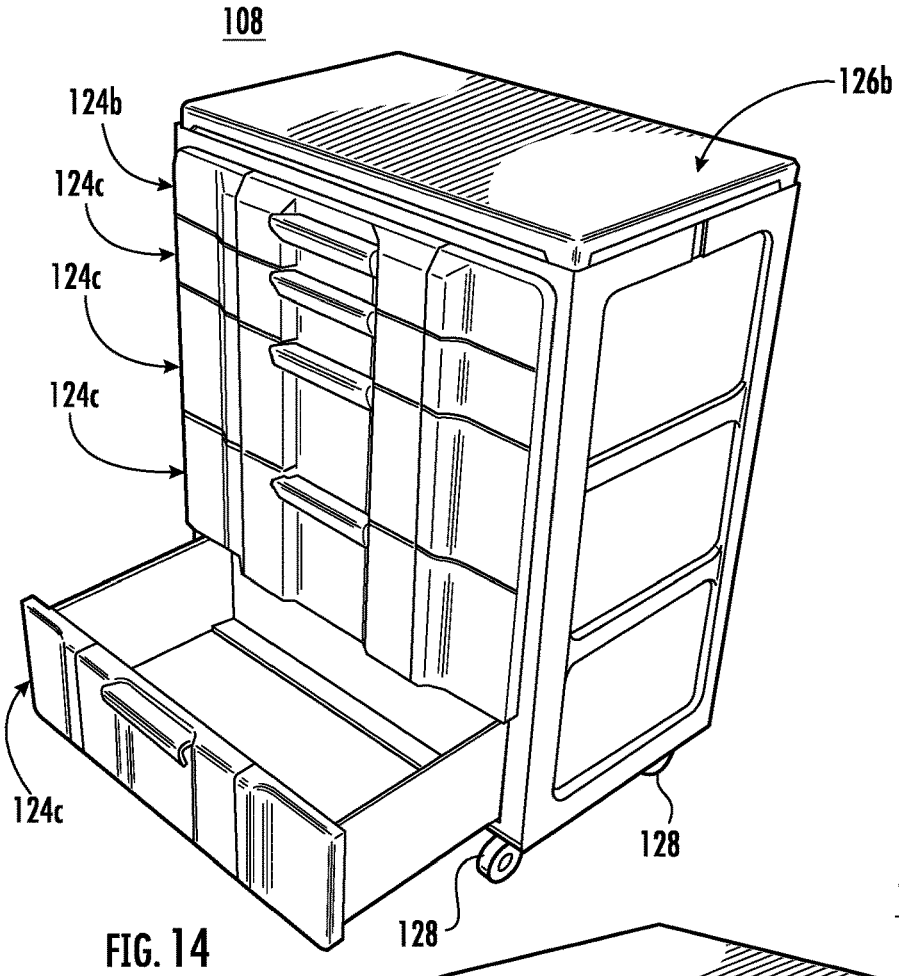
Figure 15:
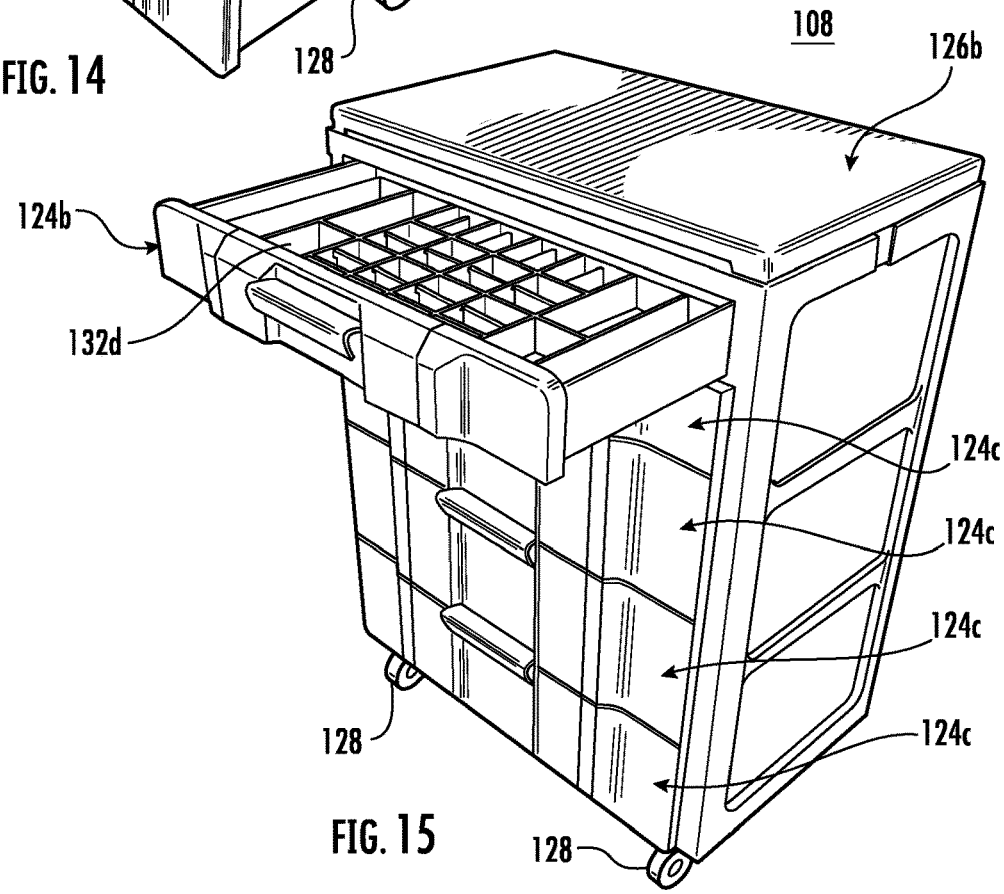
Figure 16:
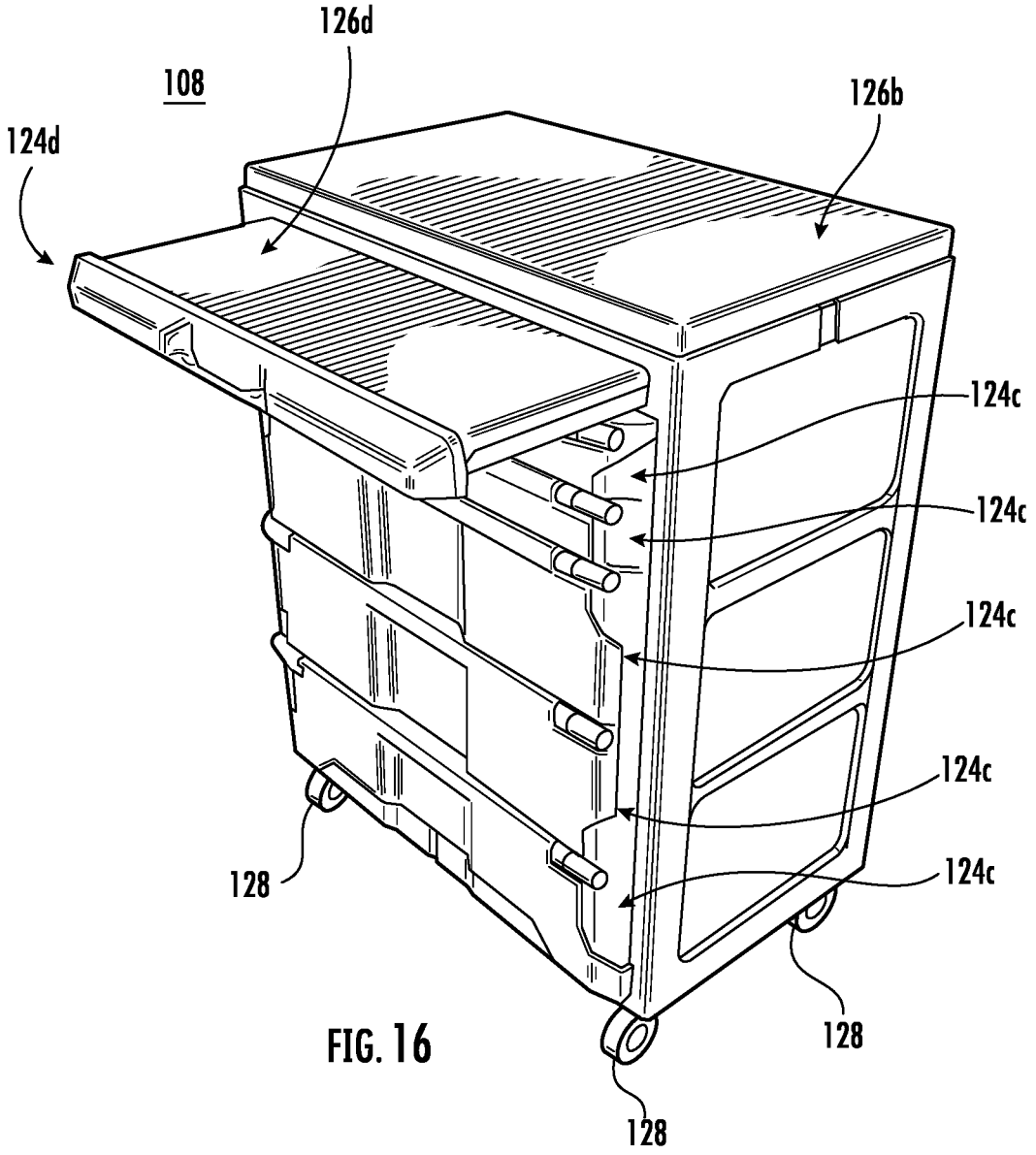

FIGS. 11-16 depict additional views of the short five drawer cabinet 108 of FIG. 5 and FIGS. 11-13 and 14-16 include example variations on the drawer and handle configurations. For example, FIGS. 12, 13, and 15 depict accessory storage bins 132*a*, 132*b*, 132*d* (also referred to as baskets, tool organizers, and the like) which may attach to the cabinet on the interior or exterior. In some embodiments, the depicted accessory storage bins 132*a*, 132*b*, 132*d* may be placed on top of or on a hard surface within the cabinet (e.g., resting within the drawer). In some embodiments, the cabinet may include one or more openings in a wall or door panel thereof, which openings may receive corresponding engagement projections from the storage bins for hanging the bins therefrom, or vice versa. With reference to FIGS. 12-13, example drawers 124*b*, 124*c* are shown with and without accessory storage bins 132*d*. With reference to FIG. 16, an extendable work surface 126*d* is shown as a separate extendable portion 124*d* that enables the total work surface of the cabinet to increase without increasing the stored footprint of the cabinet 108. In some embodiments, the extendable work surface 126*d* may be disposed above the upper-most drawer 126*c*. In some embodiments, the extendable work surface may rest on top of an outer perimeter of a drawer such that the drawer may be opened, and the extendable work surface may be moved between an operational position and a stored position along the top of the drawer. In some embodiments, the extendable work surface 126*d* may be separately attached (e.g., via separate rails) to the cabinet as an extendable portion 124*d* and may be moved to the operational position independent of the drawers 124*c*. Many various drawer configurations are available including drawers with internal organization features, such as trays, dividers, and the like.

FIGS. 17-19 depict additional views of the wide cabinet 102 of FIG. 2. For example, FIGS. 18-19 depict accessory storage bins 132*a-c*, 132*e* (also referred to as baskets, tool organizers, and the like) which may attach to the cabinet 102 on the interior or exterior. In some embodiments, the depicted accessory storage bins 132*a-c*, 132*e* may be placed on top of or on a hard surface within the cabinet. In some embodiments, the cabinet 102 may include one or more openings 134*a*, 134*b* in a wall or door panel thereof, which openings may receive corresponding engagement projections from the storage bins for hanging the bins therefrom, or vice versa. For example, FIG. 19 depicts an example interior view having a plurality of storage bins 132*a-c* attached to the interior of the doors via one or more perforated openings 134*a*, 134*b* and corresponding engagement projections on the storage bins. As depicted in FIGS. 17-19, the perforated openings 134*a*, 134*b* may not extend entirely through the cabinet doors 120*b*, 122*b* or walls in some instances, and in some embodiments, a perforated panel 136 may be mounted to or formed as part of a door 120*b*, 122*b* or wall panel (e.g., rear wall 138*a* shown in FIG. 19) to prevent perforations from being visible to the exterior of the cabinet. In some embodiments, the perforated panel may be the exterior door or wall panel such that the perforations are visible and engageable on both sides of the door or wall. In some embodiments, the doors and rear wall may include perforations.

With continued reference to FIG. 18, in some embodiments one or more brackets 142 (also referred to as stems) may be attached to the cabinet to support one or more accessory storage bins. As shown in FIG. 18, the brackets 142 may include one or more hooked ends 144 configured to engage a portion of the cabinet 102 (e.g., a top wall 138*b*). In some embodiments, the stems 142 may include slots or perforations 146 (also referred to as an opening) at predetermined spacings to allow the user to select the height at which the accessory storage bins (e.g., bins 132*a*, 132*b* shown in FIG. 18) are placed. The slots 146 may be horizontal and/or angled upwardly at least partially to afford engagement and quick removal of items attached to the stems 144. These "slots" are designed for quick removal of a smaller storage device that may need to be move to a work area from the cabinet. In some embodiments, one or multiple stems 142 may be used to support the accessory storage bins (e.g., bins 132*a*, 132*b* shown in FIG. 18), and stems 142 may be used in addition to or instead of perforated panels 136. Also, with reference to FIG. 19, an accessory storage bin 132*e* may be disposed on and/or attached to a top wall 138*b* of the cabinet according to any of the embodiments described herein. In some embodiments, as shown in FIG. 19, other accessory storage bins 132*c* (e.g., tool holders), such as screwdriver holders, may be engaged with the perforated panel 136, and one or more shelves (e.g., foldable shelves 140*a* as shown in FIG. 19) according to any of the embodiments described herein may be engaged with one or more of the perforated panels.

With continued reference to FIG. 19, in some embodiments, the cabinet 102 may have one or more shelves (e.g., foldable shelves 140*a* as shown in FIG. 19) according to any of the embodiments disclosed herein. For example, as shown in FIG. 19, one or more foldable shelves 140*a*, half shelves, flat shelves, or pull out work surfaces and drawer systems may be used. Any of the shelves and accessory storage bins described herein may be movable and/or removable.

FIGS. 20-21 depict additional views of the tall cabinet 100 of FIG. 1. For example, FIGS. 20-21 depict accessory storage bins 132*a-c* (also referred to as baskets, tool organizers, and the like) which may attach to the cabinet 100 on the interior or exterior. In some embodiments, the depicted accessory storage bins 132*a-c* may be placed on top of or on a hard surface within the cabinet 100. In some embodiments, the cabinet 100 may include one or more openings 134*a*, 134*b* in a wall or door panel thereof, which openings may receive corresponding engagement projections from the storage bins 132*a-c* for hanging the bins therefrom, or vice versa. For example, FIG. 21 depicts an example interior view having a plurality of storage bins 132*a-c* attached to the interior of the doors 120*a*, 122*a* via one or more perforated openings 134*a*, 134*b* and corresponding engagement projections on the storage bins. As depicted in FIGS. 20-21, the perforated openings 134*a*, 134*b* may not extend entirely through the cabinet doors or walls in some instances, and in some embodiments, a perforated panel 136 may be mounted to or formed as part of a door 120*a*, 122*a* or wall (e.g., wall 138*a*) to prevent perforations from being visible to the exterior of the cabinet. In some embodiments, the perforated panel may be the exterior door or wall panel such that the perforations are visible and engageable on both sides of the door or wall. In some embodiments, the doors and rear wall may include perforations. With continued reference to FIG. 20, in some embodiments one or more brackets 142 (also referred to as stems) may be attached to the cabinet 100 to support one or more accessory storage bins (e.g., accessory storage bins 132*a*, 132*b* shown in FIG. 20) as described herein with respect to the embodiment of FIG. 18. In some embodiments, as shown in FIG. 21, other accessory storage bins 132*c* (e.g., tool holders), such as screwdriver holders, may be engaged with the perforated panel 136, and one or more shelves according to any of the embodiments described herein may be engaged with one or more of the perforated panels.

In any of the embodiments herein, the left side wall 138*d* and/or right side wall 138*c* of a cabinet may define one or more channels 148 configured to receive the brackets 142. In the depicted embodiment, the side walls 138*c*, 138*d* extend past the surface of the top wall 138*b* such that the channels 148 allow the hooked ends 144 of the brackets 142 to rest within the channel and atop the cabinet.

With continued reference to FIG. 21, in some embodiments, the cabinet 100 may have one or more shelves (e.g., foldable shelves 140*a* and/or drawer shelves 140*d* with drawers 124*e* and optional secondary work surfaces) according to any of the embodiments disclosed herein. For example, as shown in FIG. 21, one or more foldable shelves 140*a*, half shelves, or pull out work surfaces and drawer shelves 140*d* may be used. Any of the shelves and accessory storage bins described herein may be movable and/or removable.

Figure 23:
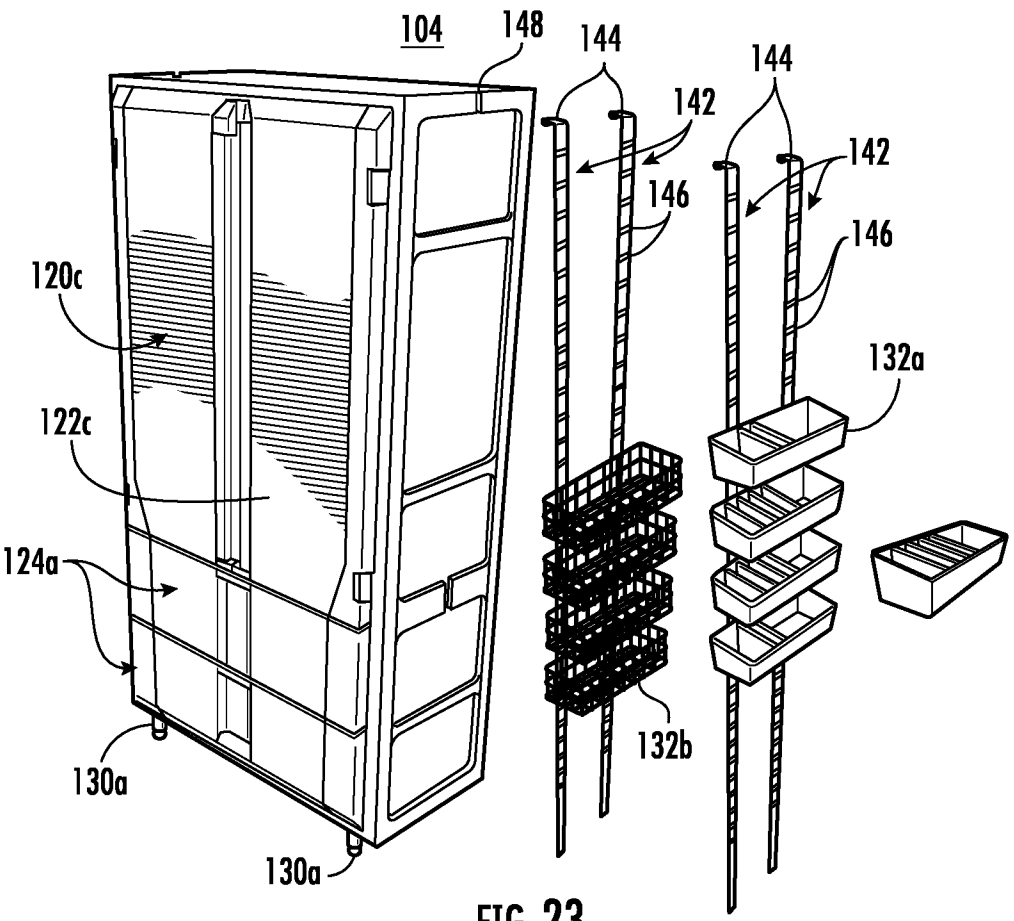
Figure 22:
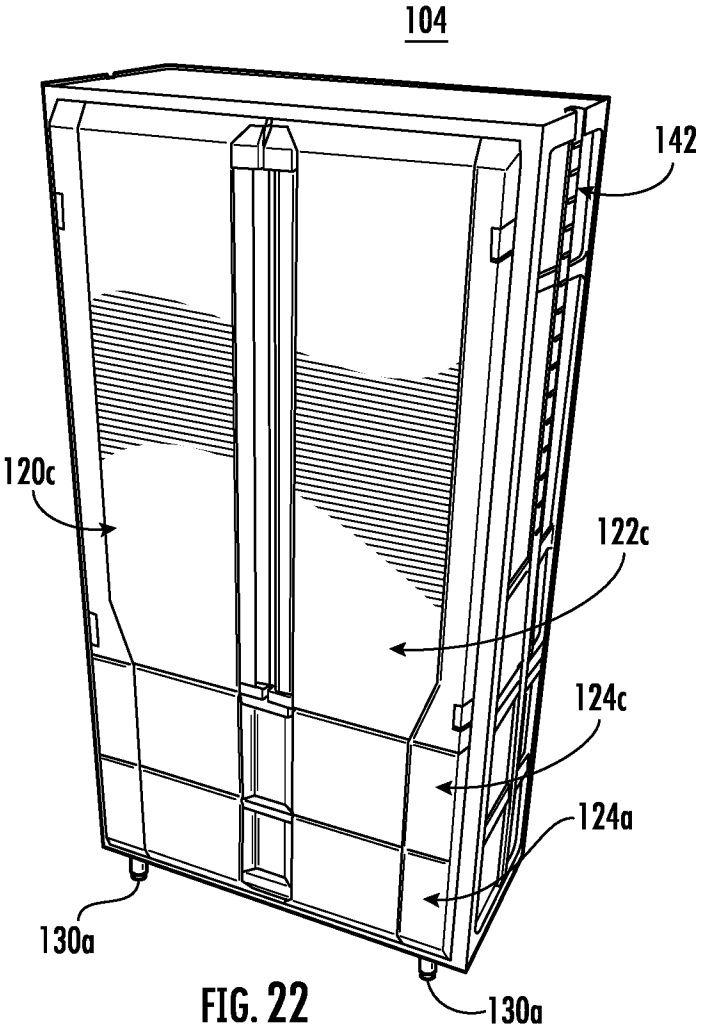
Figure 24:
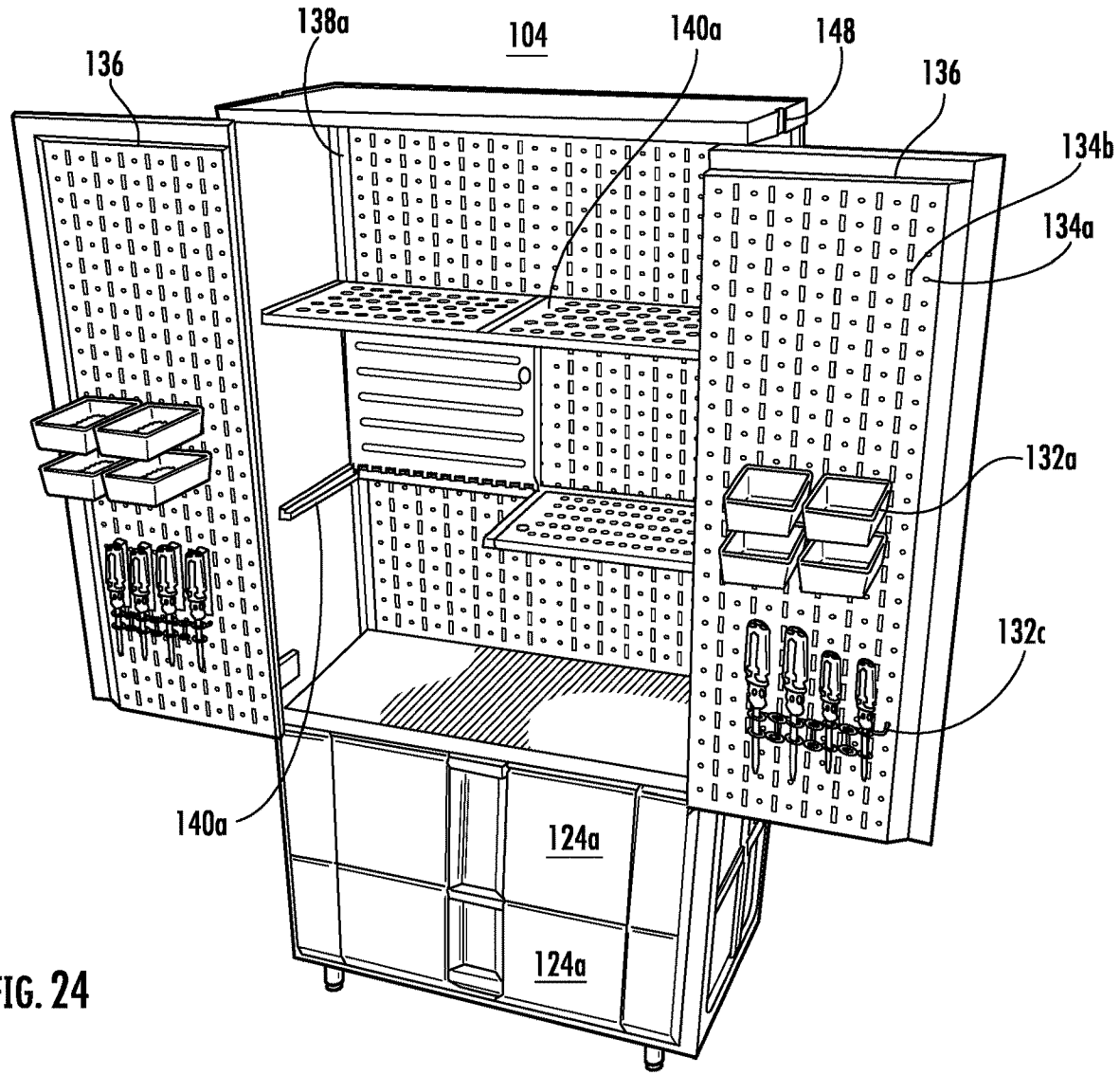
Figure 24:
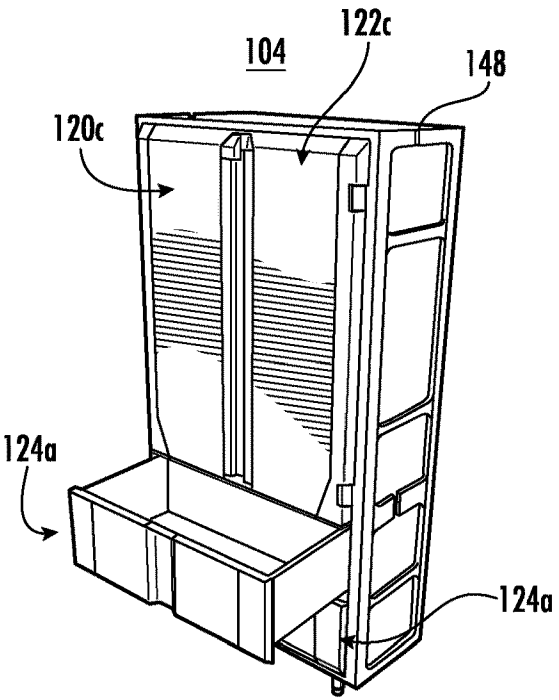
Figure 25:
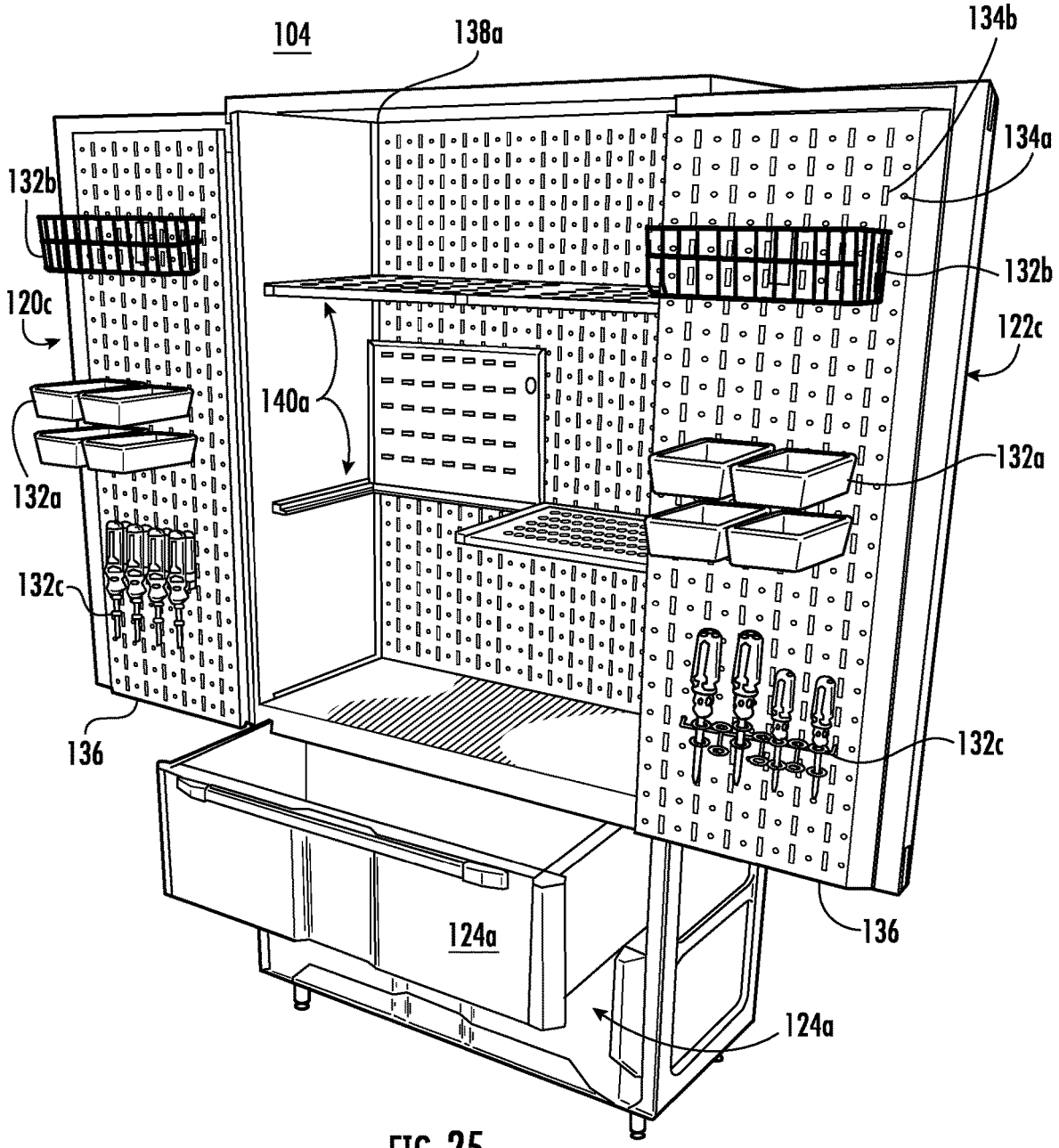

FIGS. 22-27 depict additional views of the modular cabinet 104 of FIG. 3. For example, FIGS. 23, 24, and 25 depict accessory storage bins 132*a*-132*c* (also referred to as baskets, tool organizers, and the like) which may attach to the cabinet 104 on the interior or exterior. In some embodiments, the depicted accessory storage bins 132*a*-132*c* may be placed on top of or on a hard surface within the cabinet. In some embodiments, the cabinet 104 may include one or more openings 134*a*, 134*b* in a wall (e.g., rear wall 138*a*) or door panel (e.g., door 120*c*, 122*c*) thereof, which openings 134*a*, 134*b* may receive corresponding engagement projections from the storage bins 132*a*-132*c* for hanging the bins therefrom, or vice versa. For example, FIGS. 24 and 25 depict example interior views having a plurality of storage bins 132*a*-132*c* attached to the interior of the doors via one or more perforated openings 134*a*, 134*b* in a perforated panel 136 and corresponding engagement projections on the storage bins. As depicted in FIGS. 22-27, the perforated openings 134*a*, 134*b* may not extend entirely through the cabinet doors or walls in some instances, and in some embodiments, a perforated panel 136 may be mounted to or formed as part of a door or wall panel to prevent perforations from being visible to the exterior of the cabinet. In some embodiments, the perforated panel may be the exterior door or wall panel such that the perforations are visible and engageable on both sides of the door or wall. In some embodiments, the doors and rear wall may include perforations. With continued reference to FIG. 23, in some embodiments one or more brackets 142 (also referred to as stems) may be attached to the cabinet to support one or more accessory storage bins (e.g., accessory storage bins 132*a*, 132*b* as shown in FIG. 23) as described herein with respect to the embodiment of FIGS. 18 and 20. In some embodiments, as shown in FIGS. 24 and 25, other accessory storage bins 132*c* (e.g., tool holders), such as screwdriver holders, may be engaged with the perforated panel 136, and one or more shelves (e.g., foldable shelves 140*a* as shown in FIGS. 24-25) according to any of the embodiments described herein may be engaged with one or more of the perforated panels.

With continued reference to FIGS. 24 and 25, in some embodiments, the cabinet may have one or more shelves (e.g., foldable shelves 140*a*) according to any of the embodiments disclosed herein. For example, as shown in FIGS. 24 and 25, one or more foldable shelves 140*a*, half shelves, or pull out work surfaces and storage may be used. Any of the shelves and accessory storage bins described herein may be movable and/or removable. In addition, with continued reference to FIGS. 24 and 25, in some embodiments, one or more drawers may be included in the modular cabinet.

Figure 26:
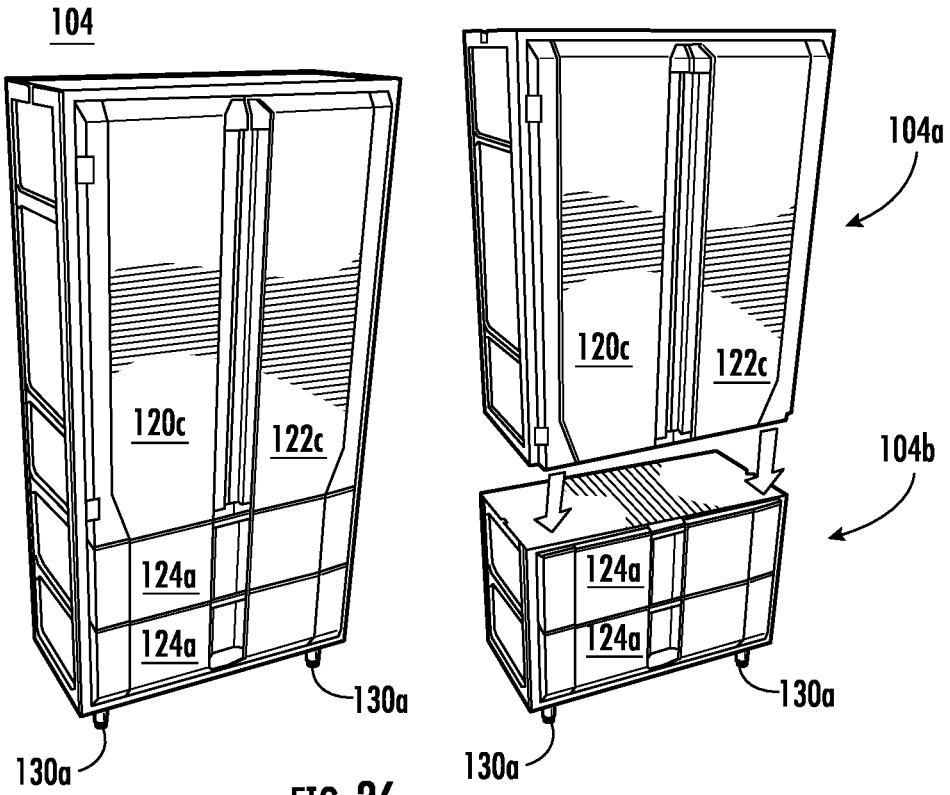
Figure 27:
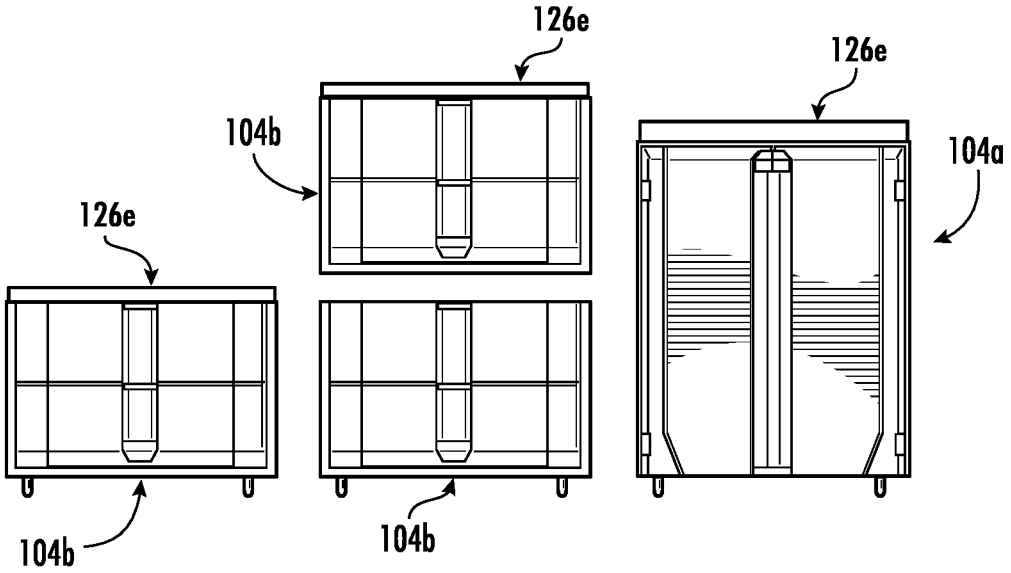

With reference to FIGS. 22-27, examples of the modular components discussed herein and usable with the modular cabinet are shown. As described herein, any of the cabinet and work top embodiments may be interoperated in a modular fashion, for example, using the components described herein. In FIG. 26, the upper portion 104*a* of the modular cabinet 104, including the two-door cabinet section 104*a* in the depicted embodiment, may be removed from the lower drawer unit 104*b*. As depicted in FIG. 27, the drawer and cabinet units (e.g., drawer unit 104*b* and cabinet units 104*a* are depicted) may be reconfigured into any combination of configurations of work top(s) (e.g., a wood work surface 126*e*), drawer cabinet unit(s) (e.g., drawer units 104*b*), and door cabinet unit(s) (e.g., door cabinet unit 104*a*). For example, FIG. 27 shows a two-drawer unit 104*b* with work top 126*e* (e.g., a "Single Bottom w/ Worktop"), two two drawer units 104*b* with work top 126*e* (e.g., a "Double Bottom w/ Worktop"), and an upper cabinet unit 104*a* with a work top 126*e* (e.g., a "Single Top w/ Work Top").

In some embodiments, the upper and lower drawer units may be different or asymmetrical, such as having upper and lower unit design features between the metallic and black colored sections. In some embodiments, as shown in FIGS. 26-27, the design of each component may be universal, such that the top and bottom units of the "Double Bottom w/Worktop" are interchangeable. For example, each individual cabinet unit may have locking mechanisms (examples described herein) on both the top and bottom surfaces for engaging other cabinet units in either direction and each individual cabinet unit may have additional engaging elements for engaging other components of the system, such as legs 130*a*, in any desired configuration. In some embodiments, the additional engaging elements may comprise threaded holes configured to receive a threaded rod connected to the respective legs or may include any other fastening means disclosed herein. In some embodiments, a user may assemble the modular components to have the same visual design language as the modular components shown in FIGS. 26-27 while varying the door and drawer configuration. In some embodiments, a user may use any combination of features to assemble according to the embodiments disclosed herein. In addition, removable legs 130*a* (as shown in each of the form factors of FIG. 27) may be attached to the lowermost modular cabinet component during use for holding the cabinet off the floor. Each cabinet unit, whether configured with doors, drawers, or otherwise, may comprise engagement features for any of the components described herein. For example, each cabinet unit may include engagement features (e.g., without limitation: magnets, clips, clip openings, perforations, latches, screws, threaded holes, pins, snaps, or other engagement elements) configured to receive a working surface on at least the top of the cabinet unit, legs on at least the bottom of the cabinet unit, engagement features of other cabinet units on the top or bottom surface, and/or one or more accessory storage bins (including bins and/or stems) on any surface. In some embodiments, a single working surface may extend horizontally between two adjacent cabinet units, which cabinet units may be at the same height or differing heights.

FIGS. 28-30 depict additional views of the two-door wall cabinet 110 of FIG. 6. For example, FIGS. 29-30 depict accessory storage bins 132*a*-132*c* (also referred to as baskets, tool organizers, and the like) which may attach to the cabinet 110 on the interior or exterior. In some embodiments, the depicted accessory storage bins 132*a*-132*c* may be placed on top of or on a hard surface within the cabinet.

In some embodiments, the cabinet may include one or more openings 134*a*, 134*b* in a wall or door panel thereof, which openings may receive corresponding engagement projections from the storage bins 132*a*-132*c* for hanging the bins therefrom. As depicted in FIGS. 28-30, the perforated openings 134*a*, 134*b* may not extend entirely through the cabinet doors or walls in some instances, and in some embodiments, a perforated panel 136 may be mounted to or formed as part of a door 120*e*, 122*e* or wall panel (e.g., rear wall 138*a*) to prevent perforations from being visible to the exterior of the cabinet. In some embodiments, the perforated panel may be the exterior door or wall panel such that the perforations are visible and engageable on both sides of the door or wall. In some embodiments, the doors and rear wall may include perforations. In some embodiments, as shown in FIG. 30, other accessory storage bins 132*c* (e.g., tool holders), such as screwdriver holders, may be engaged with the perforated panel 136, and one or more shelves according to any of the embodiments described herein may be engaged with one or more of the perforated panels.

With continued reference to FIG. 30, in some embodiments, the cabinet 110 may have one or more shelves (e.g., foldable shelves 140*a*) according to any of the embodiments disclosed herein. For example, as shown in FIG. 30, one or more foldable shelves 140*a*, half shelves, or pull out work surfaces and storage may be used. Any of the shelves and accessory storage bins described herein may be movable and/or removable.

Figure 31:
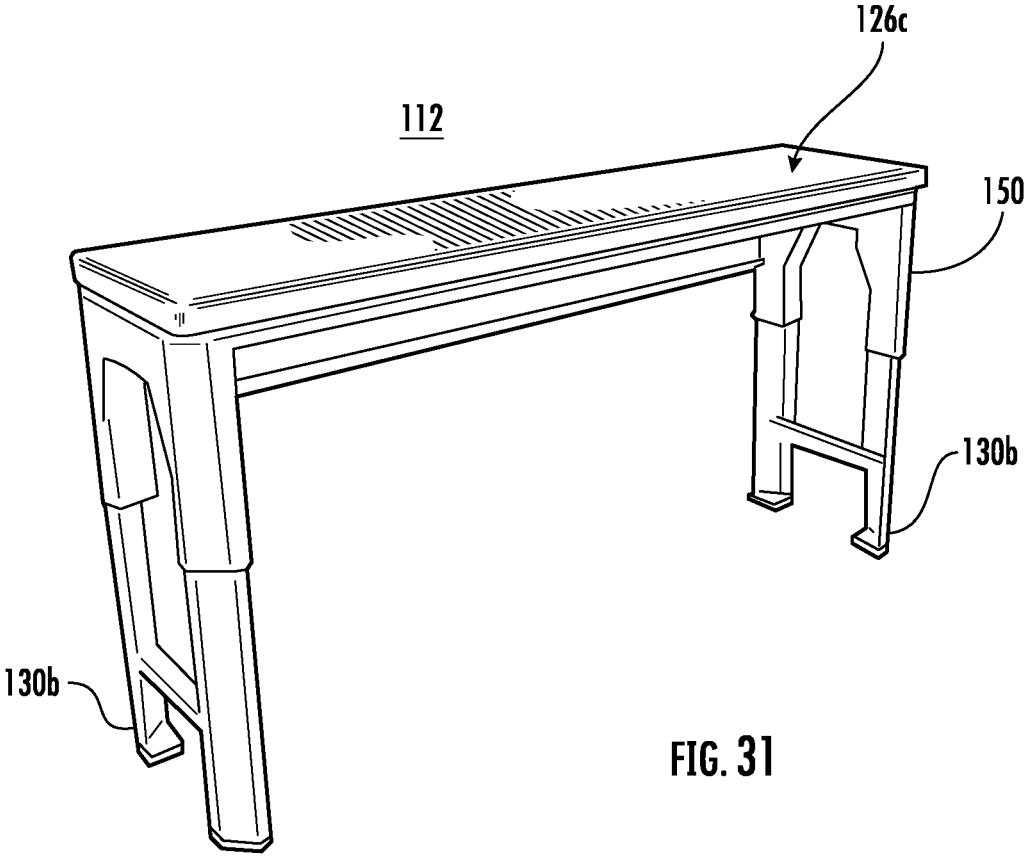
Figure 32:
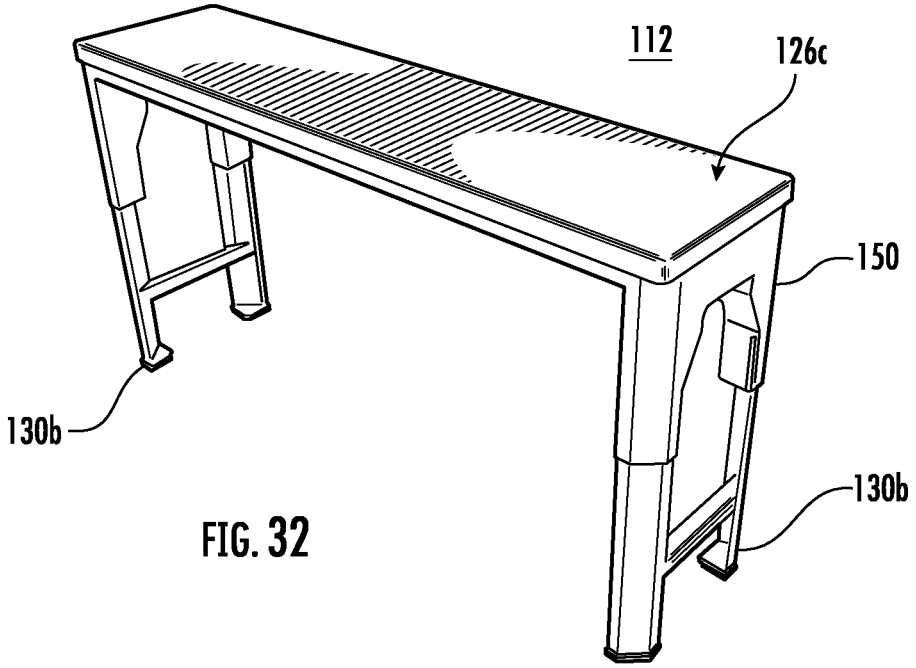
Figure 33:
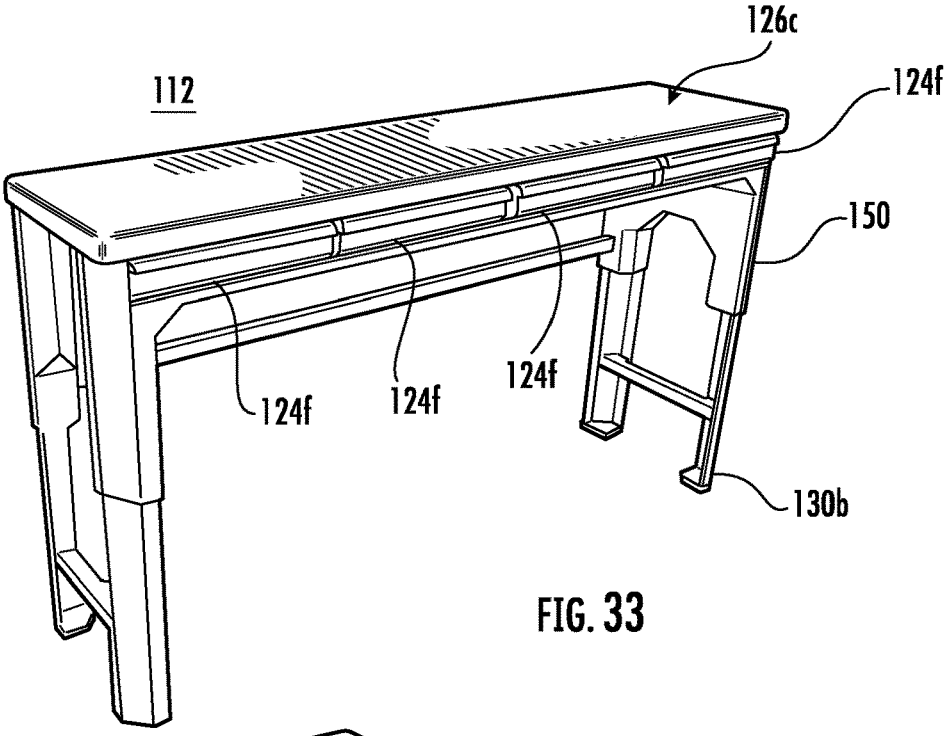
Figure 34:
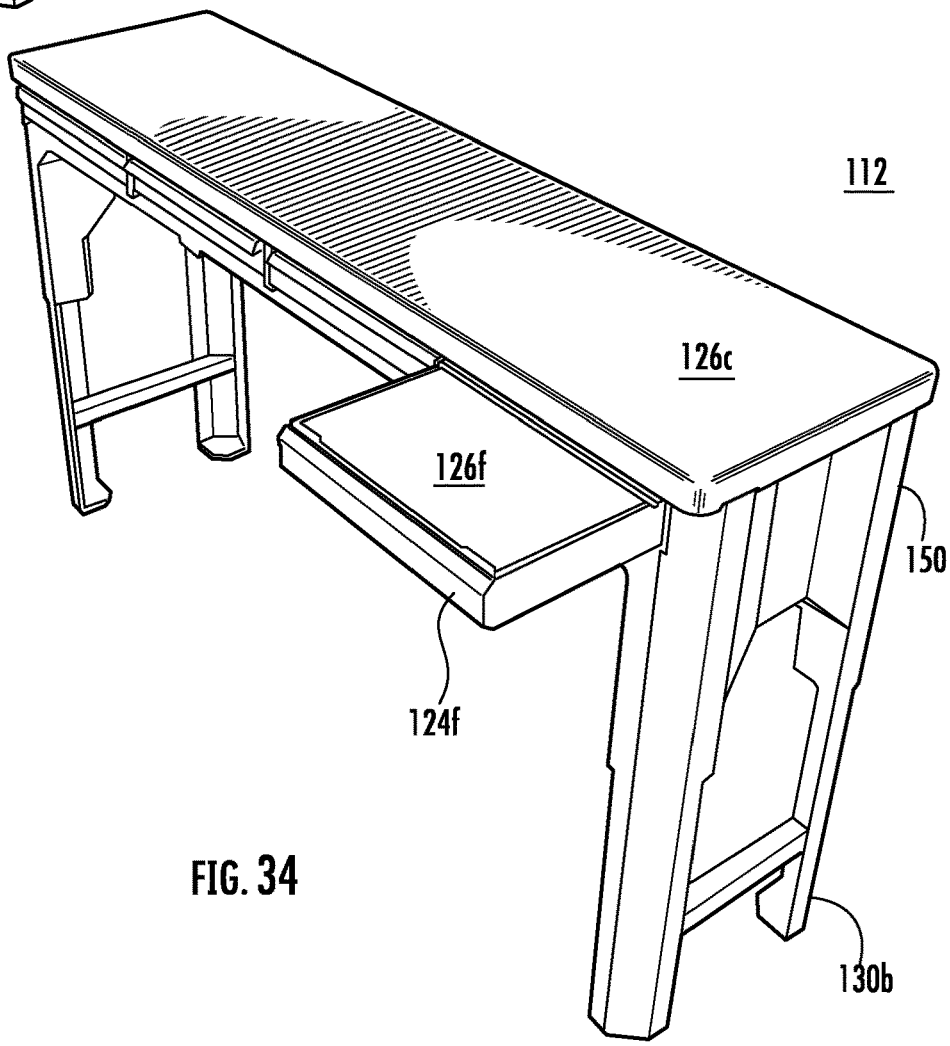

FIGS. 31-32 depict additional views of the wood work bench 112 of FIG. 7, and FIGS. 33-34 depict additional embodiments of the wood work bench 112. In the depicted embodiments, the work bench 112 includes a work surface 126*c* (also referred to as a worktop) attached to a metal and/or plastic frame 150. In some embodiments, the frame 150 may be height adjustable (e.g., by sliding the black, upper portion of the frame up and down on the lower legs 130*b*, which legs nest inside the frame). In some embodiments, the work bench 112 may include at least one drawer 124*f* on the underside of the frame. In some embodiments, the work bench may include no drawers on the underside of the frame. In some embodiments, the work bench may include three or more drawers 124*f* In some embodiments, the work bench may include four or more drawers 124*f*. In some embodiments, the drawers 124*f* may be engaged with the frame 150 beneath the work surface 126*c*. In some embodiments, as shown in FIG. 34, the drawers may include one or more secondary work surfaces 126*f* that a user may access. As discussed herein, in some embodiments, the secondary work surface 126*f* may be a top surface of the drawer 124*f*, capable of sliding along the top of the drawer to present the work surface in an operational position and to expose the drawer area beneath in a stowed position, and in some embodiments, the secondary work surface (e.g., work surface 126*d* shown in FIG. 16) is a smaller sliding element that moves separate from the work bench and the drawer beneath.

In the embodiments depicted herein, the cabinet doors (e.g., any cabinet doors, including doors 120*a*-120*e*, 122*a*-122*e*) may include handles 152 running some or all the vertical height of the respective doors along a lateral edge of the doors opposite the hinges 154 (e.g., such that the handles of adjacent doors are disposed proximate each other). In some embodiments, end caps 156 may be disposed at the vertical ends of each handle 152 (e.g., as shown in the embodiments of FIGS. 1-30). In embodiments having drawers (e.g., any drawers, including drawers 124*a*-124*h*), one or more handles 158 may extend some or all the width of the cabinet. In some embodiments, the handles may be disposed at or near the top level of the drawer. In some embodiments, the cabinets may include a channel 160 extending vertically down the front of the cabinet, and the channels may connect regardless of whether doors or drawers are used such that the appearance of a contiguous channel is preserved.

In some embodiments, the doors and/or drawer fronts may be made of metal, plastic, or the like, or a combination thereof. For example, in some embodiments, the doors and/or drawer fronts may be stamped from sheet metal. In some embodiments, all or a portion of each door and/or drawer front may be made from plastic (e.g., compression molded, blow molded, or injection molded). In some embodiments, the rest of the cabinet may be made from metal, plastic, or the like, or a combination thereof. For example, in some embodiments, a sheet metal cabinet is used.

In some embodiments, a work top may be added to any of the cabinets or components disclosed herein. In some embodiments, the work top may be made of wood, metal, or the like. In some embodiments, the work top may be attached to an underlying cabinet or frame using any of the methods discussed herein, for example, using the techniques and components for attaching the accessory storage bins, legs, and cabinets to a cabinet surface. In some embodiments, wheels 128 (e.g., caster wheels) or legs 130*a*, 130*b* may be attached to any of the cabinets (e.g., any individual cabinet unit) and components described herein for supporting a base of the cabinet.

Turning to FIGS. 35-70, various components, features, and configurations are shown that may be used with any embodiment discussed herein. With reference to FIGS. 35-36, a flat shelf 140*c* is shown that may be used in any of the embodiments of cabinet disclosed herein. The flat shelf 140*c* may be engaged with the cabinet using perforations 134*a*, 134*b* in the cabinet (e.g., using "L" or hook shaped engagement tabs that insert into a protrusion), pins and recesses, screws and holes, magnets, welding, adhesion, or any other attachment mechanism as would be understood by a person of ordinary skill in the art in light of the present disclosure.

With reference to FIGS. 37-39, a foldable shelf 140*a* is shown that may be used in any of the embodiments of cabinet disclosed herein. In the depicted embodiment, the foldable shelf 140*a* includes two foldable panels 162 supported by a frame 164 comprising one or more lateral support bars 166, with the panels pivoting about a rear hinge 168. The support bars 166 may include a flange 170 (also referred to as a lip) that projects inwardly to support the weight of the panels 162 and objects thereon in combination with the hinge 168. In some embodiments the lateral support bars 166 may form an "E" shaped frame to allow two or more foldable panels 162 to be supported thereon. The depicted embodiment also includes a hole 172 on each panel 162 proximate the center support bar. The holes 172 may be used to lift the panel 162 (e.g., a user may insert their finger into the holes). The shelves 140*a* may be supported by engaging the perforated openings 134*a*, 134*b* within the cabinet as discussed herein (e.g., "L" or hook shaped engagement tabs that insert into a protrusion), pins and recesses, magnets, screws and holes, welding, adhesion, or any other attachment mechanism as would be understood by a person of ordinary skill in the art in light of the present disclosure.

FIG. 39 shows two pairs of foldable shelves 140*a* with the left-most panel 162 in an upright or stowed position to demonstrate how a large item may be loaded into the cabinet (e.g., resting on the floor and extending up past the lateral support bars of an upwardly stowed shelf). As described herein, any of the shelves may be used in combination with other style shelves and bins. For example, FIG. 39 also shows three flat shelves 140*c* according to the embodiment of FIGS. 35-36. Any number of foldable panels 162 may be used in a single shelf 140*a* to allow the users' desired width of storage area. In some embodiments, the various reconfigurable shelves disclosed herein may save the user time by allowing flexible adaptation of the storage space without removing or repositioning an entire shelf. In some embodiments, a magnet may be used to hold the foldable shelf panel 162 in an upright position at 90 degrees or greater relative to the downward, in-use position. In some embodiments, the magnet may be disposed on the cabinet wall above the shelf's lateral supports 166. Any of the shelves disclosed herein may be mounted to the cabinet via, for example, protrusions engaging a openings 134*a*, 134*b* in the cabinet (e.g., using "L" or hook shaped engagement tabs that insert into a protrusion), pins and recesses, screws and holes, magnets, welding, adhesion, or any other attachment mechanism as would be understood by a person of ordinary skill in the art in light of the present disclosure.

Figure 42:
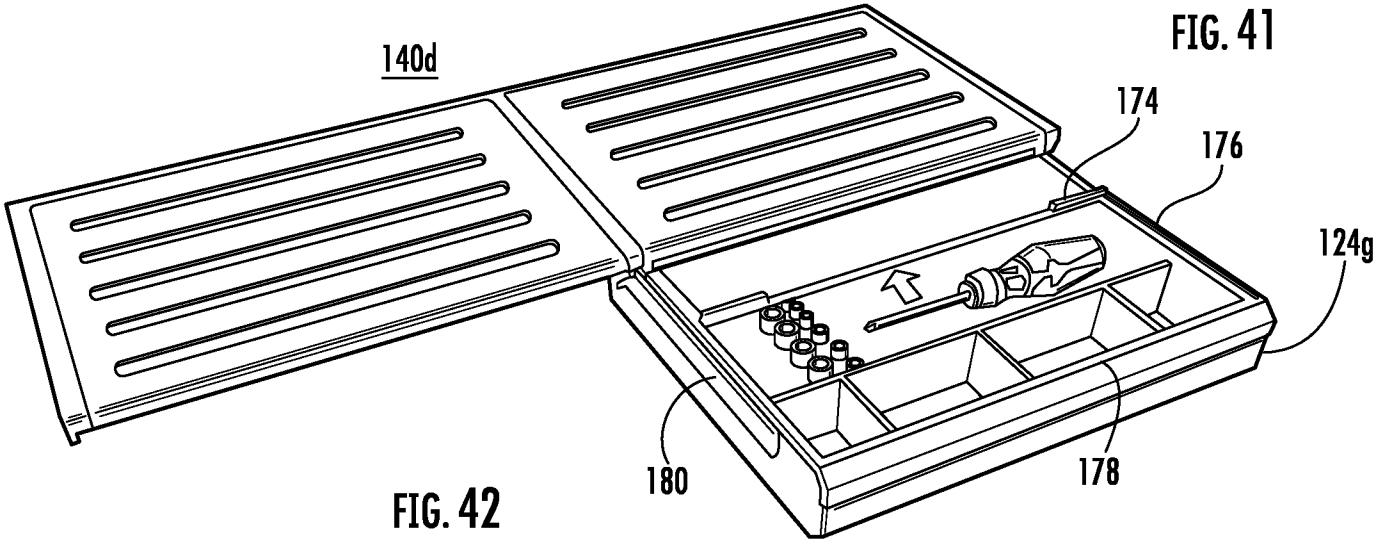

FIGS. 40-44 illustrate an example shelf 140*d* with a pull-out work surface 126*f* (also referred to as a secondary work surface or drawer cover) and drawer 124*g* is shown. In the depicted embodiment, the right side of the shelf includes a drawer 124*g* for holding items therein (e.g., as shown in FIG. 42). In some embodiments, the shelf may further include a secondary work surface 126*f* that slides atop the drawer beneath the shelf surface. A user may pull a tab 174 on the front edge of the secondary work surface 126*f* to slide the work surface out for the user (e.g., to the deployed position shown in FIG. 41). Similarly, the user may push the tab 174 of the secondary work surface 126*f* back to reveal the drawer contents beneath. In some embodiments, a recess or other pulling element may be used, or no pulling element may be used.

In some embodiments, as described herein with respect to the secondary work surfaces, the secondary work surface 126*f* may be engaged with and slide along the drawer 124*g* or may be attached to the cabinet separately. For example, in the embodiment shown in FIGS. 40-42, the secondary work surface 126*f* is configured to travel in tracks 176 defined at an upper edge of the left and right sides of the drawer 124*g*. In some embodiments, a flange 178 (e.g., a raised lip) of the drawer 124*g* may limit the travel of the secondary work surface 126*f* to prevent the secondary work surface from traveling beyond an end of the drawer.

In some embodiments, the drawer 124*g* may ride on one or more sliding elements 180 (e.g., rails or tracks), which sliding elements may be connected to the underside of the upper surface of the shelf 140 in some embodiments.

Figure 43:
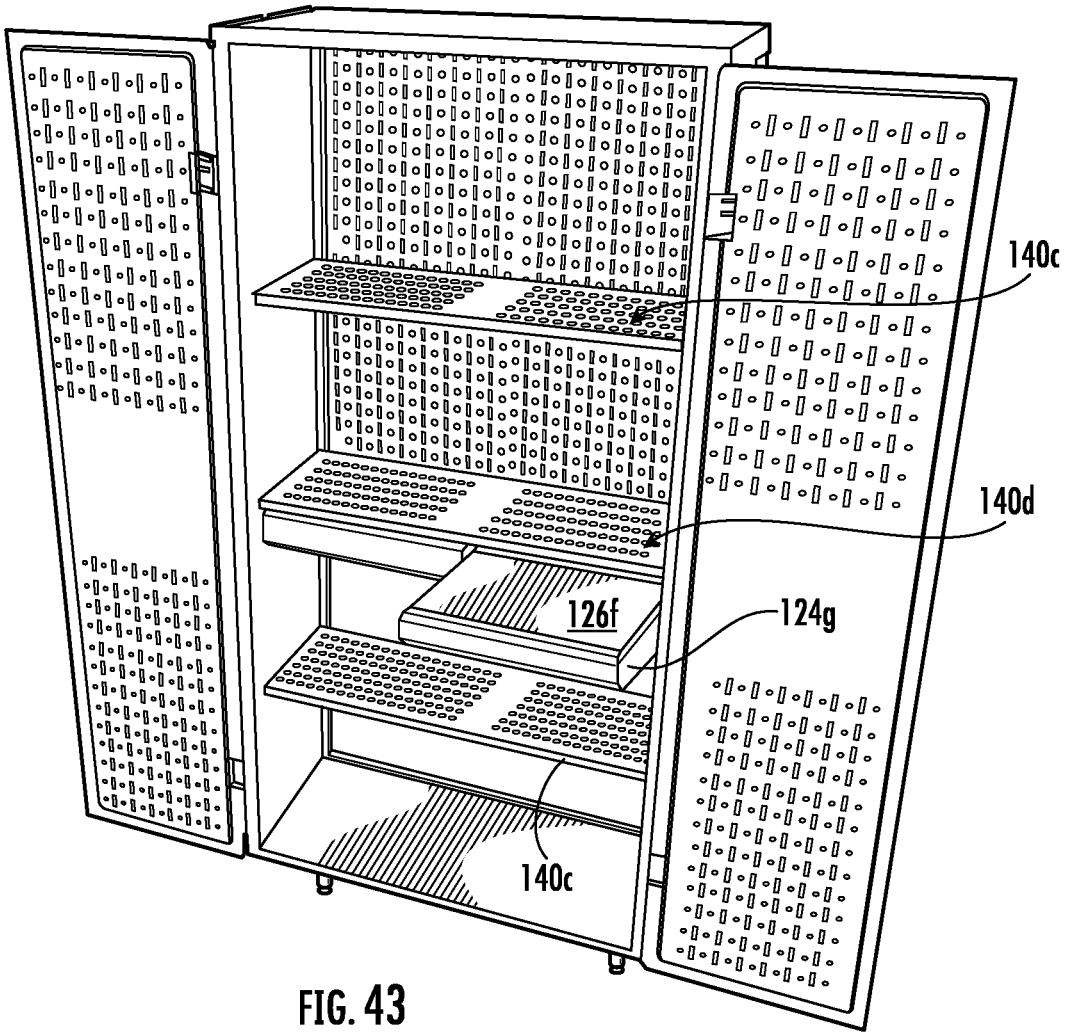

In some embodiments, the secondary work surface 126*f* (also referred to as a drawer cover) may lock in a closed position via one or more locking elements to prevent unwanted access to the drawer. Any number of drawers may be used in a single shelf 140*d* to allow the users' desired storage area. With reference to FIG. 43, a cabinet is shown having a shelf 140*d* with two pull out secondary work surfaces 126*f* and drawers 124*g* as described herein. The depicted secondary work surfaces 126*f* are positioned near work surface height for ease of use (e.g., within the middle third or the middle fifth of the height of the tall cabinet), and in some embodiments, the secondary work surfaces 126*f* and the shelves 140*d* may be modularly disposed at any height. In some embodiments, the secondary work surfaces (e.g., secondary work surface 126*f*) may be positioned at any height, and preferably from 28 inches to 28 inches from the floor.

Figure 44:
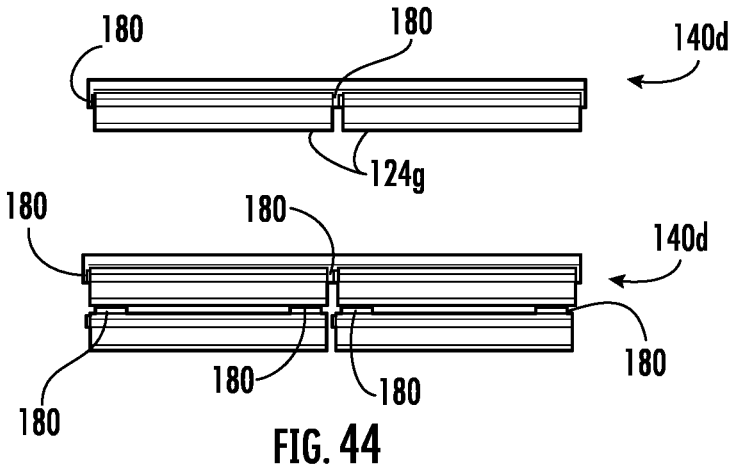
Figure 45:
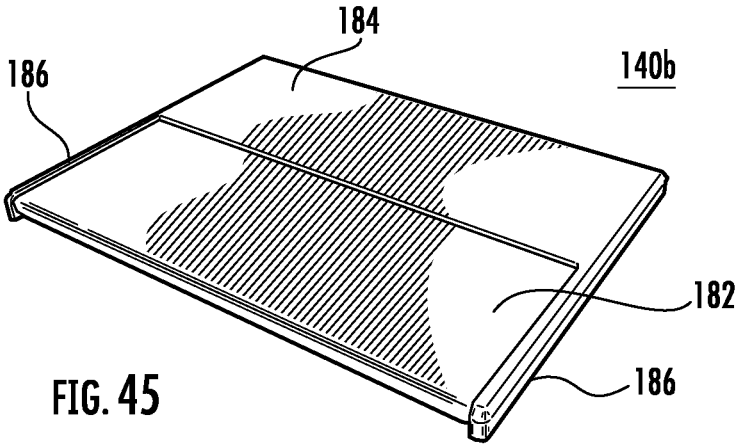
Figure 46:
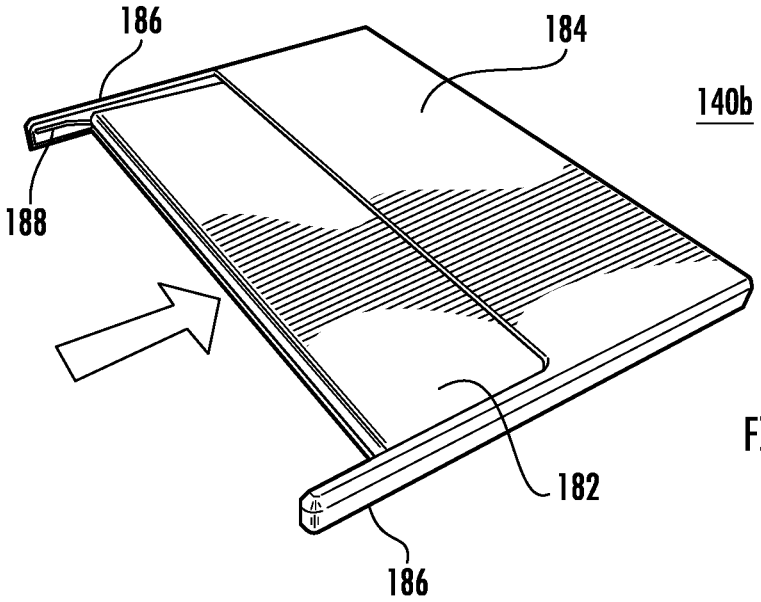
Figure 47:
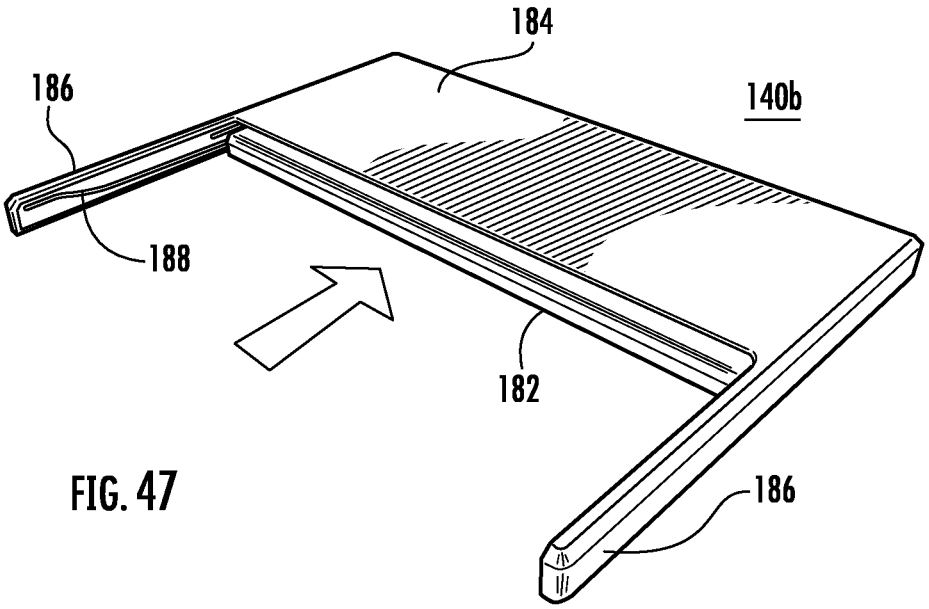

FIG. 44 shows example embodiments of the drawer configurations that include multiple layers of drawers 124*g* and work surfaces 126*f* beneath a shelf. In some embodiments, the lower drawers 124*g* may slide along sliding elements 180 connected to the bottoms of the upper drawers 124*g* such that both sets of drawers may be opened simultaneously to define a collective secondary work surface 126*f* that includes both drawers. In some embodiments, the lower drawer may slide along the under the shelf as a singular cabinet-width storage compartment, such that it affords a long continuous extendable work surface. Similarly, horizontally separated drawers may be opened simultaneously to define an extended secondary work surface. For example, the layered pull-out design shown in FIG. 44 may expand to reveal four secondary work surfaces 126*f* simultaneously.

FIGS. 45-48 show example half shelves 140*b* according to some embodiments disclosed herein. As shown from FIGS. 45-17, a slidable portion 182 (e.g., approximately half of the upper surface area of the shelf) of the shelf retracts beneath a portion of the remaining, fixed portion 184 of the shelf 140*b* to leave an open space over roughly half of the surface area of the shelf. The open space left by the half shelf may allow large items from the shelf below to extend up past the half shelf and/or may allow clearance for bins and items stored on the door panels when closed. The half shelf 140*b* may prevent the various bins or tool holders mounted to the inside of the door from causing interference inside the cabinet when the doors are closed.

Figure 48:
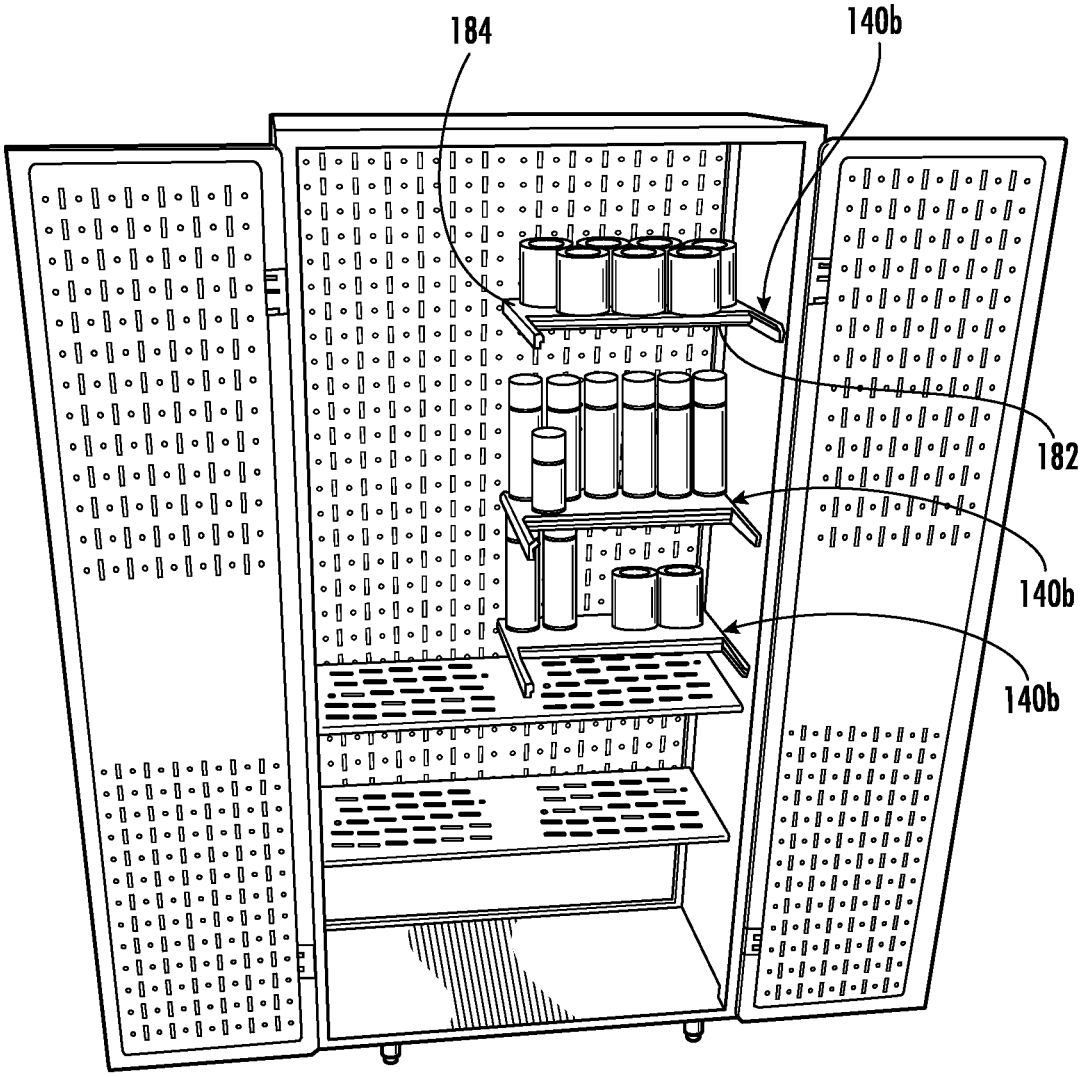

In some embodiments, the fixed portion 184 of the half shelves 140*b* may have lateral supports 186 that support the slidable portion 182 on either side, and guide tracks 188 on the lateral supports guide the slidable portion between a deployed position and a retracted position (e.g., via engagement between pins or protrusions on the slidable portion and the tracks). In the deployed position, the slidable portion 182 may be disposed at or below a height of the fixed portion 184. During retraction, the slidable portion 182 may move downward and rearward beneath the stationary half panel (e.g., following the tracks 188 shown in FIG. 47), such that the two portions are disposed at the same height or substantially the same height when the full surface area of the shelf 140*b* is in use. FIG. 48 depicts three example half shelves 140*b* in a cabinet with the slidable portions 182 in a retracted position to accommodate paint cans on the fixed portion 184 and large objects in the void left by the retraction of the slidable portion 182. In some embodiments, two or more half shelves 140*b* may be used in a vertical row (e.g., similar to the foldable shelf 140*a* embodiment discussed above). In some embodiments, as illustrated in FIG. 48, the voids of the half shelves 140*b* may be aligned vertically to facilitate larger items extending vertically past multiple shelves. In some embodiments, the half shelves 140*b* may be staggered vertically between the left and right sides of the cabinet (e.g., the vertical position of the left-side half shelves is between the vertical position of the right-side half shelves). In some embodiments, the half shelves 140*b* may be vertically or horizontally aligned.

Figure 49:
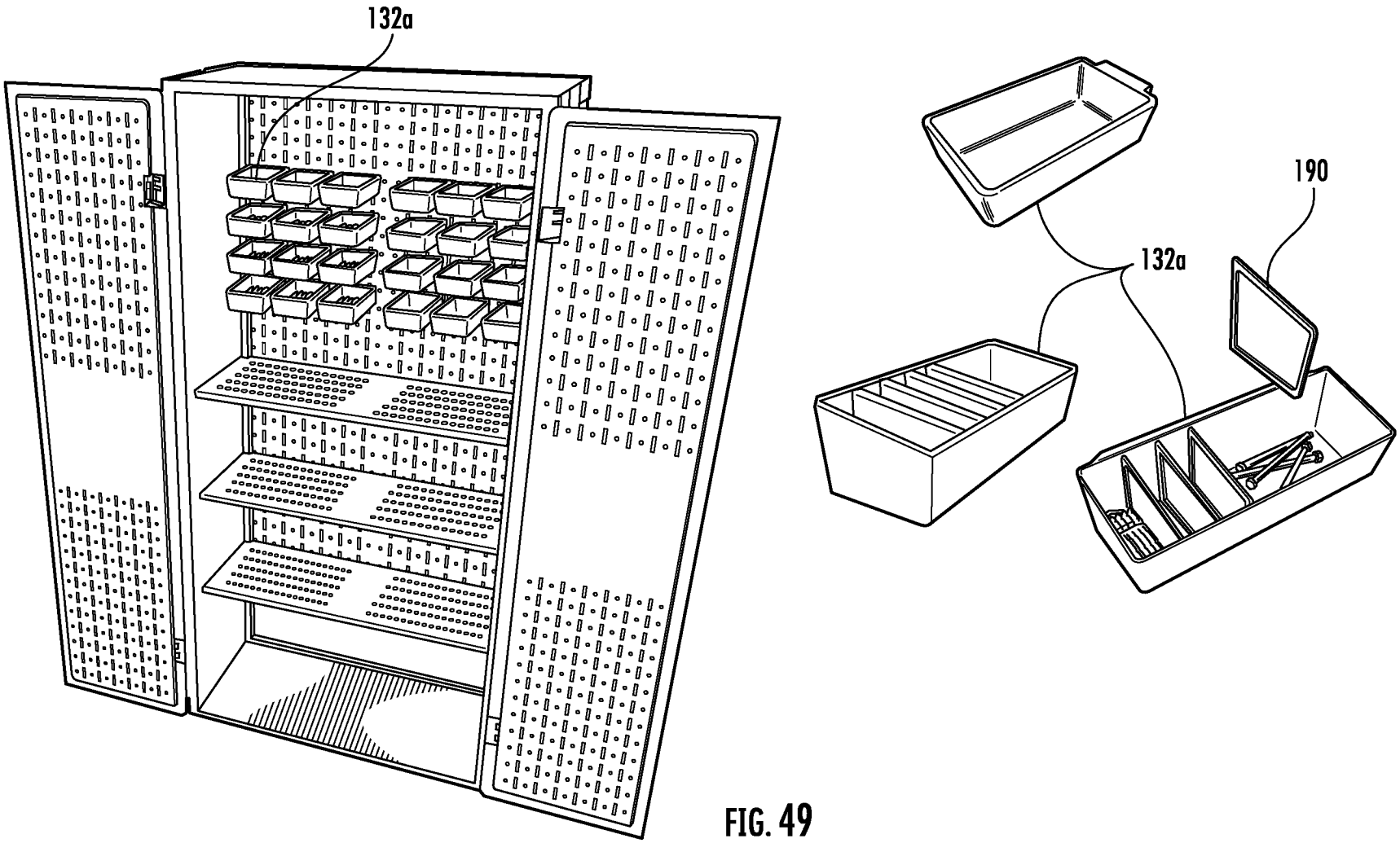
Figure 50:
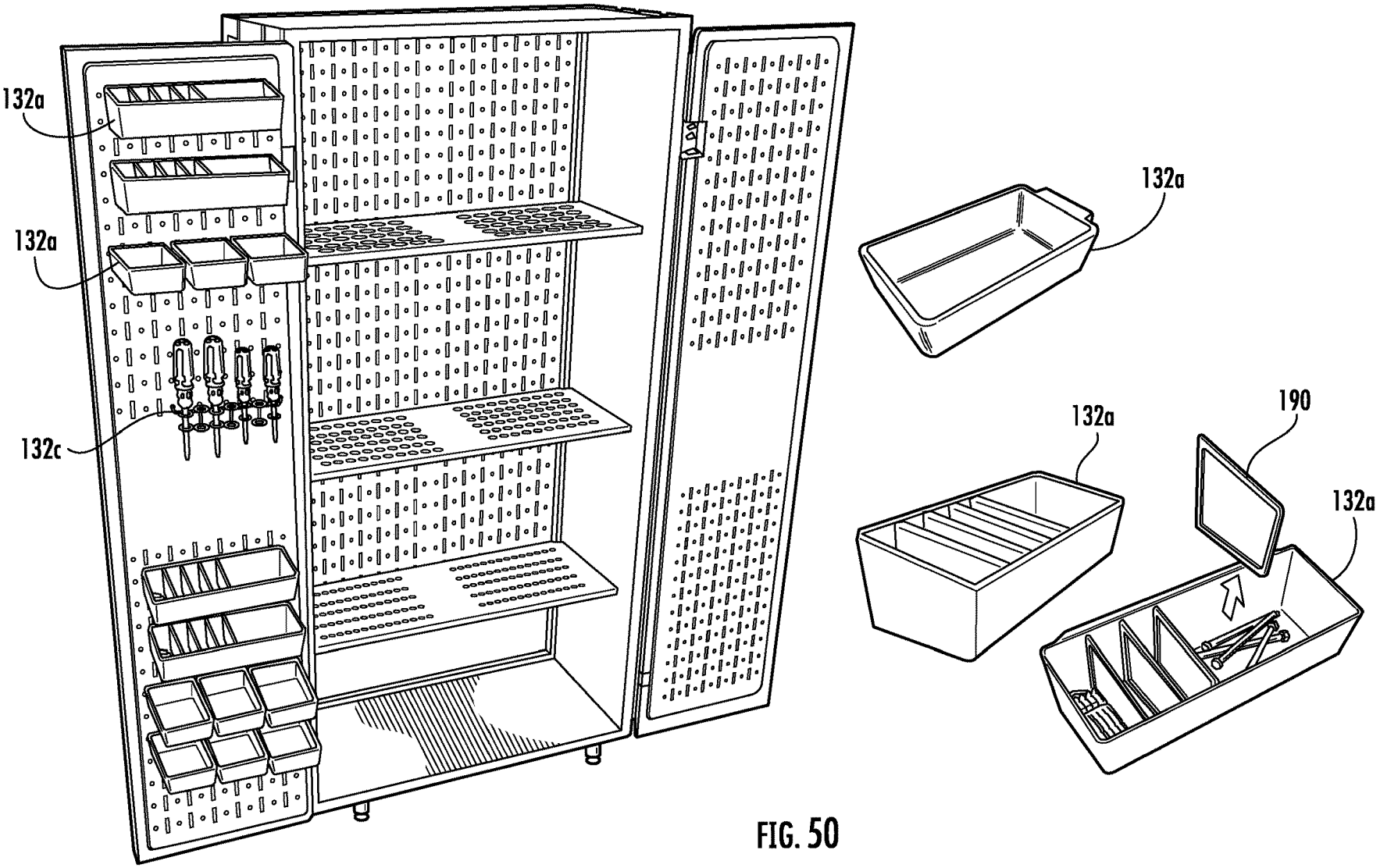
Figure 51:
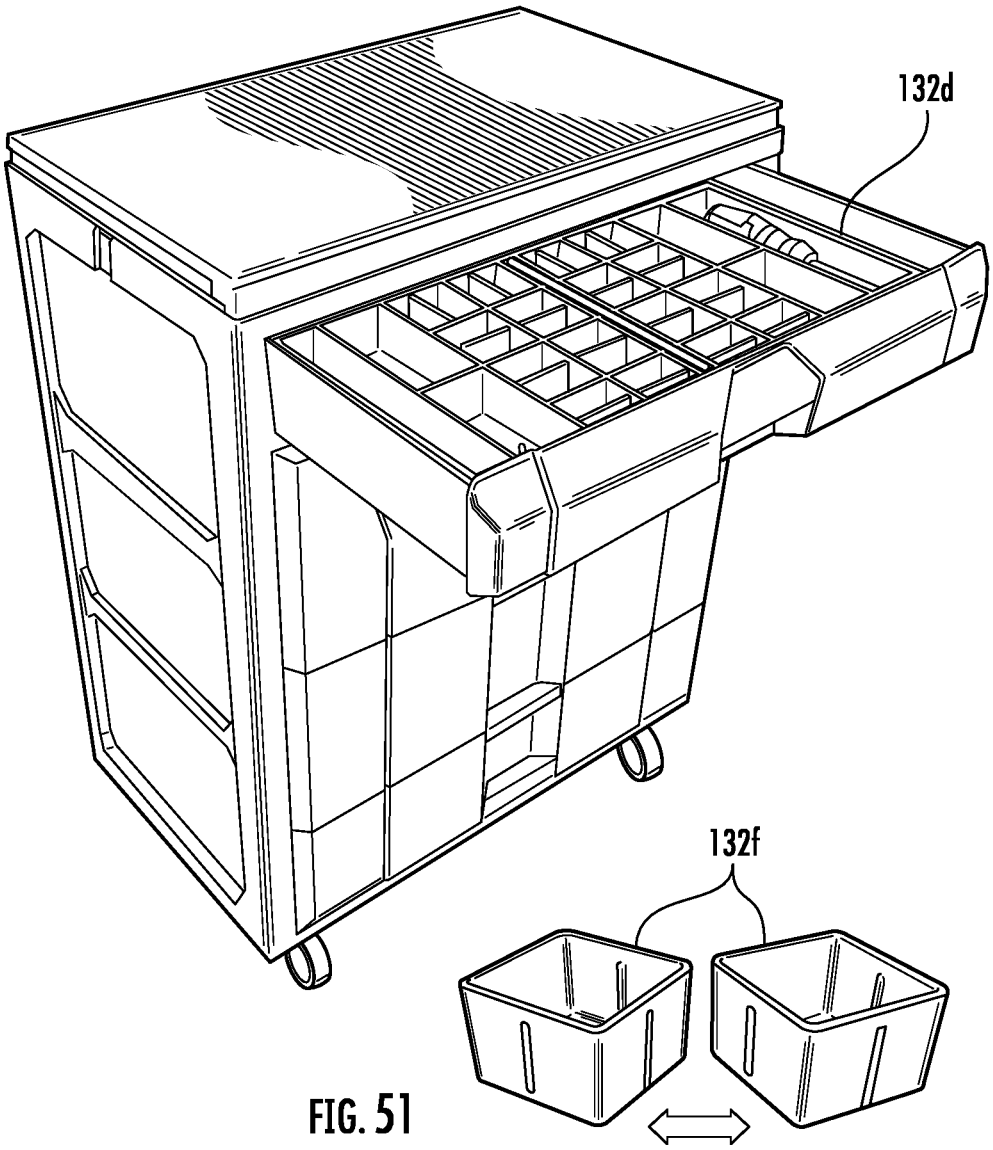
Figure 52:
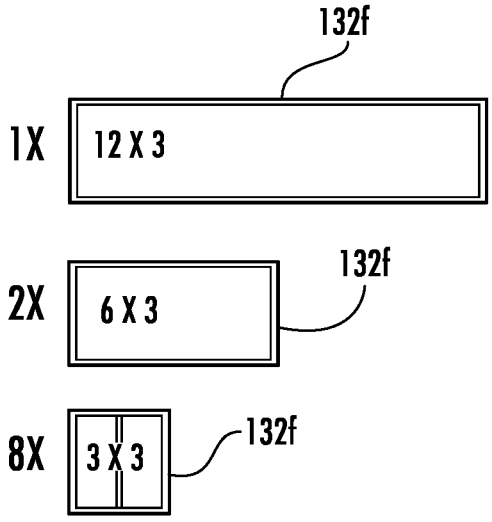
Figure 53:
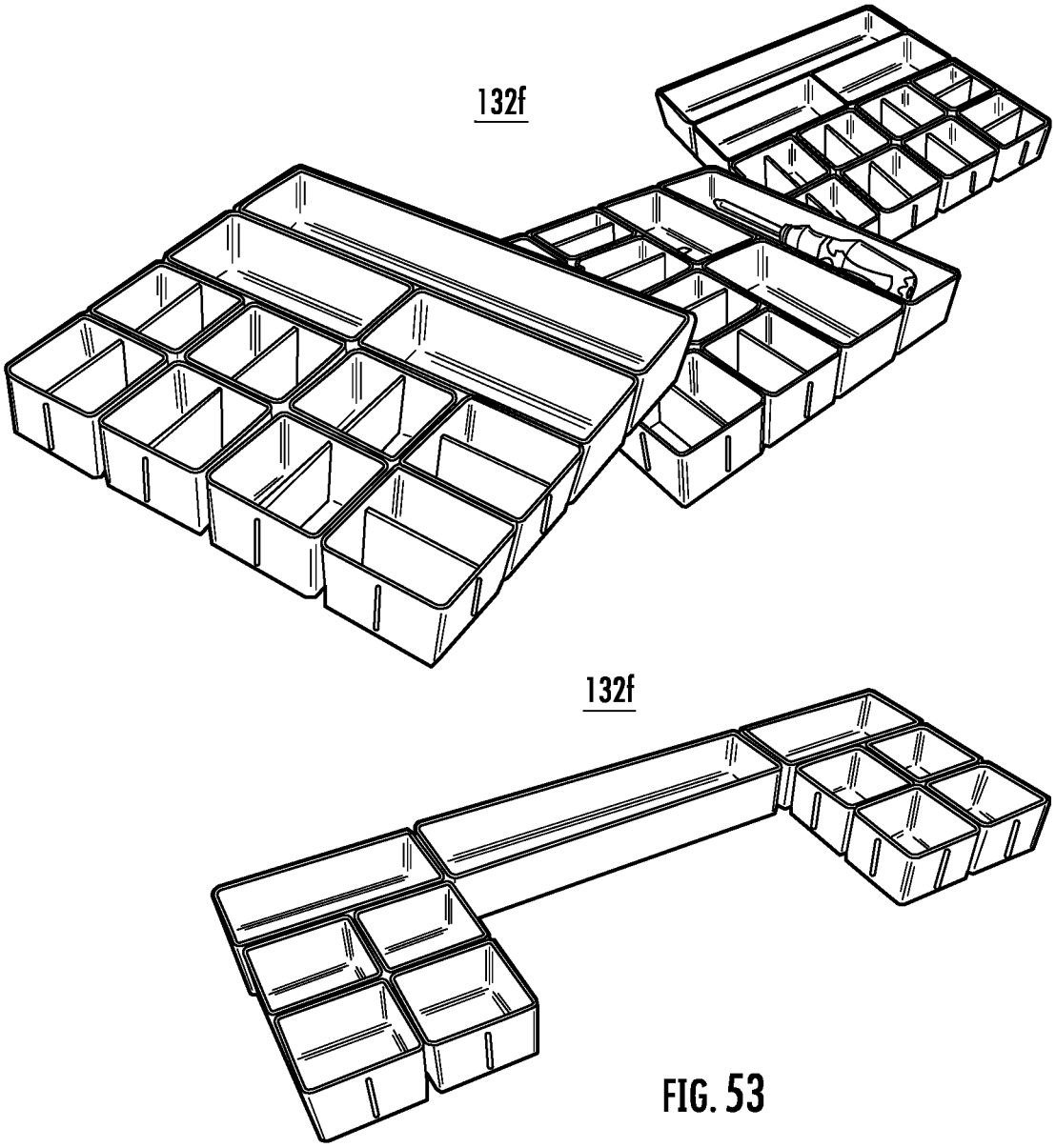
Figure 54:
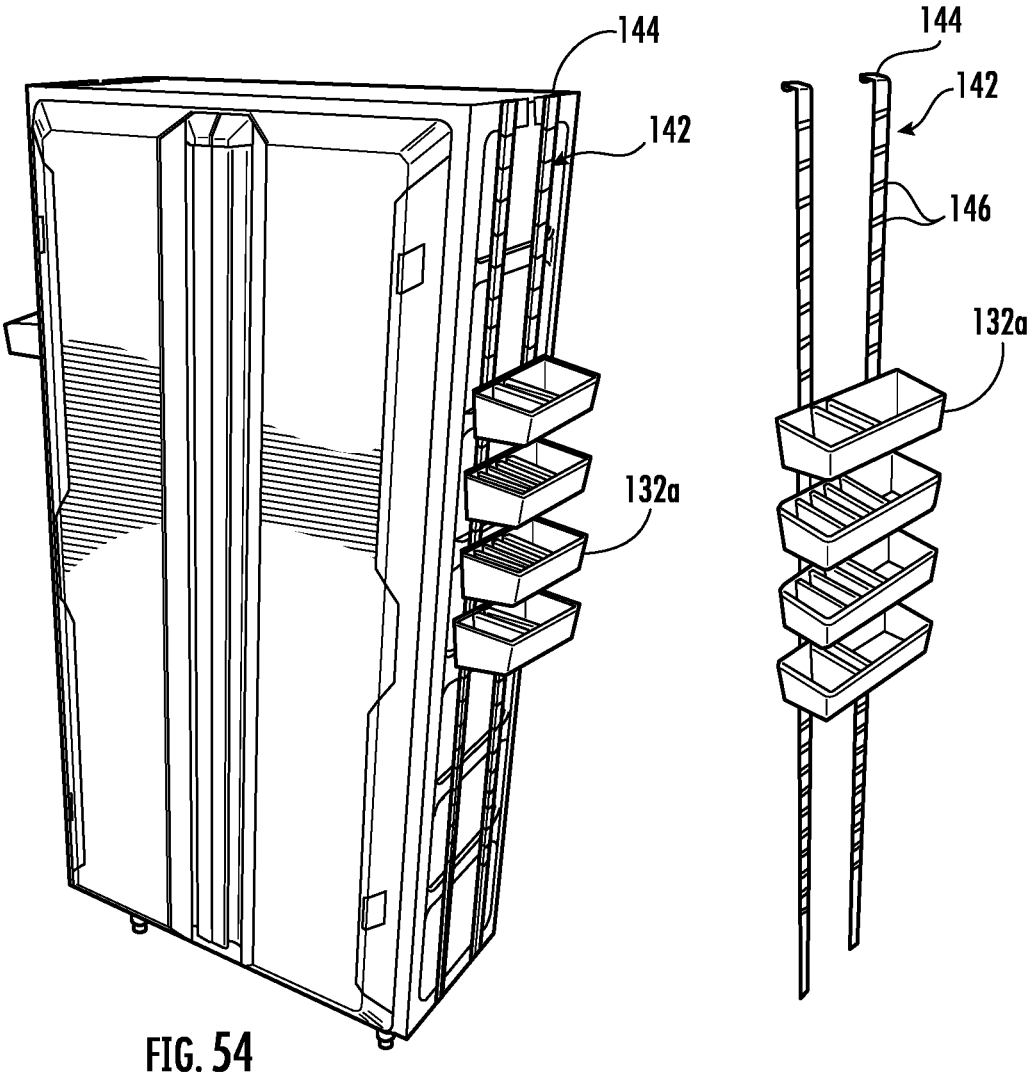
Figure 55:
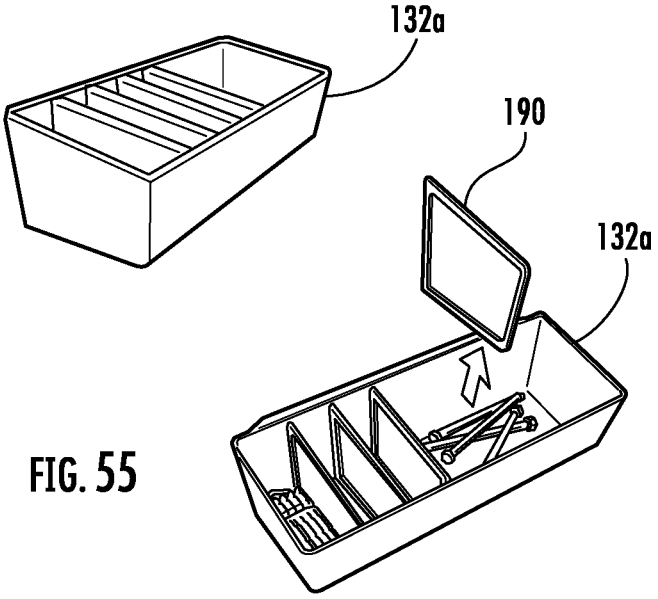
Figure 57:
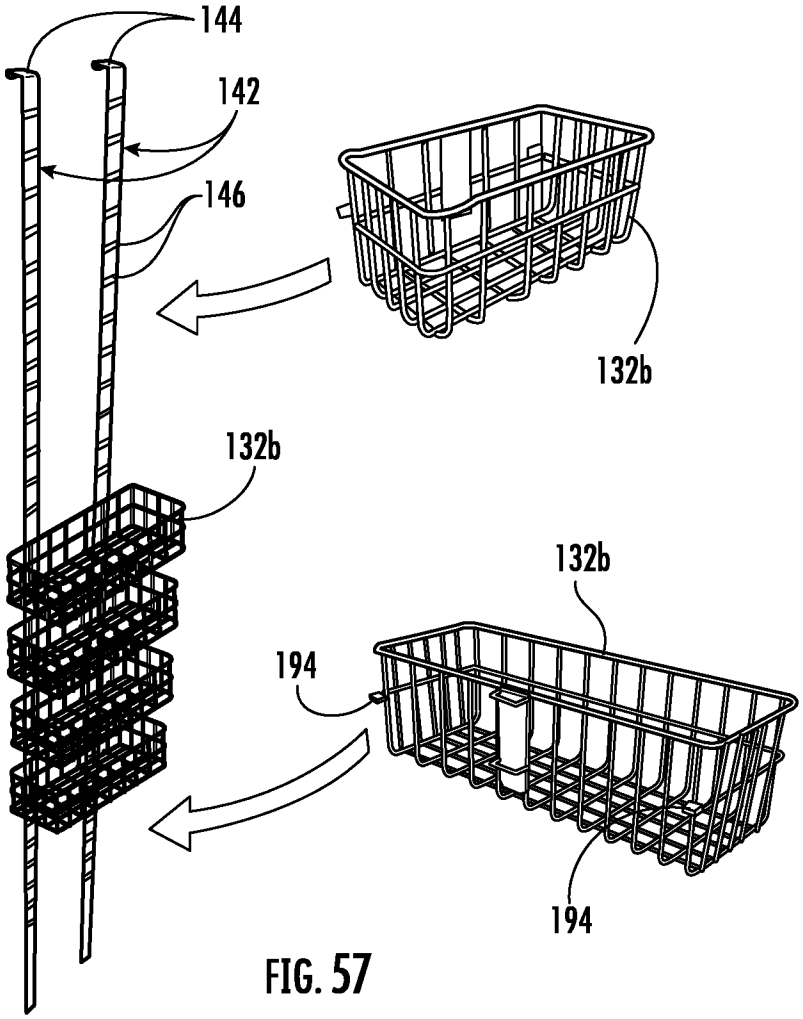
Figure 56:
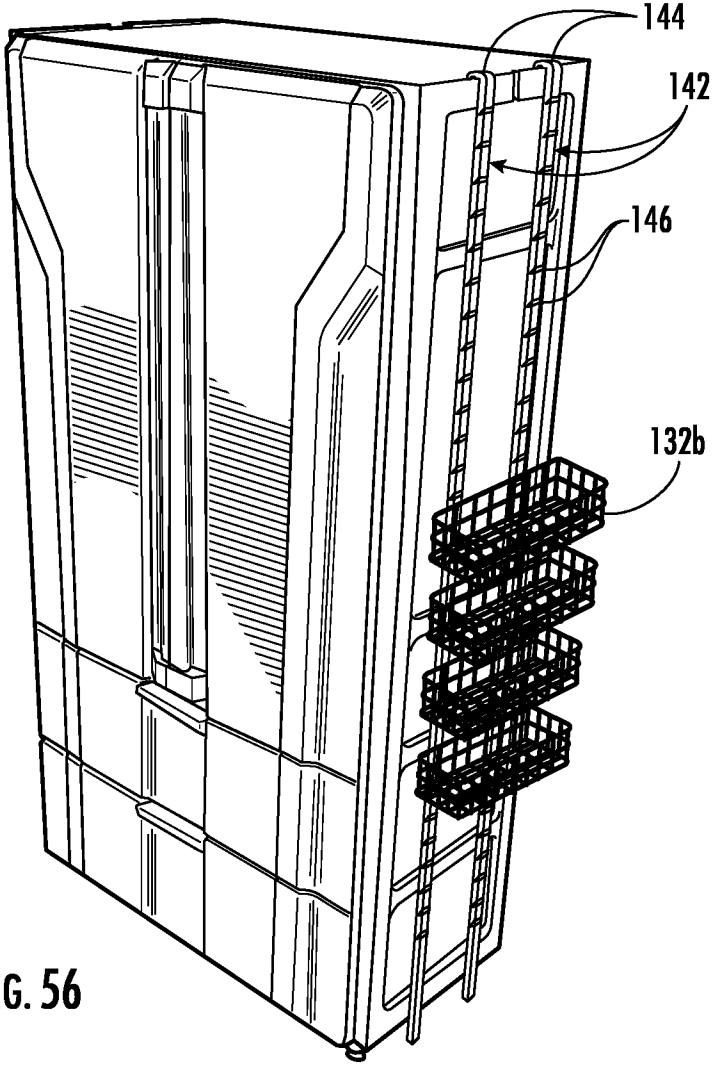

FIGS. 49-57 depict embodiments of a cabinet using a plurality of accessory storage bins 132*a*-132*d*, 132*f* for various small parts and tools. The accessory storage bins may include a plastic bin 132*a*, a wire basket 132*b*, a tool holder 132*c*, a drawer insert 132*d*, a modular drawer insert 132*f*, or any other accessory storage bin. FIG. 49 also illustrates an example accessory storage bin 132*a* with removable dividers 190 which may be positioned in the cabinet (e.g., engaging a perforated panel as shown in FIG. 49 or via any of the other attachment mechanisms discussed herein) and/or resting on one or more surfaces of the cabinet. FIG. 50 illustrates the bins 132*a*, 132*c* positioned on a perforated panel of the doors of a cabinet. FIG. 51 illustrates bins 132*d* (e.g., an organizer) in a drawer. FIG. 52 illustrates connectable bins 132*f* that may be assembled to form any number or shape of storage bins, and FIG. 53 illustrates example configurations of such bins.

FIGS. 54-57, 60-63 illustrate externally mounted bins 132*a*, 132*b*, 132*e*. In some embodiments, a bracket 142 (also referred to as a "stem") may be disposed on the exterior of cabinet for supporting one or more bins thereon. In some embodiments, two brackets 142 may be disposed in parallel along the side of the cabinet. The brackets may have hooks or flanges 144 at one end for supporting the bracket from a top wall 138*a* (e.g., via the top corner or a ridge of the side panel extending upwardly from the top surface) of the cabinet. In some embodiments, the brackets may be disposed on any side or surface of the cabinets. In some embodiments, a connecting rail may join two adjacent brackets to maintain spacing and keep the brackets parallel. In some embodiments, the brackets may include a flat distal end that engages a slot (e.g., slot 192 shown in FIG. 60) near the base of the cabinet. In some embodiments, the bin may be a wire basket, and may have one or more rubber stops (e.g., rubber stops 194 shown in FIG. 57) for engaging the cabinet. In any of the embodiments discussed herein, the brackets and other attachment features for securing items to the cabinets may contain perforations, holes, slots, keyways, key slots, French cleats, hanging straps, or other attachment means described herein.

With reference to FIGS. 58-59, an erasable board 196 is shown disposed on a side wall 138*d* of a cabinet. In some embodiments, the board may include one or more magnets for attaching to a metal side wall of the cabinet. In some embodiments, the board may include hooks for hanging the board from a top wall of the cabinet (e.g., via a bracket 142 assembly as described herein).

Figure 63:
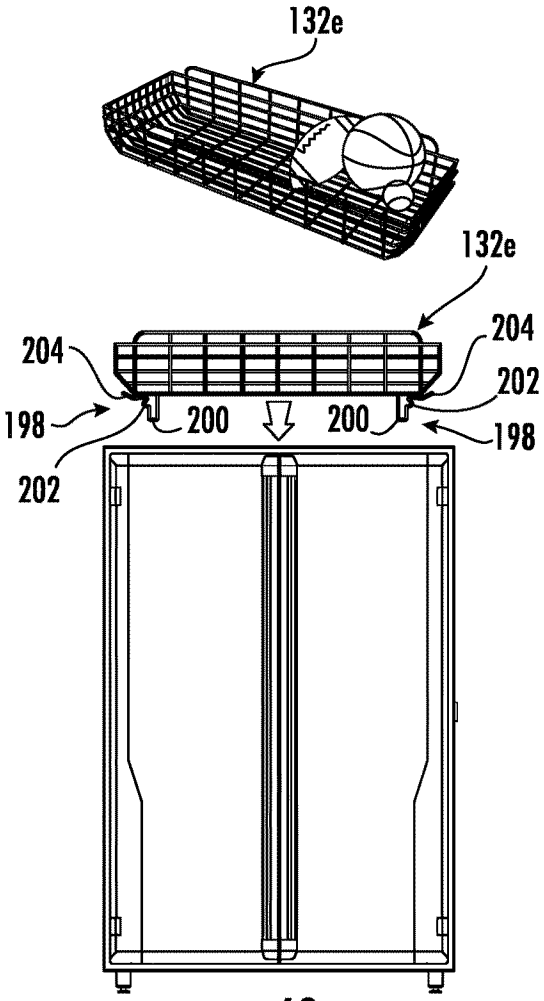
Figure 61:
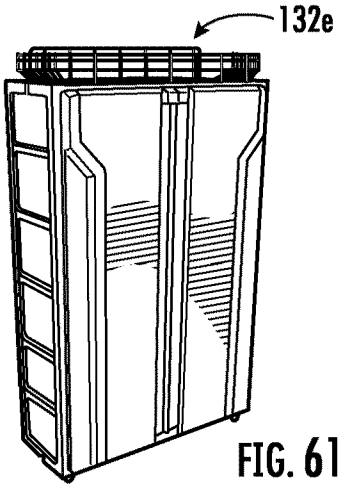

With reference to FIGS. 60-63, an accessory storage bin 132*e* is shown that may be attached to a top wall 138*b* of the cabinet. In the depicted embodiment, the bin 132*e* includes a footprint that is smaller than or equal to the footprint of the cabinet on which the bin is to be installed. In some embodiments the bin may include one or more releasable clips 198 (e.g., spring clips as shown in FIG. 63) for engaging a top wall 138*b* of the cabinet. The clips 198 may include one or more protrusions 200 (e.g., a curved or U-shaped protrusion) for inserting into a slot in the wall of the cabinet and one or more projections 202 extending from the protrusions for engaging an underside of the wall and holding the bin to the top of the cabinet. The depicted embodiment includes a "spring" shaped clip protrusion 200 that is formed in a "U" shape and configured to compress the legs of the "U" inwardly during insertion to allow the one or more protrusions 202 to clear the opening in the cabinet before snapping outwardly to engage the cabinet and hold the accessory bin in place. In some embodiments, an actuator tab 204 (e.g., a distal end of the spring shaped clip) may allow the protrusion 200 to be laterally compressed to release the projections and allow the bin to be removed.

FIGS. 64A-64C depict example embodiments of how two or more cabinets may be attached according to any of the embodiments discussed herein. In the depicted embodiment, the upper cabinet (e.g., an upper, two door cabinet of a modular cabinet) may engage a lower cabinet (e.g., a two-drawer cabinet of a modular cabinet) using a plurality of locking mechanisms 206. For example, one cabinet may include one or more locking feet 208 that are received by a locking element 210 of the other cabinet, and one or more pin members 212 may then be inserted through openings in the foot and recess to secure the cabinets to each other. For example, the pin member 12 may be inserted from within the cabinet or may be built into the locking mechanism 206.

With reference to FIGS. 64B-64C, an embodiment of the locking mechanism 206 is shown which includes a locking foot 208 and locking element 210, which locking mechanism 206 may be used to connect any of the cabinets and components described herein. The locking foot 208 may be secured to a bottom wall 138*e* of the upper-most cabinet (e.g., the cabinet shown in FIG. 64A), such as by welding, screwing, or other attachment means such that the locking foot 208 extends downwardly from the upper cabinet. In the depicted embodiment, the locking foot 208 includes two angled support arms 214 extending inwardly towards each other from a proximal portion 216 of the locking foot to the distal supporting portion 218 of the locking foot. The distal supporting portion 218 may extend between respective distal ends of each of the two angled support arms 214. The proximal portion 216 may define flanges extending from each of the angled support arms 214. In the depicted embodiment, the flanges 214 include holes for securing the locking foot 208 to the bottom wall of the upper cabinet unit. The locking foot 208 may further comprise openings 228 for receiving the pin member 212 therethrough. In operation, the distal supporting portion 218 of the locking foot 208 may further be configured with a lower surface (e.g., the flat surface depicted in FIGS. 64B-64C) capable of supporting the cabinet on ground.

With continued reference to FIGS. 64B-64C, the locking element 210 may be secured to a bottom surface of a top wall 138*b* of the lower cabinet unit (e.g., the cabinet shown in FIG. 64A), such as by welding, screwing, or other attachment means such that the locking element 210 extends downwardly from the bottom surface of the top wall. The locking element 210 may be accessed via an opening in the top wall 138*b* of the lower cabinet unit. In the depicted embodiment, the locking element 210 includes two angled support arms 222 extending inwardly towards each other from a proximal portion 224 of the locking element to the distal portion 226 of the locking element. The distal portion 226 may extend between respective distal ends of each of the two angled support arms 222. The proximal portion 224 may define flanges extending from each of the angled support arms 222. The locking element 210 may further comprise openings 230 for receiving the pin member 212 therethrough. In the depicted embodiment, the locking foot 208 and the locking element 210 may have the same, matching shapes, and they may be oriented in the same orientation during engagement, which orientations are shown in FIGS. 64B-64C.

In the embodiment depicted in FIG. 64B, the pin member 212 comprises a bolt 232 and nut 234 for securing the two cabinet units together via the locking foot 208 and locking element 210. To lock the two cabinets, the locking foot 308 may be inserted into the opening 220 in the top wall of the lower cabinet unit to nest between the angled support arms 222 of the locking element 210, which may cause the openings 228, 230 in the locking foot and locking element to align. Once aligned, the bolt 232 may be inserted through all four openings and the nut secured on the opposite side to hold the cabinet units together.

In the embodiment depicted in FIG. 64C, the pin member 212 comprises two pin caps 236 disposed on a rod 238. In the depicted embodiment, the rod 238 is secured to a center flange 240 mounted to the distal supporting portion 218 of the locking foot 208. Springs 244 may engage the center flange 240 and the proximal ends of the pin caps 236 to urge the pin caps outwardly. During engagement, the upper cabinet unit may be secured to the lower cabinet unit by inserting the locking foot 208 into the opening 220 in the top wall of the lower cabinet unit. The pin caps 236 may naturally extend through the openings 228 in the locking foot 208 and may be urged inwardly towards the center flange 240 by the user and/or the contour of the angled support arms 222 of the locking element 210. The pin caps 236 may then snap through the openings 230 in the locking element 210 when the openings 228, 230 in the locking foot 208 and locking element 210 align. To unlock the cabinet units, the process may be reversed by the user compressing the pin caps 236 until the locking foot 208 releases the locking element 210. The locking foot 208 may also comprise one or more outer flanges 242 for guiding and limiting the motion of the pin caps 236 as shown in FIG. 64C.

The pin member may include other engaging elements, such as a pin, clip, magnet, screw, tab, or other removable fastener.

As discussed herein, any combination of the disclosed cabinets and related components may be made as an individual unit, either with a unitary structure or a modular structure. In some embodiments, the attachment mechanisms depicted in FIGS. 64A-64C may be used to allow a user to later assemble to cabinets that have been manufactured and purchased separately. In some embodiments, the work surface may attach via the same connector shown in FIGS. 64A-64C. In the embodiments disclosed herein, the modular cabinet 104 may be sold as a single item (e.g., 2 parts connected) but allow the individual purchaser to reconfigure the unit (or multiple units) to create new configurations specific to their garage, shop or place of business. For example, multiple lower sections could be positioned to erect a work table/island, or the two top halves used on either side of a single bottom half to make a miter saw station.

FIG. 65 depicts an example two axis door hinge 154 according to some embodiments. The depicted hinge 154 may be used with any of the door embodiments shown and described herein. The depicted hinge 154 includes two offset axes of rotation 246, 248 (depicted as dashed lines) about which the door can rotate through the door's range of motion. The hinge may be configured to rotate 90 degrees or more from the closed position (e.g., the position shown in the first image of FIG. 65) on the cabinet frame to the open position (e.g., the position shown in the last, bottom image of FIG. 65). The two-axis hinge 154 may prevent interference with the frame of the cabinet when the door is opened to its fullest extent.

In any of the embodiments discussed herein, the doors of cabinet may be outwardly located from the front edge of the cabinet housing to allow for the doors to open greater than 90 degrees. The two-axis door hinge 154 may facilitate greater accessibility of the cabinets by allowing the doors to open wider than would otherwise be achieve if the door resides within (or planar to) the surrounding cabinet housing. In some embodiments, the resulting visual frame of the cabinet can be seen when standing in front of the unit even though it is backwardly offset from the door.

The left side of the depicted hinge 154 further includes a rapid assembler device 250 which allows quick installation of the door. The pin 254 and spring 252 of the rapid assembler device 250 mates into a female slot of the converse shape in the frame of the door to quickly connect the door to the cabinet while avoiding awkward handling issues and time-consuming fasteners. For example, a tip of the pin may engage with a hole in the door in some embodiments. Although the spring 252 is depicted extending through the frame of the rapid assembler device, it may be compressed between the frame and the tab 258 to urge the pin 254. In some embodiments, another connector, such as a plate, arm, or other connecting element, may be used instead of the rapid assembler device to allow the door to pivot about the second axis. In the embodiment of FIG. 65, the hinge 154 includes a plate 256 configured to attach to the cabinet and a tab 258 configured to insert into the door and be actuatable by a user. The plate 256 includes a hinge joint 262 configured to define the first axis 246. A body 160 of the hinge 154 then connects to the plate 256 at the hinge joint 262.

The second axis of rotation 248 is defined at an intersection of the frame of the rapid assembler device 150 and the body 260 (e.g., the rapid assembler device 150 rotates about the axis 248 between the right-most image and the lowermost image of FIG. 65). The second axis of rotation 248 is then spaced from and parallel to the first axis 246 in the depicted embodiment.

With reference to FIG. 71, a top-down diagram of the hinge 154 connected to the cabinet and door is shown. In the depicted view, the rapid assembler device 250 connects the hinge 154 and the door and rotates about the second axis 248 relative to the body 260, and the body 260 rotates about the first axis 246 relative to the plate 256, which plate is connected to the cabinet.

Figure 66:
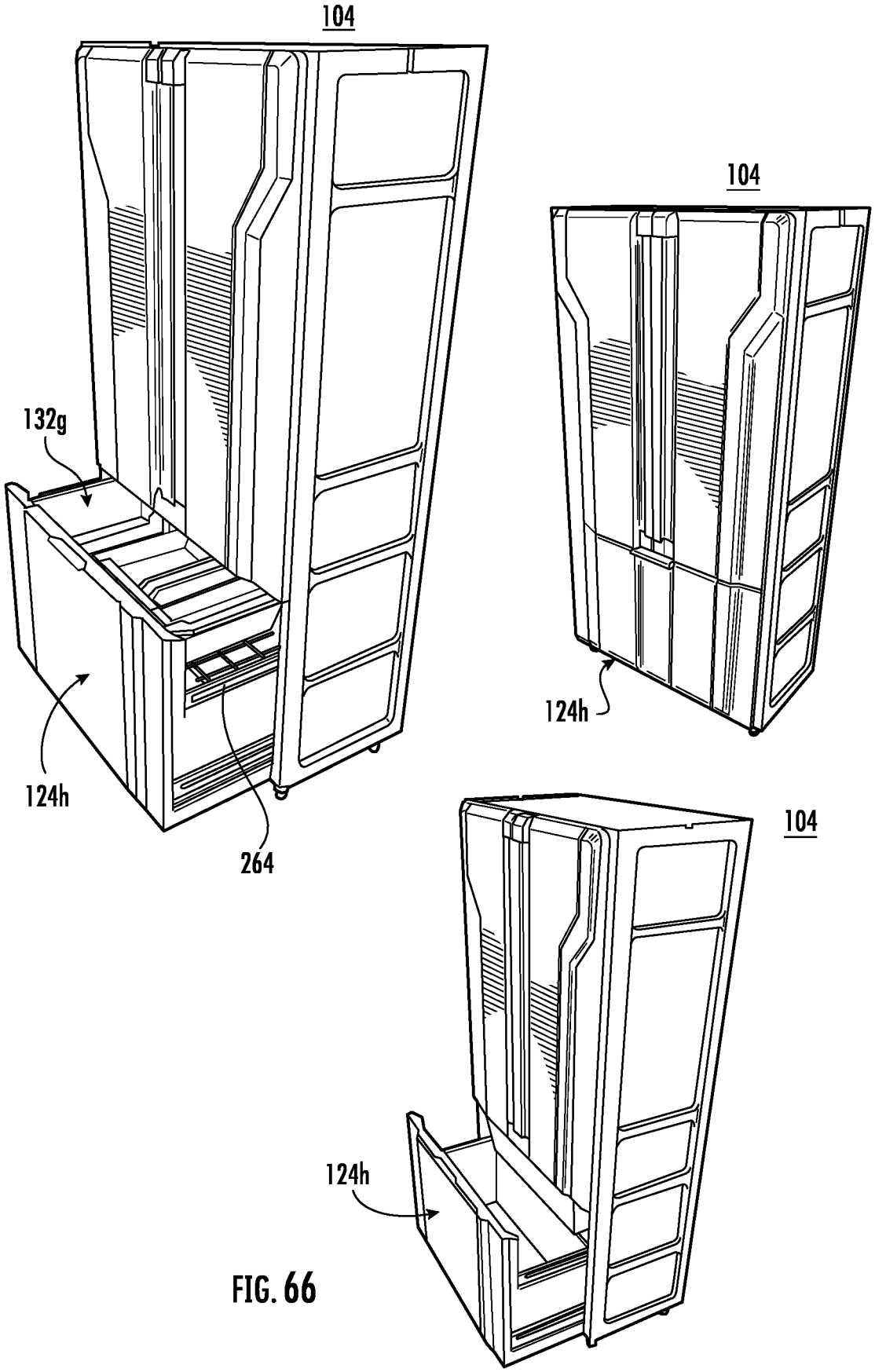
Figures 67, 68:
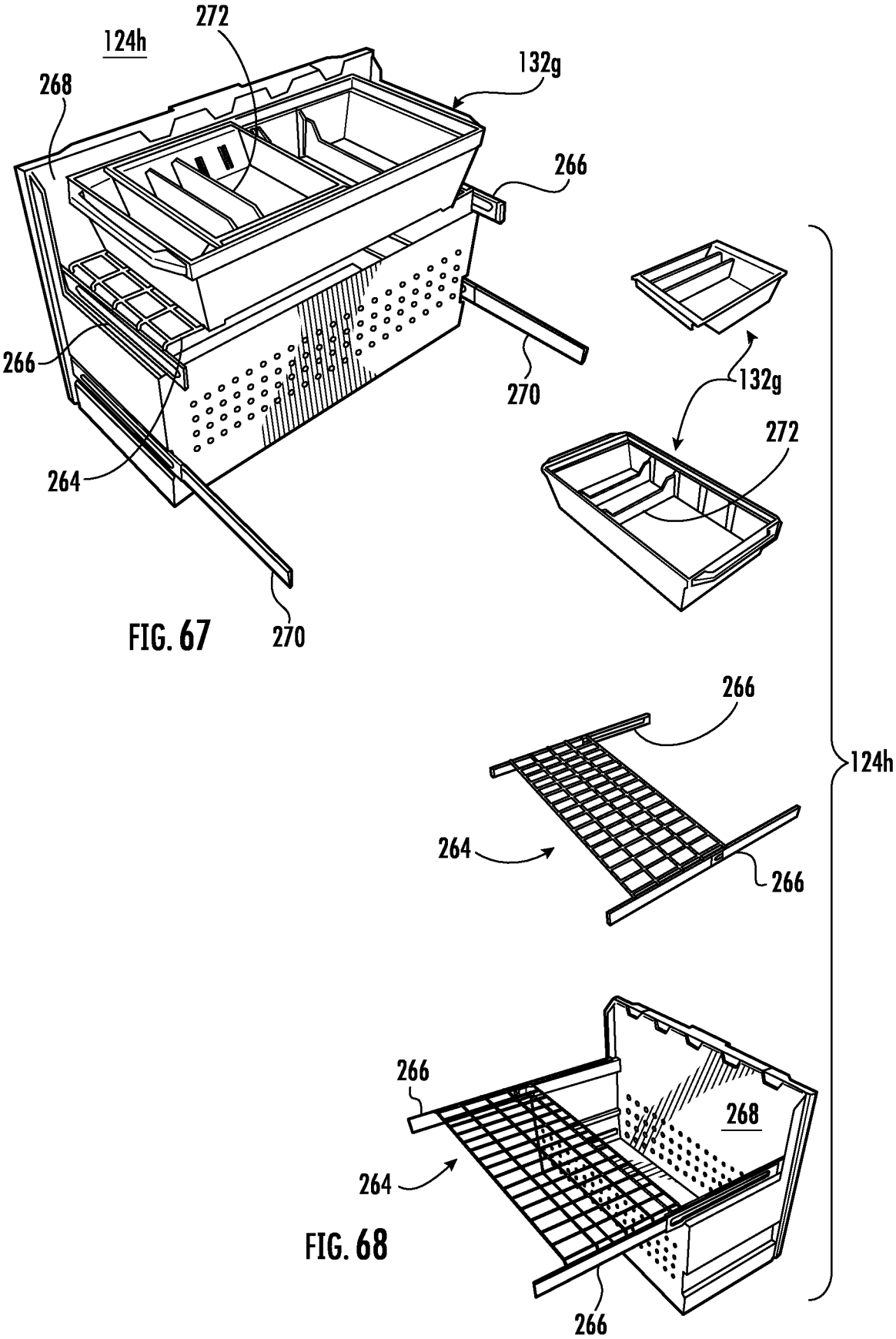

Turning to FIGS. 66-70, an example drawer configuration is shown according to some embodiments discussed herein. With reference to FIG. 66 a large drawer 124*h* is shown as part of a modular cabinet 104, and the drawer may be used in any cabinet unit configuration disclosed herein, or as its own unit. The depicted large drawer 124*h* extends the full height of the drawer unit and includes one or more sliding drawer features within it. With reference to FIG. 68, the large drawer 124*h* may include a rack 264 configured to slide relative to a body 268 of the drawer on one or more sliding elements 266 attached to the body. One or more accessory storage bins 132*g* may be disposed on the rack 264. In some embodiments, one or more drawers may be attached to the body 268 of the drawer via the sliding elements 266. The sliding drawer features may move with the large drawer body 268 and/or may move independently as described herein. The large drawer 124*h* may be attached to the surrounding cabinet via one or more sliding elements 270 (e.g., drawer glides as disclosed with respect to any drawer embodiment herein). The inner, sliding drawer features (e.g., the rack 264 and the accessory storage bins 132*g*) may attach only to the large drawer in some embodiments (e.g., via the sliding elements 266. In some embodiments, the large drawer unit 124*h* may be a modular cabinet unit used as described with respect to the other cabinet units described herein.

With reference to FIGS. 67-70, the internal components of example large drawers are shown. With reference to FIG. 68, the drawer may include a small tray 132*g*, a large tray 132*g*, a wire rack 264, and an outer large drawer body 268. With reference to FIG. 67, the small tray 132*g* may slide right or left within the large tray and may include repositionable dividers 272. The large tray 132*g* may rest on top of the wire shelf and may have handles on the right and left sides for easy removal and positioning. The large tray 132*g* may also include repositionable dividers 272 and may include a foam pad insert in the bottom. The wire rack 264 may be connected to the large drawer body 268 to hold the removable trays 132*g* discussed above. The wire rack 264 may telescope into the cabinet to allow user access to the lower portion of the large drawer (e.g., as shown in FIG. 66). For example, FIGS. 69 and 70 show the wire rack 264 in each of the respective inward and outward positions for allowing or restricting access to the lower large drawer.

Each of the aforementioned units, components, and features may be incorporated in whole or in part into any of the embodiments described herein. For example, a single, horizontal shelf may include two or more of the various shelf configurations described herein.

Figure 62:
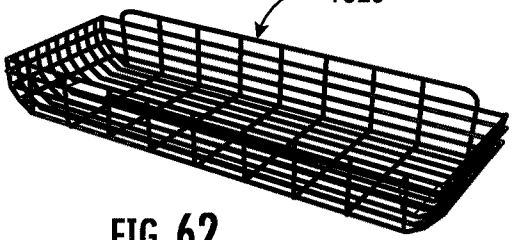
Figure 60:
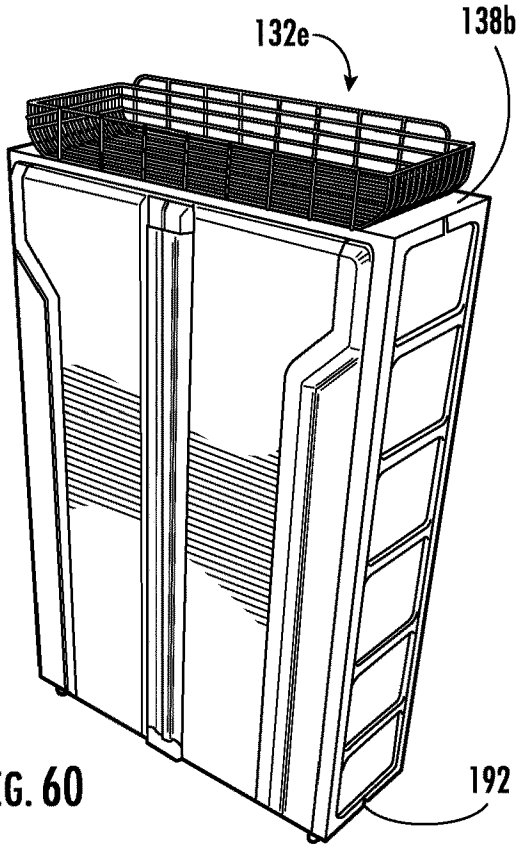

The Appendix to Specification attached to this disclosure includes additional images of various embodiments of the present disclosure and is incorporated by reference herein. The additional figures shown in the Appendix to Specification are provided for all that they would convey to a person of ordinary skill in the art. For example, as labeled in the Appendix to Specification, Appendix FIGS. 2A, 34A, and 63A show embodiments of a tall cabinet similar to the tall cabinet shown in FIG. 1 of the present application. Appendix FIGS. 1A, 33A, and 62A show embodiments of a wide cabinet similar to the wide cabinet shown in FIG. 2 of the present application. Appendix FIGS. 3A, 35A, and 64D show embodiments of a modular cabinet similar to the modular cabinet shown in FIG. 3 of the present application. Appendix FIGS. 4A, 36A, and 65A show embodiments of a short two door cabinet similar to the short two door cabinet shown in FIG. 4 of the present application. Appendix FIGS. 5A, 37A, and 66A show embodiments of a short five drawer cabinet similar to the short five drawer cabinet shown in FIG. 5 of the present application. Appendix FIGS. 6A, 38A, and 67A show embodiments of a wall cabinet similar to the wall cabinet shown in FIG. 6 of the present application. Appendix FIGS. 7A, 39A, and 68A show embodiments of a work bench similar to the work bench shown in FIG. 7 of the present application. Appendix FIGS. 8A-10A, 40A-42A, and 69A-71A show embodiments of short two door cabinets similar to the short two door cabinets shown in FIGS. 8-10 of the present application. Appendix FIGS. 11A-14A, 43A-45A, and 72A-75A show embodiments of short five drawer cabinets similar to the short five drawer cabinets shown in FIGS. 11-16 of the present application. Appendix FIGS. 15A-18A, 46A-48A, and 76A-78A show embodiments of wide cabinets similar to the wide cabinets shown in FIGS. 17-19 of the present application. Appendix FIGS. 19A-21A, 49A-51A, and 79A-81A show embodiments of tall cabinets similar to the tall cabinets shown in FIGS. 20-21 of the present application. Appendix FIGS. 22A-26A, 52A-56A, and 82A-86A show embodiments of modular cabinets and cabinet units associated therewith similar to the modular cabinets and cabinet units associated therewith shown in FIGS. 22-27 of the present application. Appendix FIGS. 27A-30A, 57A-59A, and 87A-89A show embodiments of wall cabinets similar to the wall cabinets shown in FIGS. 28-30 of the present application. Appendix FIGS. 31A-32A, 60A-61A, and 90A-91A show embodiments of work benches similar to the work benches shown in FIGS. 31-34 of the present application. Appendix FIGS. 92A-93A show embodiments of a shelf similar to the shelf shown in FIGS. 35-36 of the present application. Appendix FIGS. 94A-96A show embodiments of a foldable shelf similar to the foldable shelf shown in FIGS. 37-39 of the present application. Appendix FIGS. 97A-101A show embodiments of a shelf with a secondary work surface similar to the shelf with a secondary work surface shown in FIGS. 40-44 of the present application. Appendix FIGS. 102A-105A show embodiments of a half shelf similar to the half shelf shown in FIGS. 45-48 of the present application. Appendix FIGS. 106A-114A and 117A-120A show embodiments of accessory storage bins similar to the accessory storage bins shown in FIGS. 49-57 and 60-63 of the present application. Appendix FIGS. 115A-116A show embodiments of an erasable board similar to the erasable board shown in FIGS. 58-59 of the present application. Appendix FIG. 121A shows embodiments of a cabinet attachment mechanism similar to the cabinet attachment mechanisms shown in FIGS. 64A-64C of the present application. Appendix FIG. 122A shows embodiments of a cabinet door hinge similar to the cabinet door hinge shown in FIGS. 65 and 71 of the present application. Appendix FIGS. 123A-127A show embodiments of drawer configurations similar to the drawer configurations shown in FIGS. 66-70 of the present application.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. A modular storage cabinet comprising:

a cabinet unit defining a top wall, a bottom wall, a left side wall, a right side wall, and a rear wall; and a first shelf extending between the left side wall and the right side wall, the first shelf comprising:

a shelf frame engaged with the cabinet unit; and a foldable panel supported by the shelf frame and configured to pivot about a hinge defined within shelf frame between an in-use position and one or more folded positions, wherein the hinge defines an axis parallel to the rear wall, and wherein, in the one or more folded positions, the foldable panel is folded in a rearward direction toward the rear wall of the cabinet unit about the axis, wherein the first shelf further comprises a second panel supported by the shelf frame, wherein the foldable panel is configured to pivot about the axis independently of the second panel, and wherein the second panel is a second foldable panel hingedly connected to the shelf frame and configured to pivot about a second hinge independently of the foldable panel.

2. The modular storage cabinet of claim 1, further comprising a second shelf engaged with the cabinet unit and extending between the left side wall and the right side wall, wherein the first shelf is disposed closer to the bottom wall than the second shelf.

3. The modular storage cabinet of claim 2, wherein the second shelf further comprises a third foldable panel hingedly connected to a second shelf frame, wherein the third foldable panel is configured to pivot about a third hinge defined within the second shelf frame between a second in-use position and a second folded position; and wherein the third foldable panel is configured to pivot independently of the foldable panel.

4. The modular storage cabinet of claim 3, wherein the foldable panel and the third foldable panel are disposed at a same horizontal position within the cabinet unit to collectively define a vertical space within the cabinet unit upon the foldable panel and the third foldable panel being arranged in the one or more folded positions and the second folded position, respectively.

5. The modular storage cabinet of claim 2, wherein the second shelf comprises a first work surface and a drawer positioned beneath the first work surface, the drawer comprising a secondary work surface configured to extend from beneath the first work surface to an in-use position.

6. The modular storage cabinet of claim 2, wherein the second shelf comprises an at least partially retractable panel comprising a fixed portion and a slidable portion, wherein the slidable portion is configured to slide relative to the fixed portion between a stowed position and a second in-use position, and wherein in the stowed position, at least a portion of the slidable portion is disposed below the fixed portion.

7. The modular storage cabinet of claim 6, wherein the stowed position of the second shelf is defined at least in part by an open space provided at least substantially adjacent the fixed portion of the second panel.

8. The modular storage cabinet of claim 1, wherein the shelf frame comprises a rear support arm extending at least partially between the left side wall and the right side wall of the cabinet unit, a first lateral support arm extending from a first lateral side of the rear support arm, and a second lateral support arm extending from a second lateral side of the rear support arm.

9. The modular storage cabinet of claim 8, wherein the shelf frame further comprises at least one flange projecting from each of the lateral support arms, one of the at least one flange being configured to support the foldable panel such that the panel sits flush relative to at least one surface of the frame.

10. The modular storage cabinet of claim 8, wherein the shelf frame further comprises a center arm extending from a central portion of the rear support arm, wherein the center arm is at least substantially parallel to at least one of the first lateral support arm and the second lateral support arm, and wherein the center arm is arranged between the foldable panel and a second panel of the first shelf.

11. The modular storage cabinet of claim 1, wherein the cabinet unit comprises one or more magnets configured to interact with the foldable panel to facilitate a positioning of the foldable panel in at least one of the one or more folded positions.

12. The modular storage cabinet of claim 1, further comprising a second cabinet unit comprising a second top wall and a second bottom wall, wherein the cabinet unit and the second cabinet unit define a first configuration in which the top wall of the cabinet unit is connected to the second bottom wall of the second cabinet unit such that the cabinet unit and the second cabinet unit are fixedly attached with the second cabinet unit on top and a second configuration in which the bottom wall of the cabinet unit is connected to the second top wall of the second cabinet unit such that the cabinet unit and the second cabinet unit are fixedly attached with the cabinet unit on top.

13. The modular storage cabinet of claim 12, wherein each of the cabinet unit and the second cabinet unit comprises at least one first locking mechanism disposed at their respective bottom walls, wherein each of the cabinet unit and the second cabinet unit comprises at least one second locking mechanism disposed at their respective top walls, wherein each first locking mechanism is structured to engage each second locking mechanism.

14. A modular storage cabinet system comprising the modular storage cabinet of claim 1, the modular storage cabinet system further comprising a second modular storage cabinet configured for selective attachment to the modular storage cabinet.

* * * * *